US006464319B1

(12) United States Patent
Teshigawara et al.

(10) Patent No.: US 6,464,319 B1
(45) Date of Patent: Oct. 15, 2002

(54) ADJUSTMENT METHOD OF DOT PRINTING POSITIONS AND A PRINTING APPARATUS

(75) Inventors: Minoru Teshigawara, Urawa; Naoji Otsuka, Yokohama; Kiichiro Takahashi, Kawasaki; Hitoshi Nishikori, Inagi; Osamu Iwasaki; Toshiyuki Chikuma, both of Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/425,990

(22) Filed: Oct. 25, 1999

(30) Foreign Application Priority Data

Oct. 27, 1998 (JP) ..... 10-306190

(51) Int. Cl.[7] ..... B41J 29/393; B41J 2/145; B41J 11/44

(52) U.S. Cl. ..... 347/19; 347/41; 400/76

(58) Field of Search ..... 347/19, 14, 15, 347/23, 41, 42, 43, 65, 10, 47, 57; 101/481; 400/70, 61, 74

(56) References Cited

U.S. PATENT DOCUMENTS

| | | | | |
|---|---|---|---|---|
| 4,313,124 A | | 1/1982 | Hara | 346/140 R |
| 4,345,262 A | | 8/1982 | Shirato et al. | 346/140 R |
| 4,459,600 A | | 7/1984 | Sato et al. | 346/140 R |
| 4,463,359 A | | 7/1984 | Ayata et al. | 346/1.1 |
| 4,558,333 A | | 12/1985 | Sugitani et al. | 346/140 R |
| 4,621,890 A | | 11/1986 | Suzuki et al. | 350/6.1 |
| 4,698,648 A | | 10/1987 | Takahashi et al. | 346/108 |
| 4,723,129 A | | 2/1988 | Endo et al. | 346/1.1 |
| 4,740,796 A | | 4/1988 | Endo et al. | 346/1.1 |
| 4,892,372 A | | 1/1990 | Chonan et al. | 350/6.8 |
| 5,452,073 A | * | 9/1995 | Kataoka | 355/271 |
| 6,257,143 B1 | * | 7/2001 | Iwasaki et al. | 101/481 |
| 6,330,077 B1 | * | 12/2001 | Sato et al. | 358/1.9 |

FOREIGN PATENT DOCUMENTS

| | | |
|---|---|---|
| EP | 0 540 245 | 5/1993 |
| EP | 0 813 973 | 12/1997 |
| EP | 0 832 752 | 4/1998 |
| EP | 0 931 664 | 7/1999 |
| JP | 54-56847 | 5/1979 |
| JP | 60-71260 | 4/1985 |

* cited by examiner

*Primary Examiner*—John Barlow
*Assistant Examiner*—Charles W. Stewart, Jr.
(74) *Attorney, Agent, or Firm*—Fitzpatrick, Cella, Harper & Scinto

(57) ABSTRACT

In the case where an image is formed with a mixture of large and small droplets by bi-directional printing in an ink jet printing apparatus in which ink is ejected in the form of, e.g., a droplet for printing operation while scanning by a print head, misalignment caused by a difference in ejection speed between the large and small droplets is prevented. For this purpose, there is provided a printing registration method according to the present invention comprises the steps of forming reference dots with the large and small droplets in forward scan printing, forming shifted dots in reverse scan printing on changed registration conditions, acquiring a adjustment value of the condition of dot forming positions on the basis of optical characteristics according to a plurality of shifting amounts of the relative printing positions between forward scanning and reverse scanning, controlling the order of formation of the large and small dots in the forward scanning and the reverse scanning, and correcting the adjustment value according to the offset amount of the small dot forming positions on the basis of the difference in ejection speed or the like.

26 Claims, 58 Drawing Sheets

CHECKER OR LATTICE PATTERN

INVERTED CHECKER OR LATTICE PATTERN

OFFSETTING AMOUNT: -4DOTS (RELATIVE POSITION)

OFFSETTING AMOUNT: -2DOTS (RELATIVE POSITION)

OFFSETTING AMOUNT: 0DOTS (RELATIVE POSITION)

OFFSETTING AMOUNT: +2DOTS (RELATIVE POSITION)

OFFSETTING AMOUNT: +4DOTS (RELATIVE POSITION)

:REFERENCE DOT (FORWARD SCAN RECORDING)

:OFFSETTING OR SHIFTING DOT (REVERSE SCAN RECORDING)

OFFSETTING AMOUNT: -0.5DOTS (RELATIVE POSITION)

OFFSETTING AMOUNT: -0.25DOTS (RELATIVE POSITION)

OFFSETTING AMOUNT: 0DOTS (RELATIVE POSITION)

OFFSETTING AMOUNT: +0.25DOTS (RELATIVE POSITION)

OFFSETTING AMOUNT: +0.5DOTS (RELATIVE POSITION)

:REFERENCE DOT (FORWARD SCAN RECORDING)

:OFFSETTING OR SHIFTING DOT (REVERSE SCAN RECORDING)

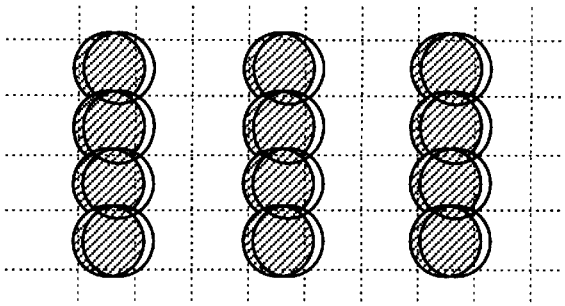
FIG.42A
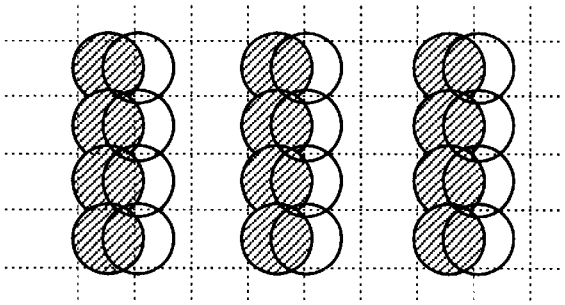
FIG.42B
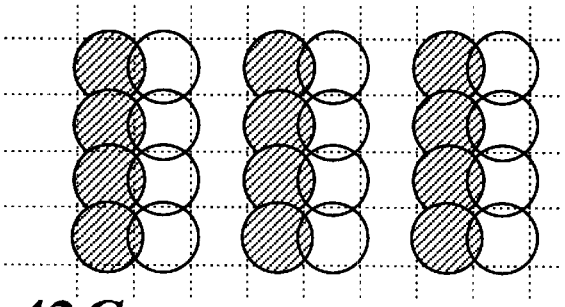
FIG.42C
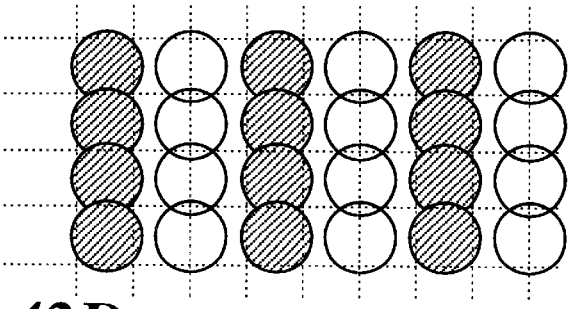
FIG.42D
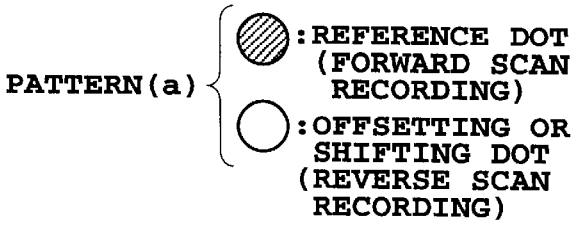

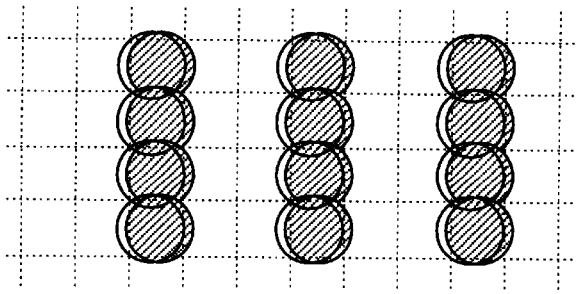
FIG.43A
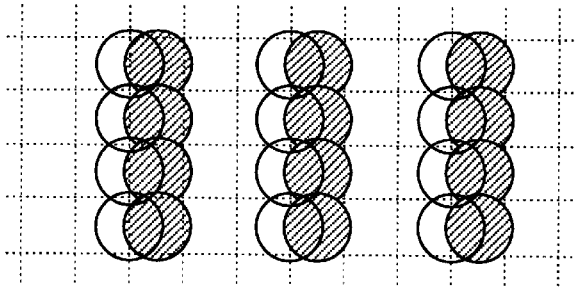
FIG.43B
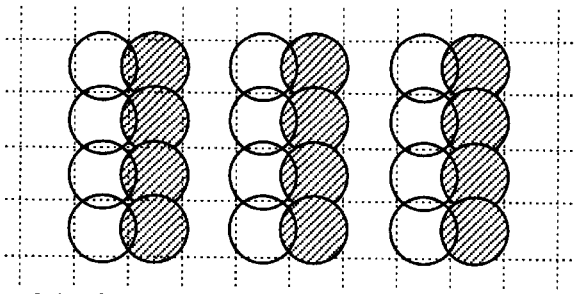
FIG.43C
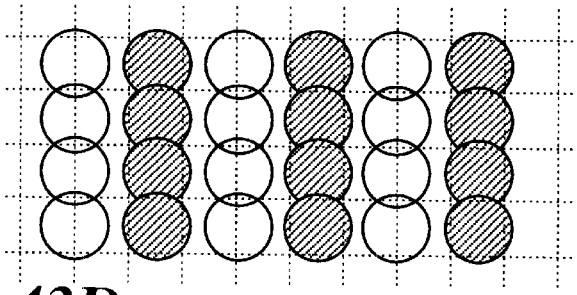
FIG.43D
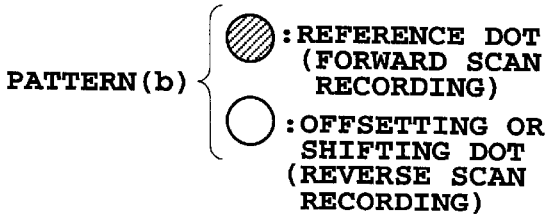

(b) IS CASE WHERE EJECTION SPEED IS LOW WITH RESPECT TO (a)
→OFFSET OF DEPOSITING POSITION BECOMES LARGE (c) IS CASE WHERE CARRIAGE SPEED IS LARGE WITH RESPECT TO (b)
→OFFSET OF DEPOSITING POSITION BECOMES LARGE

| OBJECT TO BE ADJUSTED | RESOLUTION (DPI) | DROP SIZE | PRINTER 1 (COLOR OF OBJECT TO BE ADJUSTED) | | PRINTER 2 (COLOR OF OBJECT TO BE ADJUSTED) | |
|---|---|---|---|---|---|---|
| | | | HEAD 1 | HEAD 2 | HEAD 3 | HEAD 4 |
| REVERSE SCAN DIRECTION, BETWEEN TWO-HEADS | 360×360 | LARGE | Bk/c | LC/c | - | - |
| HORIZONTAL SCAN DIRECTION, BETWEEN TWO-HEADS | 360×360 | LARGE | Bk/c | LC/c | - | - |
| | 180×180 | LARGE | Bk/c | LC/c | - | - |
| | 720×720 | SMALL | Bk/c | LC/c | - | - |
| | 1,440×720 | SMALL | Bk/c | LC/c | - | - |
| BETWEEN BIDIRECTIONAL-RECIPROCAL HORIZONTAL SCANS | 360×360 | LARGE | Bk | Bk | Bk | Bk |
| | 180×180 | LARGE | Bk | Bk | Bk | Bk |
| | 720×720 | SMALL | Bk | Bk | Bk | Bk |

HORIZONTAL SCAN SPEED EVERY RESOLUTION:
180×180→30 INCH/SEC;360×360→20 INCH/SEC
720×720→20 INCH/SEC;1,420×720→10 INCH/SEC

AMOUNT OF INK EJECTION EVERY DROP SIZE:
"HEAD 1","HEAD 4"→LARGE (80 DPI),SMALL (40 DPI)
"HEAD 2","HEAD 3"→LARGE (40 DPI),SMALL (15 DPI)

*FIG.48*

| FIG.49A | FIG.49B |
|---|---|

1/360INCH(≒70μm)

(a) IDEAL DEPOSITING POSITIONS OF LARGE DOTS (b) IDEAL DEPOSITING POSITIONS OF SMALL DOTS (c) IDEAL DEPOSITING POSITIONS OF LARGE AND SMALL DOTS (d) DEPOSITING POSITIONS (i)OF LARGE AND SMALL DOTS

EJECTION ORDER { FORWARD SCANNING : SMALL → LARGE
REVERSE SCANNING : LARGE → SMALL (BI-DIRECTIONAL DEPOSITING MISALIGNMENT BETWEEN SMALL DOTS : 10μm)

(e) DEPOSITING POSITIONS (ii)OF LARGE AND SMALL DOTS

EJECTION ORDER { FORWARD SCANNING : SMALL → LARGE
REVERSE SCANNING : LARGE → SMALL (BI-DIRECTIONAL DEPOSITING MISALIGNMENT BETWEEN SMALL DOTS : 70μm)

(f) DEPOSITING POSITIONS (iii)OF LARGE AND SMALL DOTS

EJECTION ORDER { FORWARD SCANNING : SMALL → LARGE
REVERSE SCANNING : SMALL → LARGE (EACH OF BI-DIRECTIONAL DEPOSITING MISALIGNMENT BETWEEN LARGE DOTS AND BETWEEN SMALL DOTS : 35μm)

(g) DEPOSITING POSITIONS (iv)OF LARGE AND SMALL DOTS

EJECTION ORDER { FORWARD SCANNING : SMALL → LARGE
REVERSE SCANNING : SMALL → LARGE
(SHIFT OF : 35μm)

(BI-DIRECTIONAL DEPOSITING MISALIGNMENT BETWEEN SMALL DOTS : 10μm)

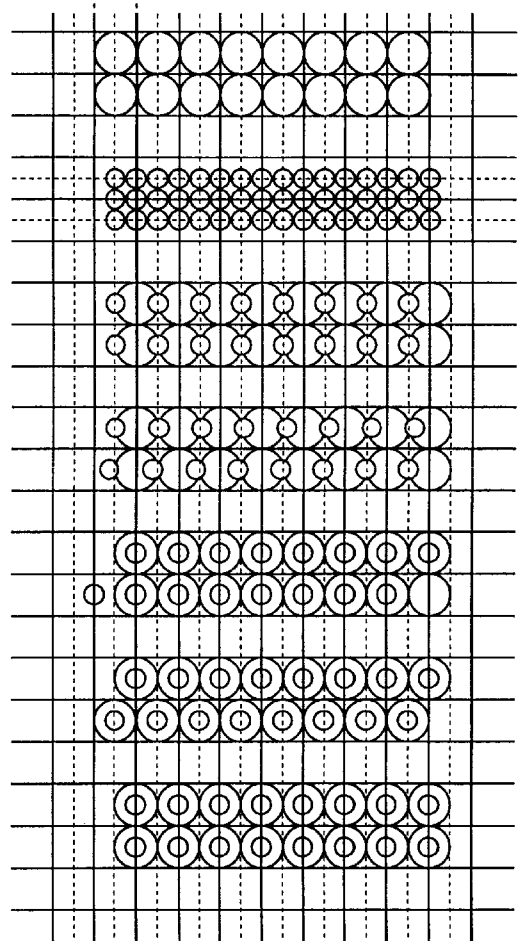

FIG.52

REGISTERED PATTERN

+ SHIFTING DIRECTION

- SHIFTING DIRECTION

REGISTERED PATTERN

+ SHIFTING DIRECTION

- SHIFTING DIRECTION

ADJUSTMENT METHOD OF DOT PRINTING POSITIONS AND A PRINTING APPARATUS

This invention is based on Patent Application No. 306190/1998 filed on Oct. 27, 1998 in Japan, the content of which is incorporated hereinto by reference.

BACKGROUND OF THE INVENTION

1. Field of the Invention

The present invention relates to a method for adjusting dot forming or depositing positions in dot matrix recording and a printing apparatus using the method. More particularly, the present invention relates to a method for adjusting dot forming positions, which are applicable to printing registration in the case of bi-directionally printing by a forward and reverse scan of a print head or to printing registration in the case of printing by means of a plurality of print heads, and printing apparatus using the method.

2. Description of the Related Art

In recent years, the office automation instruments such as the personal computer and the word processor which is relatively cheap are widely used, and an improvement in high-speed technique and an improvement in high image quality technique of various recording apparatuses for printing-out the information which are entered by the instruments are developed rapidly. In recording apparatuses, a serial printer using a dot matrix recording (printing) method comes to attention as a recording apparatus (a printing apparatus) which realizes printing of a high speed or high image quality with the low cost. For such printers, as the technique which prints at high speed, for example there is a bi-directional printing method and as the technique which the prints in high image quality, for example, there is a multi scanning printing method.

(Bi-directional Printing Method)

As the improvement in high-speed technique, in a printing head which has a plurality of printing elements, although it is also thought to plan an increase in the number of a printing elements and an improvement in a scanning speed of the print head, it is also an effective method to perform bi-directional printing scannings of the print head.

Although, since there is usually the time required for paper-feeding and paper-discharging or the like, it does not become a simply proportional relation, in the bi-directional printing a printing speed of approximately two times can be obtained as compared with the one-directional printing in the printing apparatus.

For example, when using the print head which the 64 pieces of ejection openings are arranged with 360 dpi (dots/inch) in printing density in a direction different from the printing scanning (main scanning) direction (for example, in a sub-scanning direction which is the feeding direction of the printing medium), a printing is performed on, a printing medium of A4 size set in the direction of the length, the printing can be completed by scanning of approximately 60 times. The reason is that, in one-directional printing, each printing scanning is performed only at the time of the movement in the one direction from the predetermined scanning commencement position, and since non-printing scanning to the inverse direction for returning to the scanning commencement position from a scanning completion position is attended, reciprocation of approximately 60 times is required. On the other hand, printing is completed by the reciprocating printing scanning of approximately 30 times in bi-directional printing, so that printing can be performed and since it becomes possible on at the speed of approximately 2 times, whereby bi-directional printing can be considered to be an effective method for an improvement in a printing speed.

In order to register dot-forming positions (for example, for an ink jet printing apparatus, a deposition or landing position of ink) at a forward trip and a return trip together in such bi-directional printing, using a position detection means such as an encoder, based on the detecting position, printing timing is controlled. However, it has been thought that since to form such a feedback controlled system causes an increase in the cost of the printing apparatus, it is difficult to realize this, in the printing apparatus which is relatively cheap.

(Multi Scanning Printing Method)

Secondly, a multi scanning printing method is explained as one example of the improvement in high image quality technique.

When printing is performed using the print head which has a plurality of printing elements, quality of the printed image depends on performance of a print head itself greatly. For example, in the case of the ink-jet print head, the slight differences, which is generated in a print head manufacturing step, such as variations of a form of ink ejection openings and the elements for generating energy for ejecting ink such as an electro-thermal converting elements (ejection heaters), influence a direction and an amount of ejected ink, and result in the cause which makes the unevenness in density of the image which is formed finally to reduce the image quality.

Specific examples are described using FIGS. 1A to 1C and FIGS. 2A to 2C. Referring to FIG. 1A, a reference numeral 201 denotes a print head, and for simplicity, is constituted by the eight pieces of nozzles 202 (herein, as far as not mentioned specifically, refer to the ejection opening, the liquid passage communicated with this opening and the element for generating an energy used for ink, in summary). A reference numeral 203 denotes the ink, for example, which are ejected as a drop from the nozzle 202. It is ideal that the ink is ejected from each ejection opening by the approximately uniform amount of discharge and in the justified direction as shown in this drawing. When such discharge is performed, as shown in FIG. 1B, ink dots which are justified in size are deposited or landed on the printing medium and, as shown in FIG. 1C, the uniform images that there is no unevenness in density also as a whole can be obtained.

However, there are the variations in the nozzles in the print head 20 actually as is mentioned above, and when printing is performed as mentioned above as it is, as shown in FIG. 2A, the variations are caused in size of the ink drops and in the ejecting direction of ink discharged from nozzles and the ink drops are deposit or landed on a printing medium as shown in FIG. 2B. In this drawing, a part of the white paper that an area factor cannot be served up to 100% periodically exists with respect to the horizontal scanning direction of the head, moreover, in contrast with this, the dots are overlapped each other more than required or white stripes as shown in the center of this drawing have been generated. A gathering of the landed dots in such condition forms the density distribution shown in FIG. 2C to the direction in which nozzles are arranged, and the result is that, so far as usually seen by eyes of a human, these objects are sensed as the unevenness in density.

Therefore, as a countermeasure of this unevenness in density, the following method has been devised. The method is described using FIGS. 3A to 3C and FIGS. 4A to 4B.

According to this method, in order that the printing with regard to the same region as shown in FIG. 1B and FIG. 2B is made to be completed, the print head 201 is scanned 3 times as shown in FIG. 3A and FIGS. 4A to 4C. The region defining four pixels which is a half of eight pixels as a unit in the direction of length in the drawing has been completed by two passes. In this case, the 8 nozzles of the print head are divided into a group of 4 nozzles of upper half and 4 nozzles of lower half in the drawing and the dots which one nozzle forms by scanning of one time are the dots that the image data are thinned into approximately a half in accordance with the certain predetermined image data arrangement. Moreover, at the second scanning, the dots are embedded in the image data of the half of the remaining and the regions defined four pixels as the unit are completed progressively. Hereinafter, the printing method described above is referred to as a multi scanning printing method.

Using such printing method, even when the print head 201 which is equal to the print head 201 shown in FIG. 2A are used, the influence to the printed image by the variations of each nozzle is reduced by half, whereby the printed image becomes as shown in FIG. 3B and no black stripe and white stripe as shown in FIG. 2B becomes easy to be seen. Therefore, the unevenness in density is fairly also mitigated as compared with the case of FIG. 2C as shown in FIG. 3C.

When such printing is performed, although at first scanning and at second scanning, the image data are mutually divided in a manner to be complemental each other in accordance with the certain predetermined arrangement (a mask), usually, this image data arrangement (the thinned patterns) as shown in FIGS. 4A to 4C, at every one pixel arranged in rows and columns, it is most general to use the formation which makes to form a checker or lattice matrix.

In a unit printing region (here, per four pixels), printing is completed by the first scanning which forms the dots into the checker or lattice pattern and the second scanning which forms the dots into the inverted checker or lattice pattern.

Moreover, usually, travel (vertical scanning travel) of the printing medium between each main scanning is established at a constant, and in the case of FIG. 3 and FIG. 4, is made to move every four nozzles equally.

(Dot Alignment)

As an example of the other improvement in high image quality technique in the dot matrix printing method, there is a dot alignment technique adjusting the dot depositing position. A dot alignment is an adjustment method adjusting the positions which the dots on the printing medium have formed by any means, and in general, the prior dot alignment has been performed as follows.

For example, a ruled line or the like is printed on a printing medium in depositing registration of the forward scan and the reverse scan upon reciprocal or bi-directional printing by adjusting printing timing in the forward scan and the reverse scan respectively, while a relative printing position condition in reciprocal scan is varied. The results of printing has been observed by a user oneself to select the printing condition where best printing registration is achieved, that is, the condition that printing is performed without offset of the ruled line or the like and to set the condition directly into the printing apparatus by entering through a key-operation or the like or to set the depositing position condition into the printing apparatus by operating a host computer through an application.

Moreover, the ruled line or the like is printed on the medium under printing in the printing apparatus having a plurality of heads, when printing is performed between a plurality of heads, while a relative printing position condition between a plurality of heads is varied, with the respective head. As is mentioned above, the optimum condition that best printing registration is achieved has been selected to vary the relative printing position condition to set the printing position condition into the printing apparatus every each head in the mentioned-above manner.

Here, the case where the offset of the dots has been occurred is described.

(Problems Upon Performing Image-formation by Bi-directional Printing)

Due to bi-directional printing, the following problems have been caused.

First, when the ruled line (the ruled line of the longitudinal direction) in the direction perpendicular to the horizontal scan of the print head is printed, between the ruled line element which is printed in the forward scan and the ruled line element which is printed in the reverse scan, the dot depositing positions are not registered and the ruled line is not formed into a straight line, but a difference in level occurs. This is referred to as a so-called "offset in ruled line", and this is considered to be the most general disorder which can be recognized by the usual users. In the many cases, the ruled line is formed by a black color, whereby, though the offset in ruled line has been understood as the problem where a monochrome image is formed generally, a similar phenomenon can be caused in the color image also.

(Problems in Performing Image Formation by Bi-directional Printing Accompanied by Variations of Ink Ejection Quantity)

In the case of the ink jet printing apparatus, a size of a printing dot is determined by mainly a quantity of ink to be ejected from a print head. Consequently, if printing is performed by appropriately using ink dots in a relatively small ejection quantity, high resolution can be achieved. To the contrary, in the case of so-called "solid" printing, if printing is performed by using ink dots in a relatively large ejection quantity, printing efficiency can be enhanced.

In general, in the case of an ink jet printing apparatus in which ink is ejected in the form of, e.g., a droplet in printing operation while scanning by a print head, the depositing position of the droplet is affected by a scanning speed component. In general, if a quantity of ink to be ejected is varied, an ejection speed is varied accordingly. For example, in the case where large and small droplets are used together and an image is formed by bi-directional printing, even if the optimum conditions of a printing position in the bi-directional printing with large droplets are determined, registration of the small droplets is liable to be offset with respect to the large droplets.

With occurrence of such misalignment, an image which may give a granular impression as a whole is formed in the case of printing a uniform halftone pattern, so that some users may often recognize such an image as an unpleasant design.

(Problems in the Case of Performing the Image Formation Using a Plurality of the Print Heads)

In the printing apparatus having a plurality of heads, the problems of the case where the offset in the depositing positions of the dots between a plurality of heads has been occurred is discussed.

When the image printing is performed, several colors are combined to perform the image formation frequently, and it is general to use four colors which added black in addition to three primary colors of yellow, magenta and cyan and it is used most abundantly. When in the case where a plurality of print heads for printing these colors are used, there is the offset of the depositing positions between the print heads, depending upon the amount of the offset, when a different color one another is about to be printed on the same pixel, a deviation in color matching is caused. For example, magenta and cyan are used to form the blue image, and although the part that the dots of both colors are overlapped becomes blue, the part which is not overlapped each other does not become blue, so that the deviation in color matching (irregular color) that each independent color tone appears is caused. When this occurs partially, it does not become easy to be seen, but when this phenomenon occurs in the direction of scanning continuously, a band-shaped deviation in color matching with a certain specific width is caused, so that the image becomes unequal. In addition, in a region adjacent the image region in the case of in the regions of the same color, when there is no offset in the depositing positions of the dots, a uniform impression and color development differ between the image regions adjacent each other, so that the image that there is a sense of incongruity as the image is formed. Moreover, though this deviation in color matching does not become easy to be seen in the case of an ordinary paper, it becomes easy to be seen, when a favorable printing medium in color development such as a coat paper is used.

Moreover, in the case where a different color is printed on adjoining the pixel, when there is the offset in the depositing positions of the dot, the clearance, that is, the region which is not covered by the ink on the part have caused and, the ground of the printing medium can be seen. This phenomenon frequently is called "white clearance", since the case of a white ground is frequent in the printing medium generally. This phenomenon is easy to be seen in the image high in contrast, and when a black image is formed as a colored back ground, the white clearance which no ink is deposited between a black and coloration, since a contrast between white and black is high, can be easy to be seen more clearly.

It is effective to perform the above-mentioned dot alignment in order to suppressed occurring of the problems as mentioned above. However, the complicatedness that the user should observe the results which the depositing registration conditions are varied by the eyes to select the optimized the depositing registration condition to perform entering operations is accompanied, and moreover, since fundamentally, a judgment for obtaining the optimum printing position by observing through eyes is enforced on the user, the establishment which is not optimized can be set. Therefore, it is especially unfavorable to the user who is not accustomed to operation.

Moreover, the user is enforced to expense in time and effort at least two times since the user should printing the image to perform the depositing registration and in addition, to perform conditional establishment after observing to perform judgments required, whereby upon realizing the apparatus or a system excellent in operability, it is not only desirable but also is disadvantageous from the viewpoint of a time-consumption.

Namely, it has been desired strongly that the apparatus or system capable of printing the image at a high speed and of the high-quality image without occurring the problem on the image formation as above-mentioned and the problem on the operability is realized at a low cost by designing to be able to register the depositing position without using a feedback controlling means such as an encoder by an opened loop.

SUMMARY OF THE INVENTION

Therefore, the object of the invention is to realize a dot alignment method which is excellent in operational performance and the low cost.

Moreover, the invention, without fundamentally enforcing the user the judgment and the adjustment, is designed to detect the optical characteristics of the printed image to derive the adjustment condition of the optimum dot alignment from the detected results and to set the adjustment condition automatically, thereby to improve the adjustment accuracy thereof.

In a first aspect of the present invention, there is provided a printing registration method for performing printing registration in a first printing and a second printing with respect to a printing apparatus for printing an image on a printing medium by the first printing and the second printing with predetermined conditions of dot forming positions by using a print head, in which a dot can be changed in at least two kinds of large and small sizes, the method comprising the steps of:

forming a plurality of patterns according to a plurality of shifting amounts of relative printing positions between the first printing and the second printing by controlling the print head, the pattern being formed with at least either one of the large and small dots by the first printing and the second printing;

acquiring an adjustment value of a dot forming position condition between the first printing and the second printing on the basis of the shifting amounts of the relative printing positions among the plurality of formed patterns; and correcting the adjustment value according to an offset amount of the forming position caused by printing operation by the first printing and the second printing with at least the other of the large and small dots.

In a second aspect of the present invention, there is provided a printing apparatus for printing an image on a printing medium by a first printing and a second printing with predetermined conditions of dot forming positions by using a print head, in which a dot can be changed in at least two kinds of large and small sizes, comprising:

means for forming a plurality of patterns according to a plurality of shifting amounts of relative printing positions between the first printing and the second printing by controlling the print head, the pattern being formed with at least either one of the large and small dots by the first printing and the second printing;

means for acquiring an adjustment value of a dot forming position condition between the first printing and the second printing on the basis of the shifting amounts of the relative printing positions among the plurality of formed patterns; and means for correcting the adjustment value according to an offset amount of the forming position caused by printing operation by the first printing and the second printing with at least the other of the large and small dots.

In a third aspect of the present invention, there is provided a printing system provided with a printing apparatus for printing an image on a printing medium by a first printing and a second printing with predetermined conditions of dot forming positions by using a print head, in which a dot can be changed in at least two kinds of large and small sizes, and a host apparatus for supplying an image data to the printing apparatus, comprising:

means for forming a plurality of patterns according to a plurality of shifting amounts of relative printing positions between the first printing and the second printing by controlling the print head, the pattern being formed with at least either one of the large and small dots by the first printing and the second printing;

means for acquiring an adjustment value of a dot forming position condition between the first printing and the second printing on the basis of the shifting amounts of the relative printing positions among the plurality of formed patterns; and means for correcting the adjustment value according to an offset amount of the forming position caused by printing operation by the first printing and the second printing with at least the other of the large and small dots.

In a fourth aspect of the present invention, there is provided a storage medium which is connected to an information processing apparatus and a program stored in which is readable by the information processing apparatus, the program being for making a printing system to perform a method for processing for performing printing registration in a first printing and a second printing with respective to a printing apparatus for printing an image on a printing medium by the first printing and the second printing with predetermined conditions of dot forming positions by using a print head, in which a dot can be changed in at least two kinds of large and small sizes, the method comprising the steps of:

forming a plurality of patterns according to a plurality of shifting amounts of relative printing positions between the first printing and the second printing by controlling the print head, the pattern being formed with at least either one of the large and small dots by the first printing and the second printing;

acquiring an adjustment value of a dot forming position condition between the first printing and the second printing on the basis of the shifting amounts of the relative printing positions among the plurality of formed patterns; and correcting the adjustment value according to an offset amount of the forming position caused by printing operation by the first printing and the second printing with at least the other of the large and small dots.

Incidentally, hereafter, the word "print" (hereinafter, referred to as "record" also) represents not only forming of significant information, such as characters, graphic image or the like but also represent to form image, patterns and the like on the printing medium irrespective whether it is significant or not and whether the formed image elicited to be visually perceptible or not, in broad sense, and further includes the case where the medium is processed.

Here, the wording "printing medium" represents not only paper to typically used in the printing apparatus but also cloth, plastic film, metal plate and the like and any substance which can accept the ink in broad sense.

Furthermore, the wording "ink" has to be understood in broad sense similarly to the definition of "print" and should include any liquid to be used for formation of image patterns and the like or for processing of the printing medium.

The above and other objects, effects, features and advantages of the present invention will become more apparent from the following description of embodiments thereof taken in conjunction with the accompanying drawings.

BRIEF DESCRIPTION OF THE DRAWINGS

FIGS. 13A to 13C are schematic views respectively illustrating printing patterns for use in the first embodiment according to the present invention, wherein FIG. 13A illustrates dots in the case where the printing positions are well registered; FIG. 13B, where the printing positions are registered with a slight offset; and FIG. 13C, where the printing positions are registered with a greater offset;

FIGS. 14A to 14C are schematic views respectively illustrating patterns for printing registration for use in the first embodiment according to the present invention, wherein FIG. 14A illustrates dots in the case where the printing positions are well registered; FIG. 14B, where the printing positions are registered with a slight offset; and FIG. 14C, where the printing positions are registered with a greater offset;

FIGS. 20A to 20C are schematic views respectively illustrating other printing patterns in the first embodiment according to the present invention, wherein FIG. 20A illustrates dots in the case where the printing positions are well registered; FIG. 20B, where the printing positions are registered with a slight offset; and FIG. 20C, where the printing positions are registered with a greater offset;

FIGS. 21A to 21C are schematic views respectively illustrating further printing patterns in the first embodiment according to the present invention, wherein FIG. 21A illustrates dots in the case where the printing positions are well registered; FIG. 21B, where the printing positions are registered with a slight offset; and FIG. 21C, where the printing positions are registered with a greater offset;

FIGS. 22A to 22C are schematic views respectively illustrating still further printing patterns in the first embodiment according to the present invention, wherein FIG. 22A illustrates dots in the case where the printing positions are well registered; FIG. 22B, where the printing positions are registered with a slight offset; and FIG. 22C, where the printing positions are registered with a greater offset;

FIGS. 23A to 23C are schematic views respectively illustrating still further printing patterns in the first embodiment according to the present invention, wherein FIG. 23A illustrates dots in the case where the printing positions are well registered; FIG. 23B, where the printing positions are registered with a slight offset; and FIG. 23C, where the printing positions are registered with a greater offset;

FIGS. 25A to 25C are schematic views illustrating characteristics depending upon a distance between dots of the printing pattern in the second embodiment according to the present invention, wherein FIG. 25A illustrates dots in the case where the printing positions are well registered; FIG. 25B, where the printing positions are registered with a slight offset; and FIG. 25C, where the printing positions are registered with a greater offset;

FIGS. 26A to 26C are schematic views illustrating characteristics depending upon a distance between dots of the printing pattern in the second embodiment according to the present invention, wherein FIG. 26A illustrates dots in the case where the printing positions are well registered; FIG. 26B, where the printing positions are registered with a slight offset; and FIG. 26C, where the printing positions are registered with a greater offset;

FIGS. 28A to 28C are schematic views respectively illustrating printing patterns in a third embodiment according to the present invention, wherein FIG. 28A illustrates dots in the case where the printing positions are well registered; FIG. 28B, where the printing positions are registered with a slight offset; and FIG. 28C, where the printing positions are registered with a greater offset;

FIGS. 42A to 42D are schematic views showing the printing patterns of the other example of the fine adjustment processing of printing registration for bi-directional printing capable of using in the algorithm shown in FIG. 30;

FIGS. 43A to 43D are schematic views showing the inverted patterns to FIGS. 42A to 42D, which are the printing patterns of the other example of the fine adjustment processing of printing registration for bi-directional printing capable of using in the algorithm shown in FIG. 30;

FIG. 48 is an illustration for describing a dot alignment processing in response to modes which the printing apparatus has;

FIG. 52 is a schematic view illustrating misalignment or offset registration of dots formed in bi-directional printing with large and small droplets;

DETAILED DESCRIPTION OF THE PREFERRED EMBODIMENTS

Figures 1A, 1B, 1C:
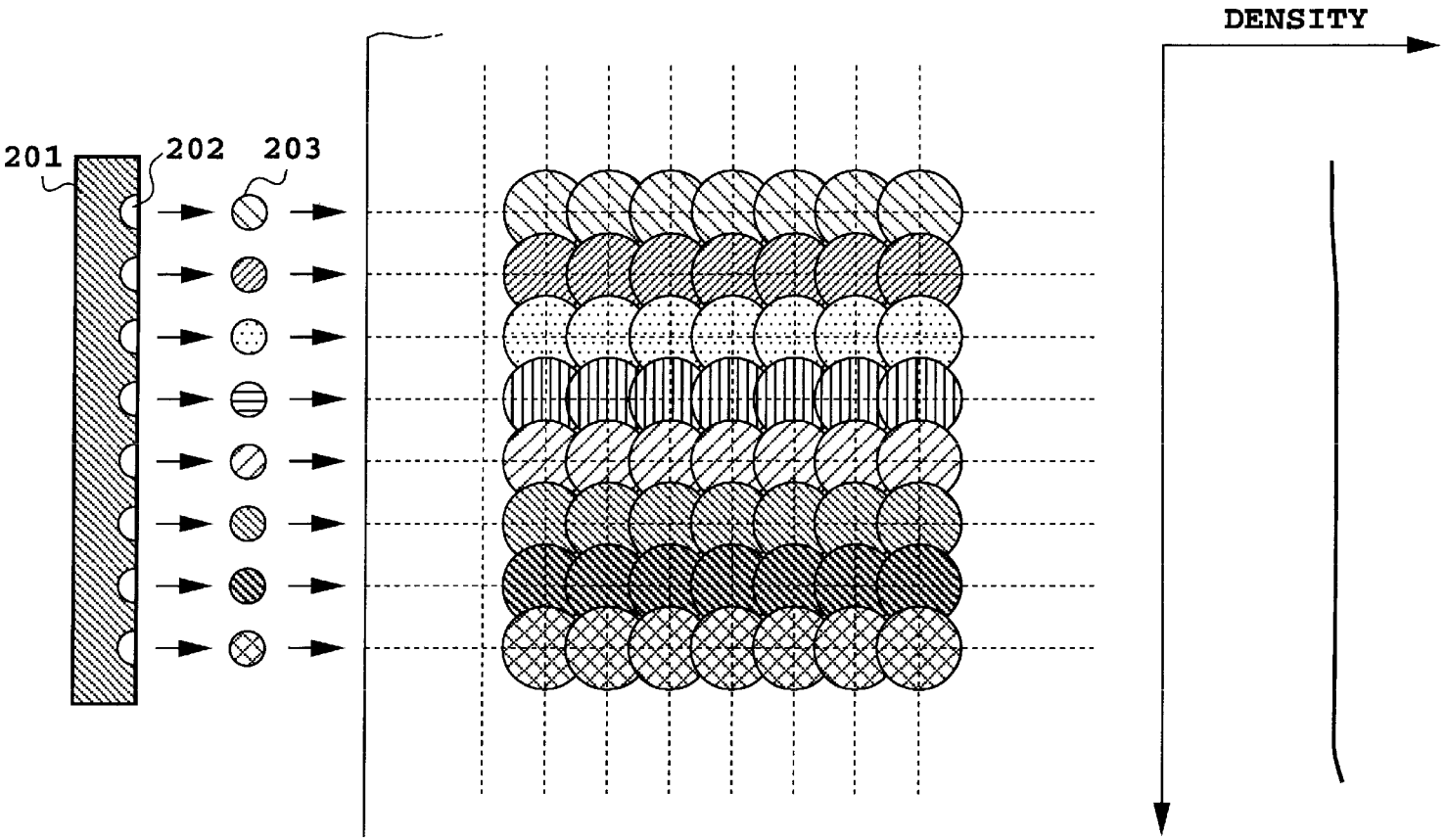
FIGS. 1A to 1C are illustrations for describing a principle of a dot matrix printing.
Figure 2C:
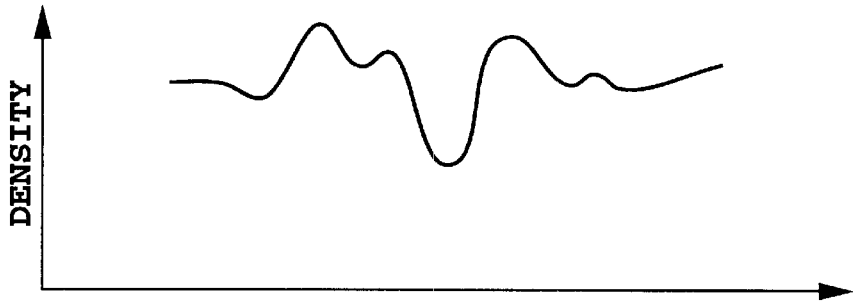
FIGS. 2A to 2C are illustrations for describing a generation of an unevenness in density which can be occurred in the dot matrix printing.
Figure 2B:
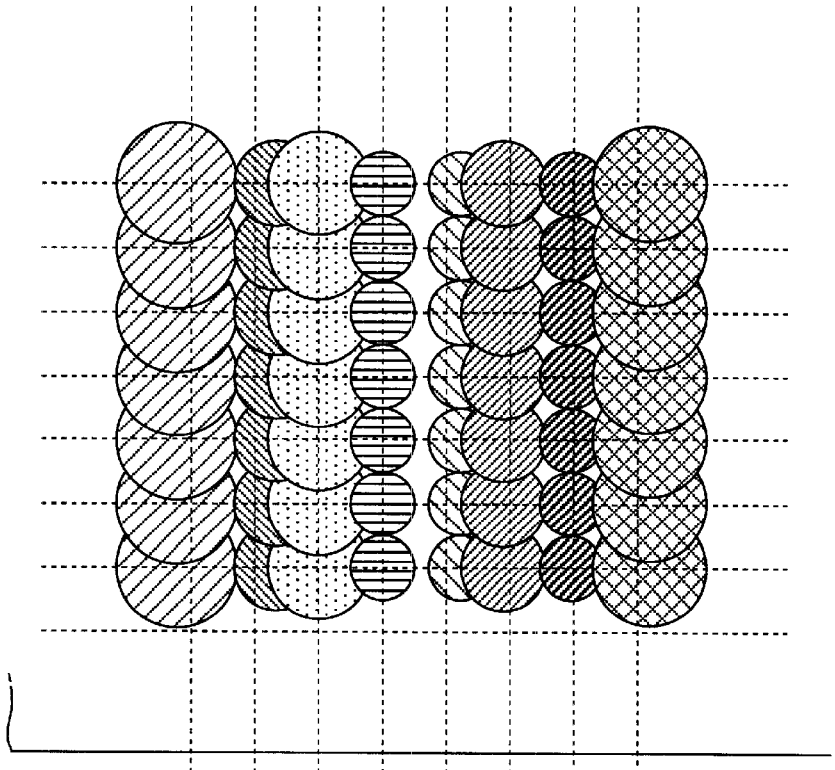
Figure 2A:
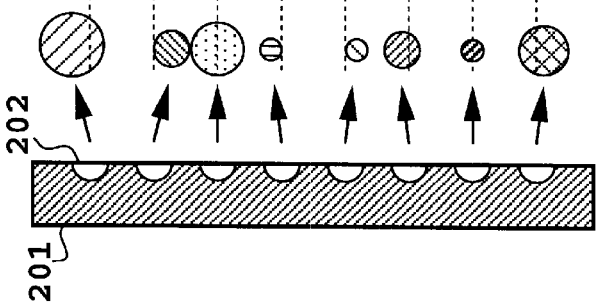
Figures 3A, 3B, 3C:
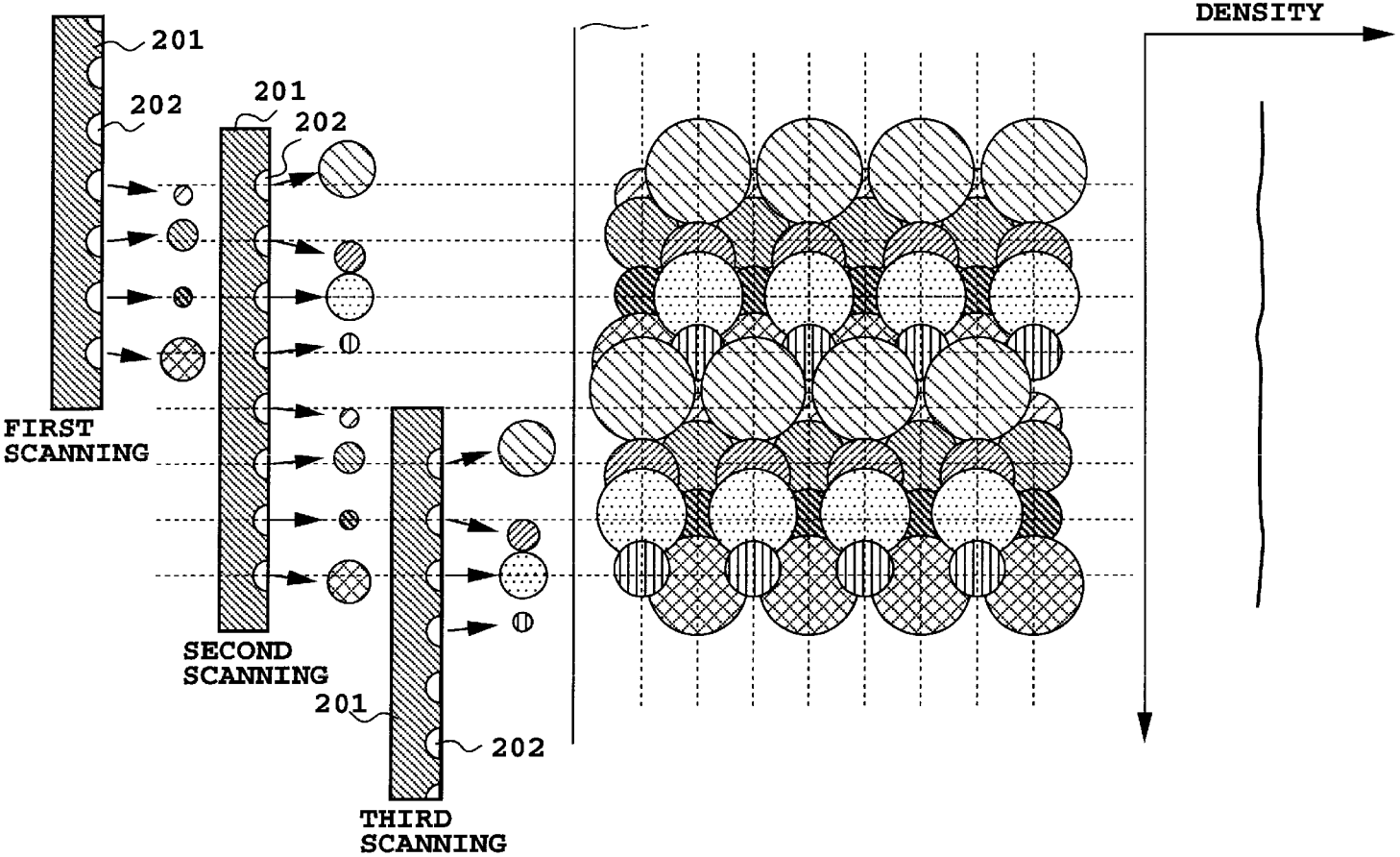
FIGS. 3A to 3C are illustrations for describing a principle of a multi scanning printing for preventing from generating the unevenness in density described in FIGS. 2A to 2C.

Hereinafter, this invention is described in detail with reference to drawings. Moreover, hereafter, the case where the invention is applied to an ink jet printing apparatus and a printing system using this is described mainly.

1. Summary of Embodiments (1.1) Summary of a Dot Alignment

In an adjustment method (printing registration) of a dot formation position (an ink-depositing position) and a printing apparatus according to embodiments of the invention, a forward printing and a reverse printing (equivalent to a first and a second printing respectively) in a bi-directional printing which an adjustment of the dot formation position should be performed mutually, or respective printing (a first printing and a second printing) by a plurality of print heads (e.g. two heads) are on the substantial same position on a printing medium. In addition, printing is performed thereon, varying registration conditions of the relative dot formation position, under a plurality of conditions upon the first printing and the second printing. Namely, varying the relative position condition of the first and the second printing, a pattern including a plurality of patches described below is formed.

Moreover, those densities are read using an optical sensor mounted on a horizontal or main scanning member such as a carriage. Namely, the optical sensor on the carriage is moved to the respective position corresponding to the respective patch and a reflected optical density (or an intensity of the reflected light and a reflection factor) is measured successively. Moreover, the condition which the positions of the first and the second printing exceedingly are registered is judged from relative relation of those values. Namely, from the relative relationship between the depositing position condition and the density, an approximation ability of the density for the depositing position condition is calculated. The optimal depositing position condition is determined from the approximation ability. The image pattern which is printed at this time is established in consideration of the accuracy which the printing apparatus and the print head have.

Concerning the first printing, the pattern elements having a width substantially equal to or more than the maximum offset amount of the accuracy of the depositing position which is predicted with reference to the accuracy may be printed on the printing medium. Concerning the second printing, the pattern elements of the same width is printed under the registration conditions of the respective depositing position. The depositing position condition can be adjusted with the equivalent to the accuracy of the position registration condition of the depositing position or the accuracy above that, according to this manner.

A further first printing and a further second printing are performed using the depositing position condition which is established once, varying the registration condition of the depositing position, under a plurality of conditions in the same manner. The registration condition in this case is set at the higher accuracy than the preceding registration. Namely, based on the result by the first dot alignment, based on the result which registration is performed, said accuracy which is registered is considered to be the largest offset, and from the accuracy which is registered, the patterns having the width equivalent to the maximum offset amount of accuracy of the predicted depositing position are printed by the first printing and the second printing. A dot alignment (a fine adjustment) of higher accuracy has allowed according to this manner.

(1.2) Summary of Entire Algorithm

After performing calibration of the optical sensor, the coarse adjustment is performed. The adjustment ranges of the coarse adjustment is determined from the accuracy of the printing apparatus and the print head. Using the registration condition of the depositing position determined by the coarse adjustment, further the fine adjustment is performed and the dot alignment is carried out with higher accuracy. Therefore, an adjustment pitch can be set more precisely because the adjustment range made narrow. In addition, after performing the adjustment, in order to check whether the dot alignment was performed accurately or not, a check pattern is printed, thus, whether the depositing position is controlled accurately can be checked by the user.

Moreover, an execution range of the dot alignment can be defined as required corresponding to the printing modes, the construction or the like of which the apparatus. For example, in the printing apparatus using a plurality of print heads, the dot alignments between bi-directional printing and between printing by the plurality of heads are carried out, and in the printing apparatus using only one head, the dot alignment of bi-directional printing have only to be carried out. Moreover, even in the case of one head, when it is possible to eject the ink of a different color tone (a color and/or a density) or when the different amount of ejection can be obtained, for every each color tone or each amount of ejection, the dot alignment may be carried out.

In addition, as is described below, the coarse adjustment and a fine adjustment may not be necessarily performed in above-mentioned order.

(1.3) Identification Patterns

The check patterns are printed using the depositing position set, after performing the dot alignment, in order to check whether the control was performed certainly or not, or such as the result of the dot alignment can be identified by the user. Corresponding the respective mode of bidirectional printing and printing using a plurality of heads, and every each printing speed, the ruled line is printed, since the ruled line patterns is easy to be identified. According to this manner, the user can identify the result of the dot alignment which was carried out obviously.

(1.4) Optical Sensor

The optical sensor being used in the embodiment, the sensor which emits light of color which was selected appropriately in response to the color tone of being used in the printing apparatus and the constitution of the head can be used. In other words, printing means corresponding to said colored ink is applied to objects of the dot alignment with respect to light emitted from red LED or infrared ray LED by using the color excellent in absorption characteristics of the light, for example. Black (Bk) or cyan (C) is preferable from the viewpoint of the absorption characteristics, while it is difficult to obtain sufficient density characteristics and S/N ratio when magenta (M) or yellow (Y) is used. Thus, the color to be used responsive to the characteristics of LED used is selected, thereby to be able to correspond to each color. For example, a blue LED, a green LED or the like in addition to the dot alignment the red LED are installed, thereby with the dot alignment for every each color (C, M, Y) with respect to Black (Bk) can be performed.

(1.5) Manual Adjustment

In the embodiment, the automatic dot alignment processing is designed to perform after performing detection of density using the optical sensor. However, another dot alignment processing also is made possible in preparation for the case or the like where the optical sensor does not operate desirably. Namely, in this case, a usual manual adjustment is performed. The condition which shifts to such manual adjustment is described.

First, it is defined as a calibration error and the dot alignment operation is stopped, when the data obtained by performing of the optical sensor calibration is beyond the range clearly. The status of this condition is communicated to the host computer to display that it is an error through an application. In addition, it is displayed that the manual adjustment is to be carried out to demand the execution. In the other case, when the calibration error were detected, the dot alignment operation is stopped and it may be printed to demand the execution of the manual adjustment on the printing medium fed.

Secondly, a disturbance is described.

The optical sensor can be failed to function, depending upon an incidence of light from the outside. Therefore, during the dot alignment, when the reflected light becomes extremely strong, it is judged to be that there is a disturbance light and to stop the dot alignment. Moreover, in the same way as the calibration error, the status of the condition is communicated to the host computer to display that it is an error through an application. In addition, It is displayed that the manual adjustment is to be carried out to demand the execution. In the other case, when the calibration error were detected, the dot alignment operation is stopped and it may be printed to demand the execution of the manual adjustment on the printing medium which the paper fed.

However, when the sensor error is temporary as an incidence of the accidental disturbance light, after a certain time interval or after informing to prepare the conditions to the user, the dot alignment processing also is made to be able to start again. Moreover, when an error is caused during the execution of one of various printing registration processing corresponding to the modes described later and other processing, the registration processing is stopped and to perform also another printing registration processing.

(1.6) Recovery Operation

The recovery operation being used in the embodiment is described.

This is designed to make to certainly perform a series of recovery operations such as suction, wiping, preliminary ejection for making the ink ejecting condition of the print head good or to maintain it good, before the automatic dot alignment is carried out.

As the operation timing, the recovery operation is certainly performed before it is carried out when an executive instruction of the automatic dot alignment is generated. According to this operation, under the stabilized ejection condition of the print head, the patterns for the printing registration can be printed, thereby to be able to set corrective conditions for printing registration with higher reliability.

As the recovery operations are not limited to only a series of operations such as suction, wiping, preliminary ejection, but with only preliminary ejection or preliminary ejection and wiping the operation may be performed. The preliminary ejection of this case is set preferably such that the ejection of more frequency than a frequency at the time of a preliminary ejection for printing are performed. Moreover, a frequency and an operation order of such as suction, wiping, preliminary ejection are not especially limited.

Moreover, in response to an elapsed time from preceding suction recovery, whether an execution of suction recovery prior to the automatic dot alignment control is required or not may be judged. In this case, first, immediately before the automatic the dot alignment is performed, it is judged whether the predetermined time has elapsed from the preceding suction. And when the suction operation has been carried out within the predetermined time, the automatic dot alignment is carried out. On the other hand, when the suction operation has not been carried out within the predetermined time, after a series of the recovery operations including the suction recovery has been carried out, the automatic dot alignment can be performed.

Moreover, it may be designed to be judged whether the print head has been performed ink ejection over the predetermined number of times from preceding suction recovery, and when ink ejection over the predetermined number of times has been performed, after the recovery operation is carried out, the automatic dot alignment may be carried out, and in addition, both the elapsed time and the number of ink ejection are turned into judgment and, such that when either has reached the predetermined value, the suction recovery is performed, it may be combined therewith.

According to this manner, carrying out the suction recovery to excessive can be prevented, thereby to be able to contribute in savings of the consumption of the ink and a reduction of the amount of ink discharge to a waste ink-treatment section, as well as the recovery operation prior to the automatic dot alignment can be performed effectively.

Moreover, recovery conditions may be changed in such a manner that the recovery conditions are made variable in response to an elapsed time or the number of ink ejection from preceding suction recovery and when, for example, the elapsed time is brief, the suction operation is held under a disable condition, and only the preliminary ejection and wiping are performed, and when the elapsed time is long, the suction recovery further is interposed.

2. Constitution Example of a Printing Apparatus (2.1) Mechanical Constitution

Figure 5:
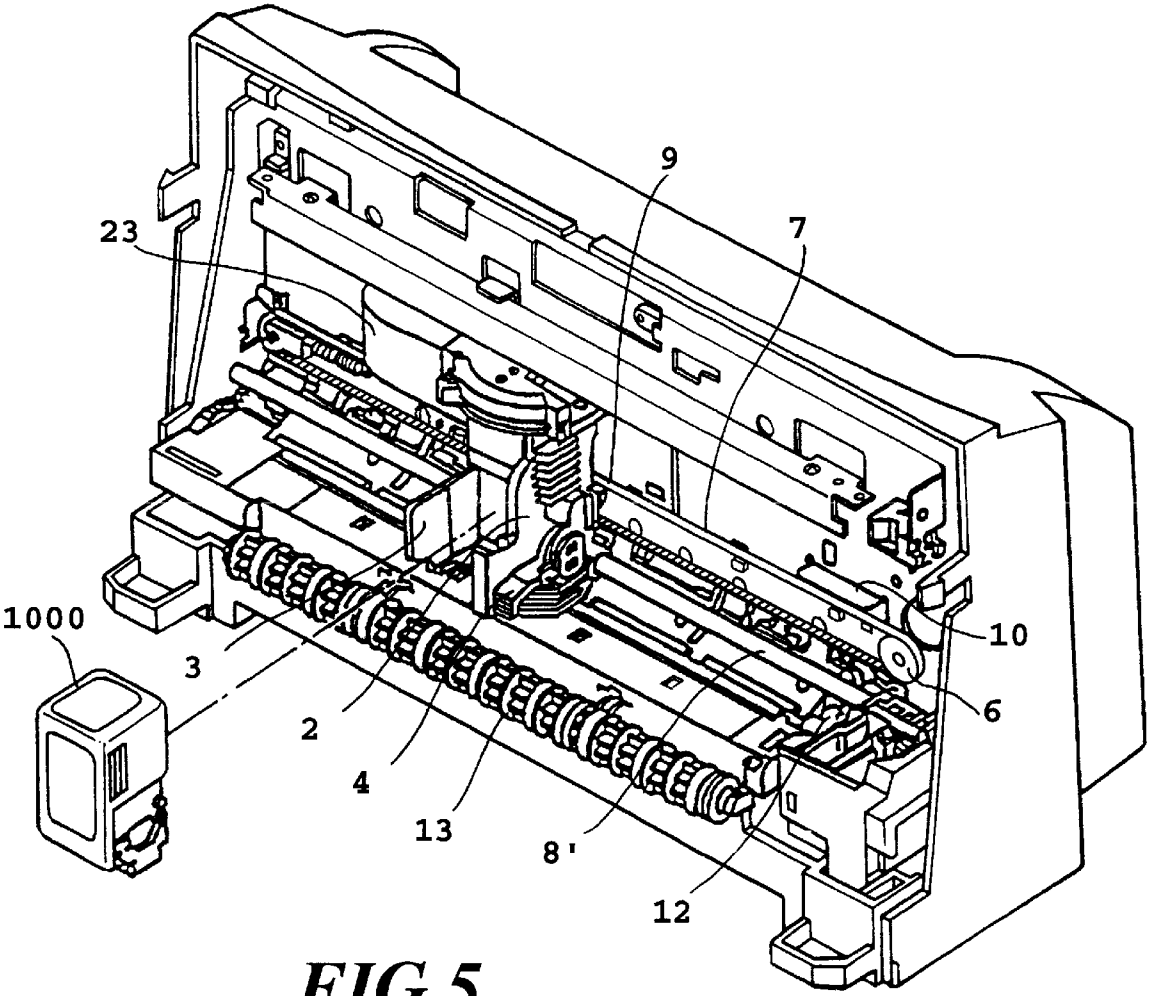
FIG. 5 is a perspective view showing a schematic constitution example of an ink jet printing apparatus according to one embodiment of the invention.

FIG. 5 is a perspective view showing a constitution example of a color ink jet printing apparatus which the invention is preferably embodied or to which is preferably applied and in the drawing, a condition that, detaching the front cover, an inside of an apparatus is exposed is shown.

In the drawing, a reference numeral 1000 denotes an exchangeable type head cartridge and a reference numeral 2 denotes a carriage unit retaining the head cartridge detachably. A reference numeral 3 denotes a holder for fixing the head cartridge 1000 on the carriage unit 2, and after the head cartridge 1000 is installed within the carriage unit 2, when the carriage fixing lever 4 is operated, linking to this operation, and the head cartridge 1000 is pressed on and contacted with the carriage unit 2. Moreover, when the head cartridge 1000 is located by the pressing and contacting, electric contacts for the required signal transmission, which are provided on the carriage unit 2, are in contact with electric contacts on the side of the head cartridge 1000. A reference numeral 5 denotes a flexible cable for transferring electric signals to the carriage unit 2. Moreover, a reflective type optical sensor 30 (not shown in FIG. 5) is provided on the carriage.

A reference numeral 6 denotes a carriage motor as a driving source for allowing the carriage unit 2 to travel in the direction of the horizontal scanning reciprocally, and a reference numeral 17 denotes a carriage belt transferring the driving force to the carriage unit 2.

A reference numeral 8' denotes a guide shaft guiding the movement, as well as there exists in a manner to extending in the direction of the horizontal scanning to support the carriage unit 2. A reference numeral 9 denotes a transparent-type photo coupler attached to the carriage unit 2, and a reference numeral 10 denotes a light-shield board provided on the vicinity of the carriage home position, and when the carriage unit 2 reaches the home position, a light axis of the photo coupler 9 is shielded by the light-shield board 10, thereby the carriage home position being detected. A reference numeral 12 denotes a home position unit including a recovery system such as a cap member for capping a front face of the ink-jet head and suction means for sucking from the inside of this cap and further a member for performing wiping of the front face of the head.

A reference numeral 13 denotes a discharge roller for discharging the printing medium, and sandwiches the printing medium, cooperating with a spur-shaped roller (not shown) to discharge this out of the printing apparatus. A reference numeral 14 denotes line feed unit and to carry the printing medium in the direction of the vertical scanning by the predetermined amount.

Figure 6A:
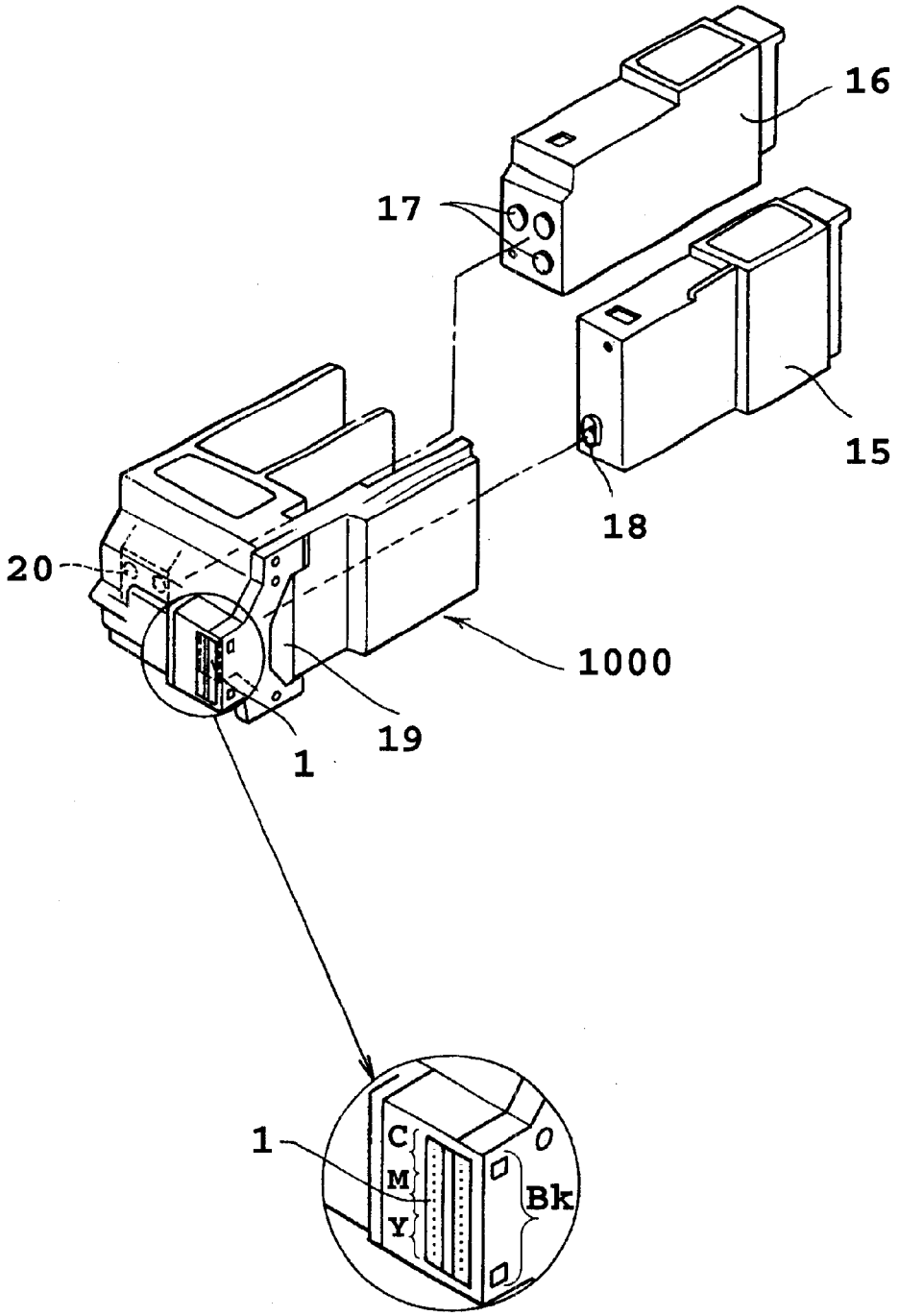
FIGS. 6A and 6B are perspective views showing a constitution example of a head cartridge shown in FIG. 5 and a constitution example of an ejection portion thereof respectively.

FIGS. 6A is perspective view showing a detail of a head cartridge 1000 shown in FIG. 5. Here, a reference numeral 15 denotes an ink tank accommodating black ink, and a reference numeral 16 denotes the ink tank accommodating a cyan, a magenta and a yellow ink. These tanks are designed to being able to attach and detach to the head cartridge body. Each of portions denoted a reference numeral 17 is a coupling port for an each of ink supply pipes 20 on the side of the head cartridge accommodating each color inks, and similarly, a reference numeral 18 is a coupling port for the black ink accommodated in the ink tank 15, and by said coupling, the ink can be supplied to the print head 1 which is retained in the head cartridge body. A reference numeral 19 denotes an electric contact section, and accompanying with contact with an electric contact section provided on the carriage unit 2, through a flexible cable electric signals from the body of the printing apparatus control section can be received.

In this embodiment, a head which both a black ink ejecting portion arranging nozzles for ejecting the black ink and a color ink ejecting portion are arranged in parallel is used. The color ink ejecting portion comprises a nozzle groups respectively ejecting yellow ink, magenta and cyan arranged unitarily and in line in response to a range of a black ejection opening arrangement.

Figure 6B:
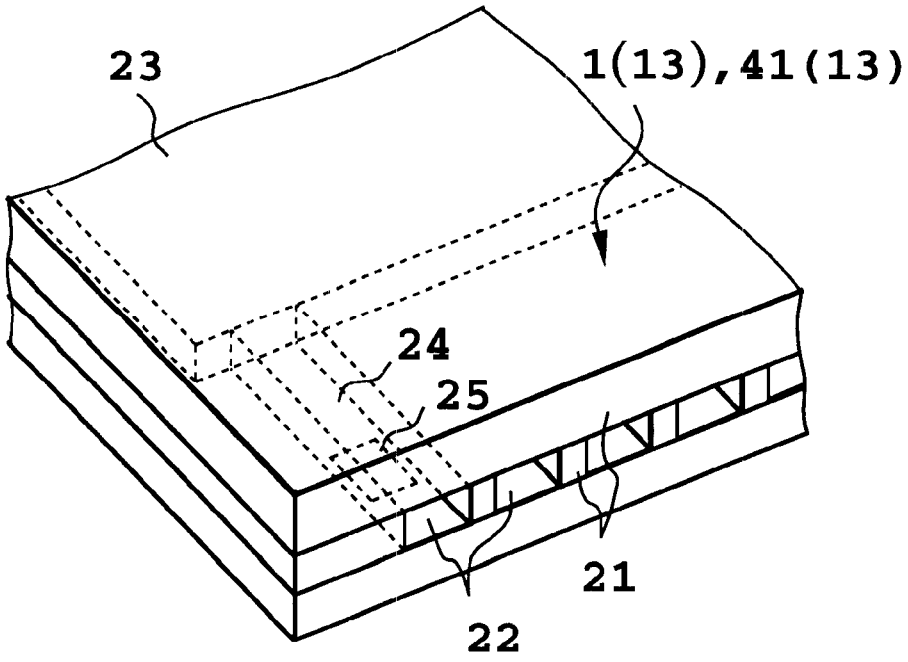

FIG. 6B is a schematic perspective-view partially showing a structure of a main portion of the print head portion 1 of the head cartridge 1000.

A plurality of ejection openings 22 are formed with the predetermined pitches on the ejection opening face 21 faced with the printing medium 8 spaced the predetermined clearance (for example, approximately 0.5 to 2.0 mm) in FIG. 6B, and along a wall surface of each liquid passages 24 communicating a common liquid chamber 23 with each ejection opening 22, the electrothermal converting elements (exothermic resistant element and so on) 25 for generating the energy used for ejecting ink ejection are arranged. In this embodiment, the head cartridge 1000 is installed on the carriage 2 under the positional relationship so that the ejection openings 22 stand in a line in the direction which crosses a scanning direction of the carriage unit 2. Thus, the print head 1 is constituted in that the corresponding exothermic resistant elements (hereinafter referred to as an ejecting heater) 25 are driven (energized) based on the image signal or ejection signals and to film-boil ink within the liquid passages 24 and to eject the ink from the ejection openings 22 by pressure of the bubbles which are generated by film-boiling.

In this embodiment, although the constitution was mentioned wherein within one print head body, a nozzle group for ejecting the black ink, and nozzle groups for ejecting yellow, magenta, cyan ink are provided and arranged, the invention cannot be limited to this manner and the print head having the nozzle group for ejecting the black ink may be provided independent from the print head having the nozzle groups for ejecting the yellow, magenta, cyan ink, and still more, the head cartridges themselves may be independent from each other. Moreover, respective head cartridge may be provided by the nozzle groups of each color which are independent each other. The combination of the print head and the head cartridge is not especially limited.

Figure 7:
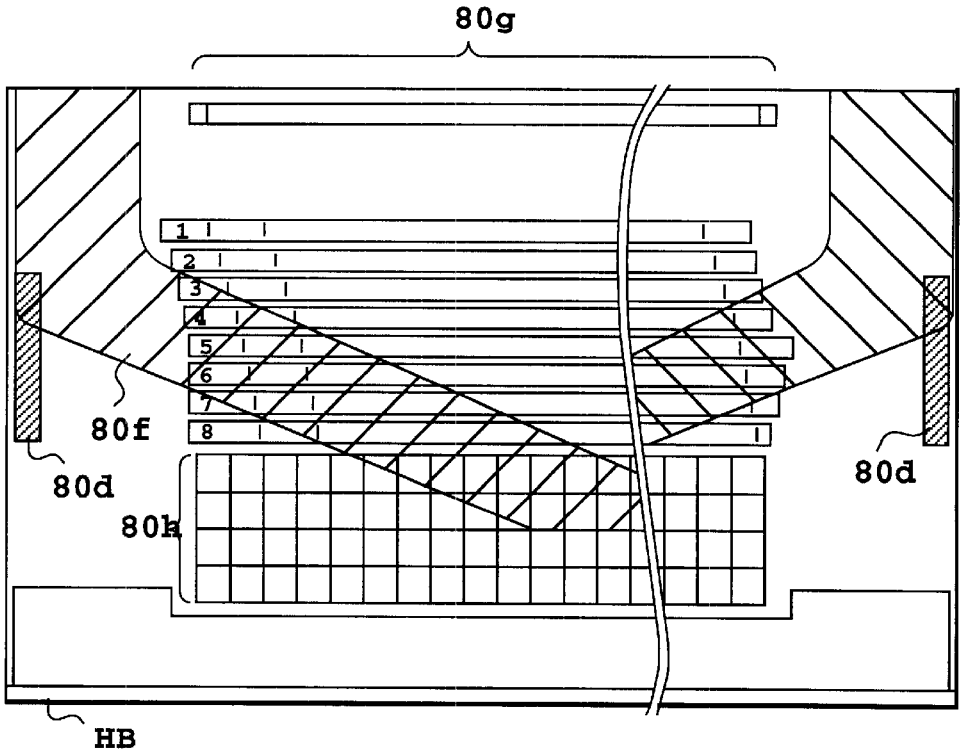
FIG. 7 is a plane view showing a constitution example of a heater board being used in the ejection portion shown in FIG. 6B.

FIG. 7 is a schematic view of a heater board HB being used in this embodiment. Temperature regulating heaters or sub heaters 80*d* for controlling temperature of the head, an ejection section row 80*g* in which ink ejecting heaters or main heaters 80*c* are arranged and a driving device 80*h* are formed on the same board under a positional relationship as shown in this drawing. The heater board is usually a chip of Si wafer and in addition, by an identical semiconductor deposition process each heater and the driving section required are formed thereon.

Moreover, on the same drawing, especially, a positional relationship of an outside circumference wall section 80*f* of a ceiling board for separating a region which the heater board of ejection portion for the black ink is filled with the black ink from a region which is not so. The side of ejecting heaters 80*g* of the outside circumference wall section 80*f* of the ceiling board functions as the common liquid chamber. Moreover, by a plurality of grooves formed on the outside circumference wall section 80*f* corresponding to the ejection section row 80*g*, a plurality of liquid passages are formed. Although the color ink ejection sections of yellow, magenta and cyan are constituted in the approximately similar manner, for each ink, by forming the liquid passages for supplying and the ceiling board appropriately, separation or compartmentalization is performed such that different color inks are not mixed each other.

Figure 8:
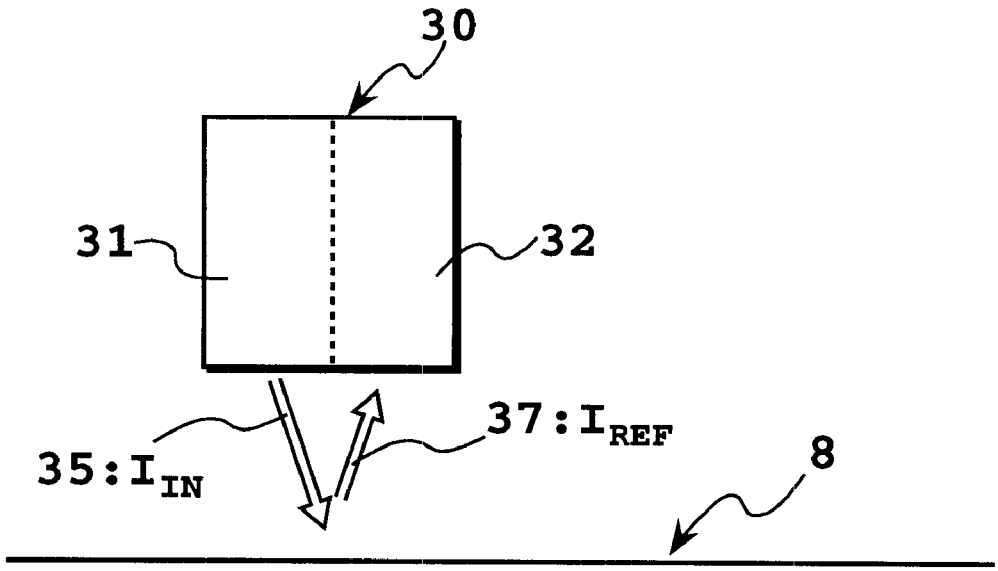
FIG. 8 is a schematic view describing an optical sensor being used in the apparatus shown FIG. 5.

FIG. 8 is a schematic view describing a reflection type optical sensor being used in the apparatus shown in FIG. 5.

The reflection type optical sensor 30 is mounted on the carriage 2 as described above, and comprises a light-emitting portion 31 and a photosensing portion 32 as shown in FIG. 8. A light Iin 35 which is emitted from the light-emitting portion 31 is reflected on the printing medium 8, and the reflected light Iref 37 can be detected by the photosensing portion 32. Moreover, the detected signal is transferred to a control circuit formed on an electric board of the printing apparatus through a flexible cable (not shown), and is converted into a digital signal by the A/D converter. The position which the reflective optical sensor 30 is attached to the carriage 2 is set at the position where the ejection opening section of the print head 1 does not pass in order to prevent splashed droplets of ink or the like from depositing, during printing scanning. This sensor 30 can be constituted a sensor of the low cost because of to be able to use a sensor of relatively low resolution.

(2.2) Constitution of Control System

Secondly, a constitution of a control system for carrying out printing control of the described-above apparatus is described.

Figure 9:
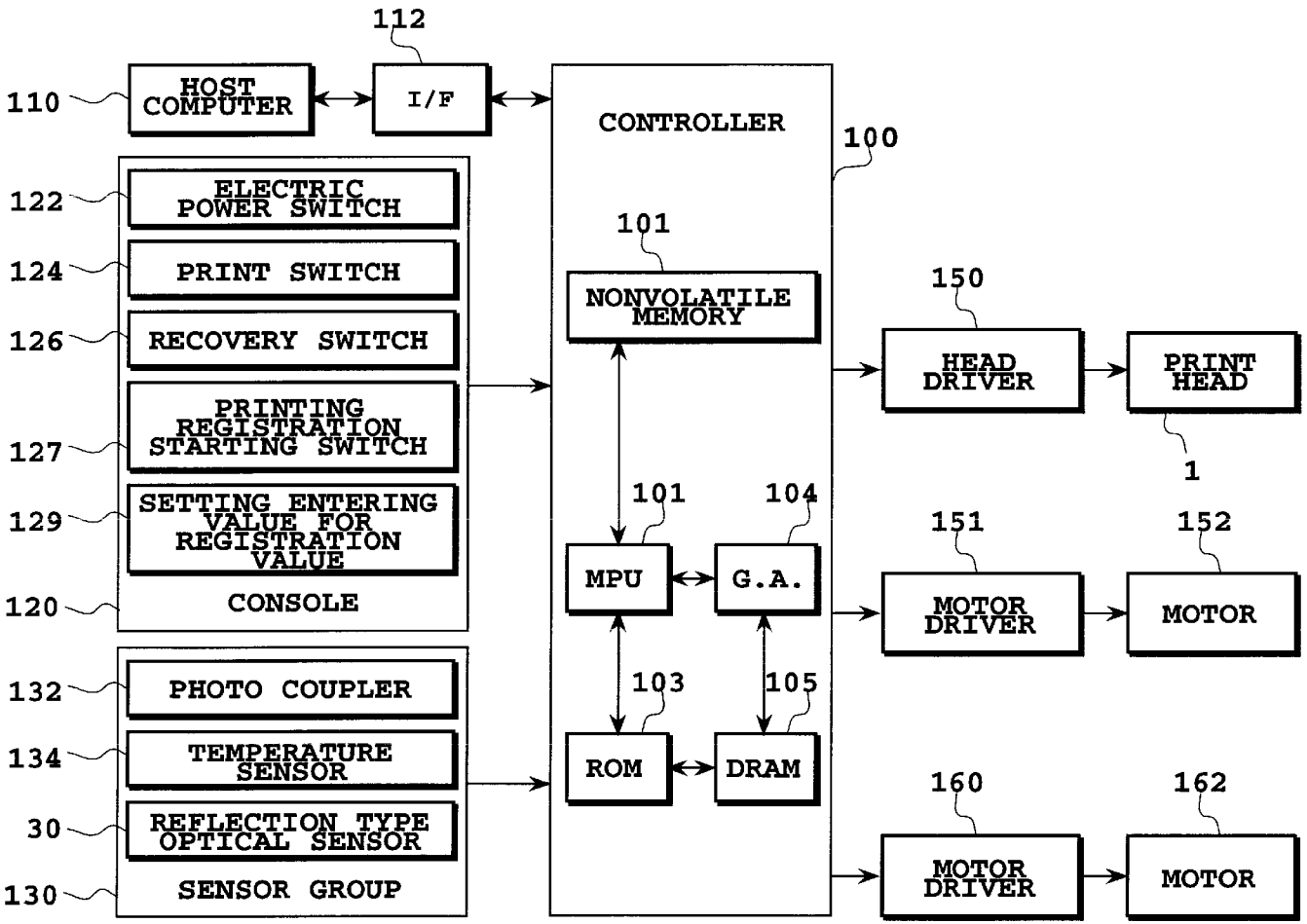
FIG. 9 is a block diagram showing a schematic constitution of a control circuit in the ink jet printing apparatus according to one embodiment of the invention.

FIG. 9 is a block diagram showing one example of the constitution of the control system. In this drawing, a controller 100 is a main control section and, for example, comprises MPU 101 of a microcomputer form, ROM 103 in which a program, a table required and the other fixed data are stored, nonvolatile memory 107 such as EEPROM for storing data adjustment data (may be data obtained every each mode described below) which are obtained by a dot alignment processing described below and are used in printing registration at the time of practical printing, a dynamic RAM in which various data (the described-above printing signal and printing data being supplied to the head or the like), and so on. The number of the print dots and the number of exchange of a print head also can be stored in this RAM 105. A reference numeral 104 denotes a gate array which performs supplying control of printing data to the print head 1, and transmission control of data between interface 112, MPU 101 and RAM 1106 and is also performed. A host apparatus 110 is a source of supply of the image data (a computer performing preparation of data and processing for printing is used, as well as the apparatus may be a form of a reader unit or the like for reading the image also). The image data, the other commands, a status signal or the like are transmitted to controller 100 and are received from controller 100 through the interface (I/F) 112.

A console 820 has a switch group which receives indicative input by an operator, and comprises a power supply switch 122, switch 124 for indicating commencement of printing, a recovery switch 126 for indicating starting of the suction recovery, a registration adjustment starting switch 127 for starting registration and an adjustment value set entering section 129 for entering said adjustment value by a manual operation.

A reference numeral 130 denotes a sensor group for detecting conditions of the apparatus, and comprises the above-mentioned reflective optical sensor 30, the photo coupler 132 for detecting the home position and a temperature sensor 134 provided on the appropriate region in order to detect an environment temperature or the like.

A head driver 150 is a driver for driving the ejection heaters 25 of the print head in response to printing data or the like, and comprises a timing setting section or the like for setting driving timing (ejection timing) appropriately for the dot-formation registration. A reference numeral 151 denotes a driver for driving a horizontal scanning motor 4, and a reference numeral 162 denotes a motor being used to carry (vertical scanning) the printing medium 8, and a reference numeral 160 denotes a driver thereof.

Figure 10:
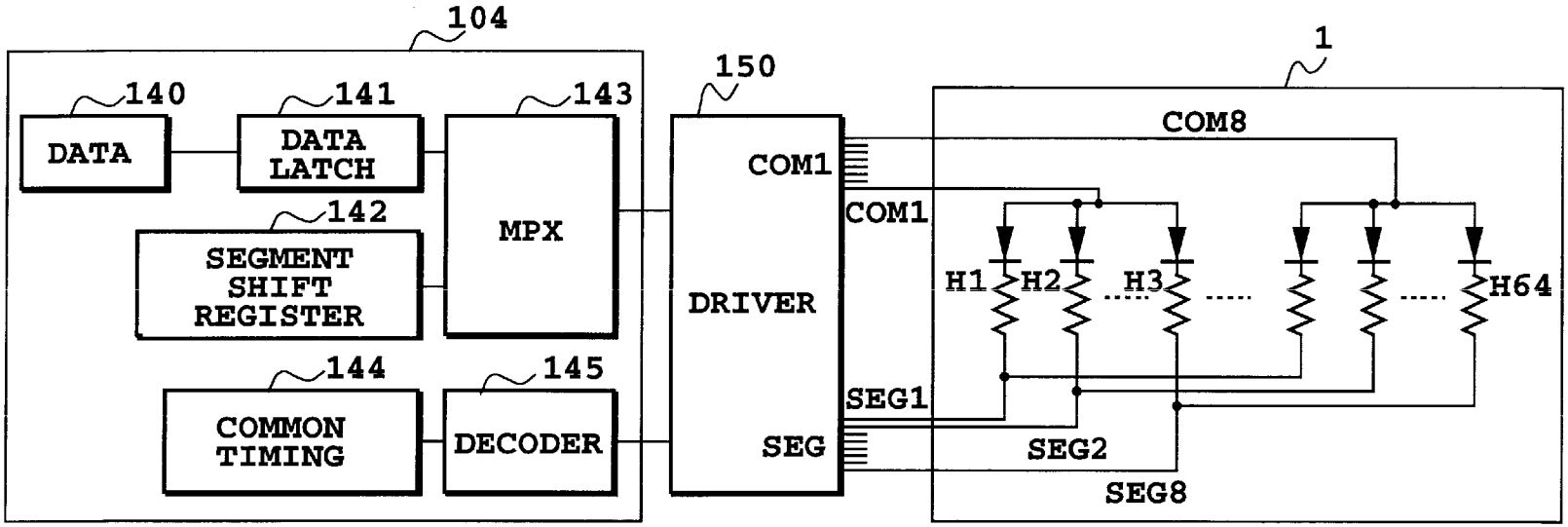
FIG. 10 is a block diagram showing an electric constitution example of a gate array and the heater board shown in FIG. 9.

FIG. 10 is one example of a circuit diagram showing a detail of each part 104, 150 and 1 of FIG. 9. A gate array 104 comprises a data latch 141, a segment (SEG) shift register 142, a multiplexer (MPX) 143, a common (COM) timing generating circuit 144 and a decoder 145. The print head 1 has a diode matrix, and driving currents flow to ejection heaters (H1 to H64) at the time where a segment signal SEG coincides with a common signal COM, thereby the ink is heated to eject the ink.

The decoder 145 decodes a timing generated by common timing generation circuit 144 to select any one of common signals COM 1 to COM 8. The data latch 141 latches the printing data read from RAM 105 every 8 bit, and a multiplexer 143 outputs the printing data in accordance with a segment shift register 142 as segment signals SEG 1 to SEG 8. The output from the multiplexer 143 can be changed every one bit, 2 bits or 8 bits all or the like according to contents of shift register 142 variously as described below.

Describing an operation of a configuration for controlling described below, when the printing signals enter the interface 112, the printing signals are converted into the printing data for printing between the gate array 104 and MPU 101. Moreover, the motor driver 151 and 160 are driven, as well as the print head is driven and printing is performed in accordance with the printing data sent to a head driver 150. Namely, here, although the case which drives the printing head of 64 nozzles has been described, control can be performed under even using the number of other nozzle by the similar configuration.

Figure 11:
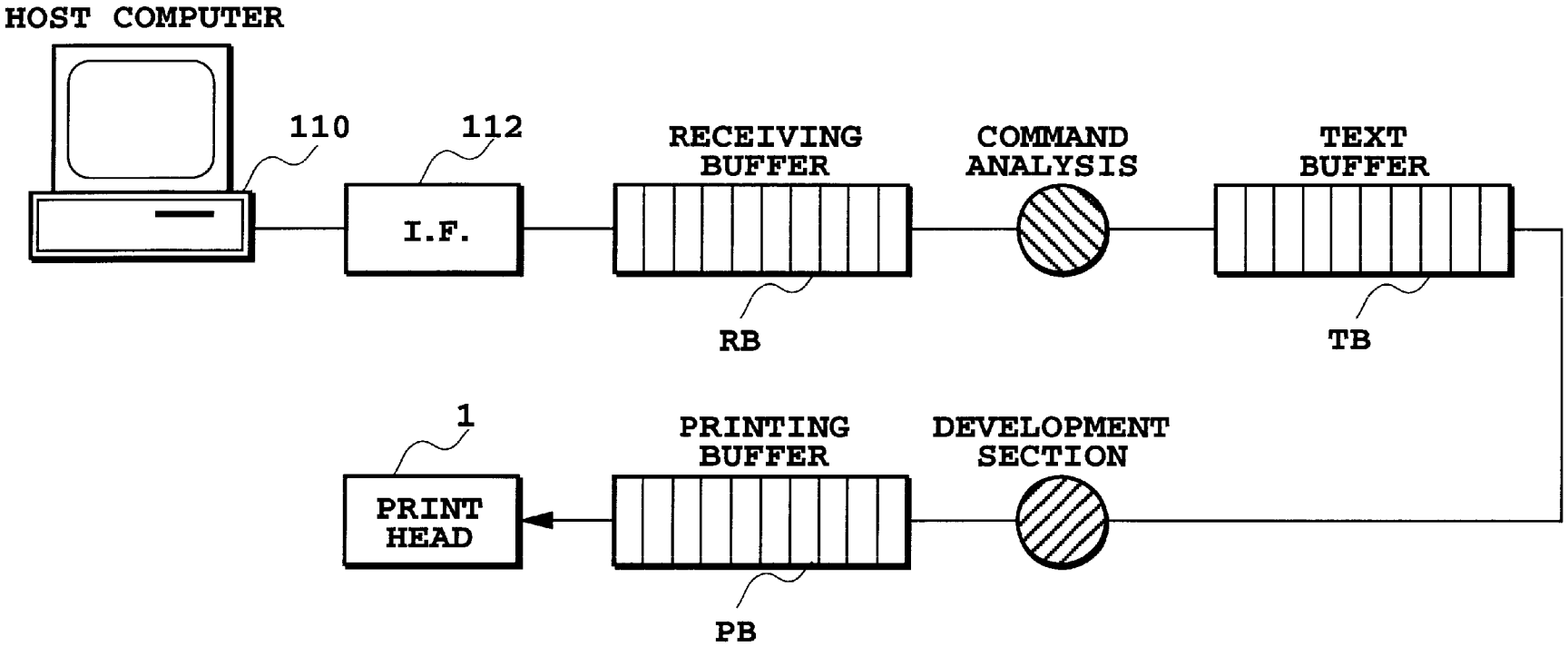
FIG. 11 is a schematic view for describing a stream of printing data in the inside of the printing apparatus from a host apparatus.

Secondly, a stream of the printing data in the inside of the printing apparatus is described using FIG. 11. The printing data sent from the host computer 110 are stored in the receiving buffer RB of the inside of the printing apparatus through an interface 112. The receiving buffer RB has a capacity of several kilobytes to tens of kilobytes. After a command analysis is performed with respect to the printing data stored in the receiving buffer RB, they are sent to a text buffer TB.

In a text buffer TB, printing data are maintained and as a intermediate form of one line, the processing which a printing position of each character, a kind of decoration, size, a character (code), an address of a font or the like are added is performed. A capacity of the text buffer TB differs depending upon the kind of the apparatus every each kind, and comprises a capacity of several lines in the case of serial printer and a capacity of one page in the case of page printer. Furthermore, the printing data stored in the text buffer TB are developed and are stored in a printing buffer PB in the binary-coded condition, and the signals are sent to the print head as the printing data and printing is performed.

The signals are send to the print head after the binary-coded data stored in the printing buffer PB are covered with a thinning mask patterns of a specific rate in this embodiment. Therefore, the mask patterns can be set after observing the data in the condition being stored in the printing buffer PB. There is also the apparatus of a kind that the printing data stored in the printing buffer PB are developed concurrent with a command analysis and to be written in the printing buffer PB without comprising the text buffer TB depending upon the kind of the printing apparatus.

Figure 12:
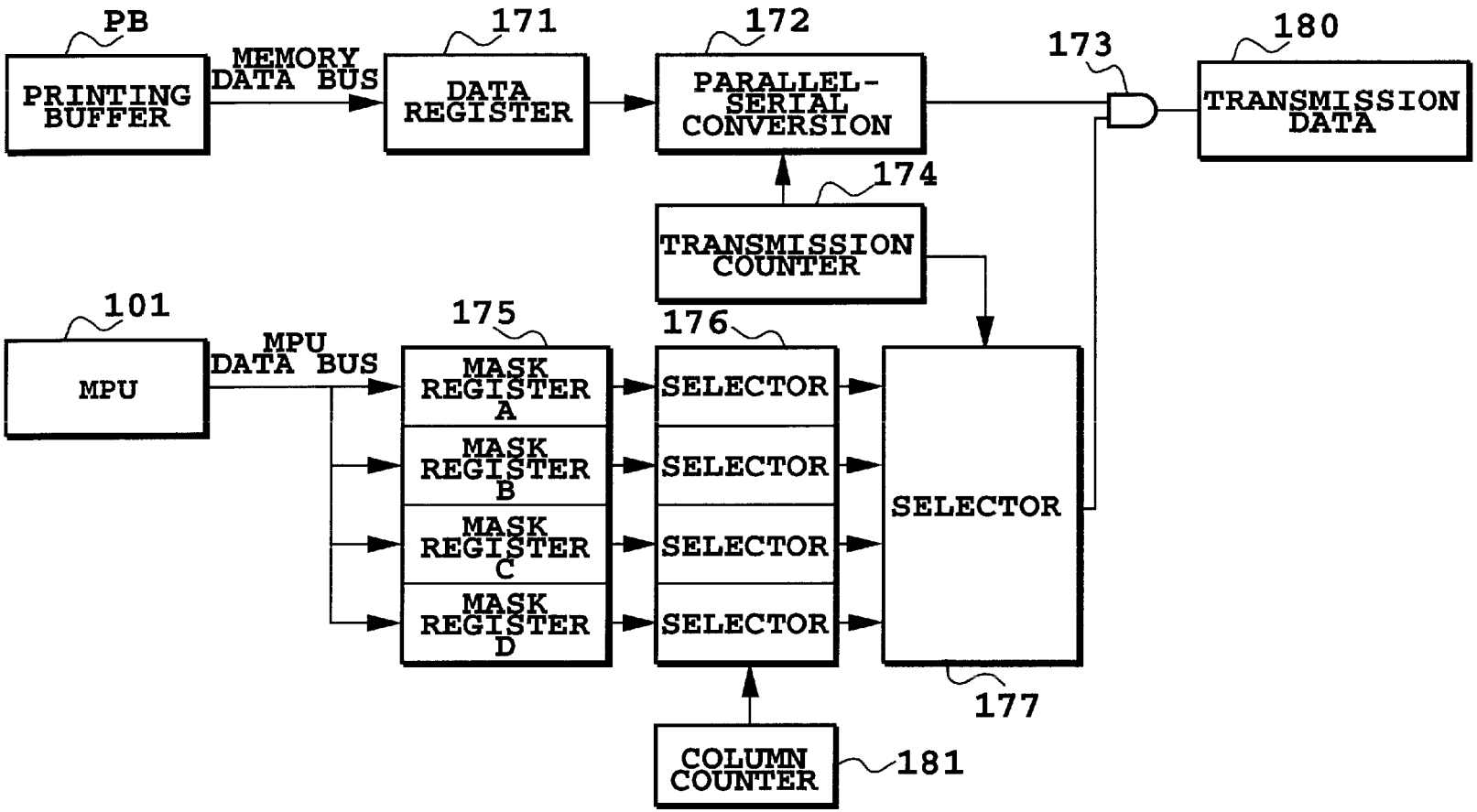
FIG. 12 is a block diagram showing a constitution example of a data transmission circuit.

FIG. 12 is a block diagram showing a constitution example of a data transmission circuit, and such circuit can be provided as a part of controller 100. In this drawing, a reference numeral 171 denotes a data register for connecting with a memory data bus to read the printing data being stored in the printing buffer in memory and to store temporarily and a reference numeral 172 denotes a parallel-serial converter for converting the data stored in a data register 171 into a serial data, and a reference numeral 173 denotes an AND gate for covering the serial data with the mask, and a reference numeral 174 denotes a counter for controlling the number of data transmission.

A reference numeral 175 denotes a register which is connected with an MPU data bus and is for storing the mask patterns, and a reference numeral 176 denotes a selector for selecting a column position of the mask patterns, and a reference numeral 177 denotes a selector for selecting a row position of the mask patterns.

A data transmission circuit shown in FIG. 12 transfers serially the printing data of 128 bits to the print head 1 according to the printing signal being sent from MPU 101. The printing data stored in the printing buffer PB in memory are stored temporarily in a data register 171, and are converted into the serial data by a parallel-serial converter 172. After the converted serial data are covered by an AND gate 103 with the mask, the data are transferred on the print head 1. A transmission counter 174 counts the number of transmission bits to terminate the transmission when reaching 128 bits.

A mask register 175 is constituted by four pieces of the mask registers A, B, C and D to store a mask patterns written by the MPU. Each register stores the mask pattern of 4 bits row by 4 bits column. Moreover, a selector 176 selects the mask patterns data corresponding to the column position by providing the value of the column counter 181 as a selective signal. The transmission data is covered with the mask by the mask patterns data selected by the selector 176 and 177 using an AND gate 173.

In this example, four mask registers are used however, the other number of mask registers may be used. Further, the transmission data may be stored in a print buffer once, instead of directly supplying to the printing head 1 as mentioned above.

3. Embodiment of Dot Alignment (Printing Registration)

Next, an embodiment of a printing registration which is basic to this embodiment is described.

(3.1) Printing Registration for Bi-directional Printing

Figure 13A:
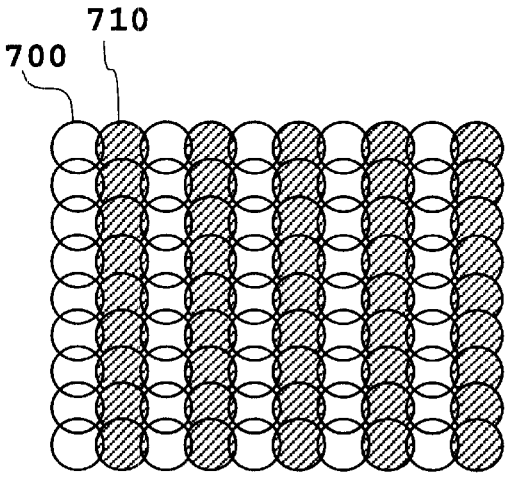
Figure 13B:
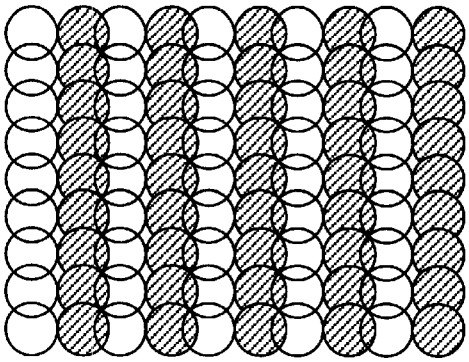
Figure 13C:
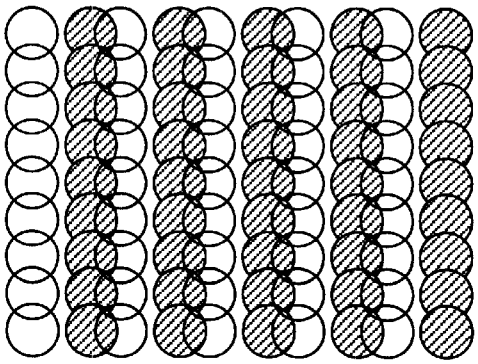

FIGS. 13A to 13C schematically illustrate printing patterns for printing registration to be used in the present embodiment.

In FIGS. 13A to 13C, white dots 700 represent dots formed on the printing medium during the forward scan (first printing) and hatched dots 710 represent dots formed on the printing medium during the reverse scan (second printing). It should be noted that although in FIGS. 13A to 13C the dots are hatched or not for the purpose of illustration, the dots are formed with the ink ejected from the same printing head, irrespective of the color or density of the ink.

FIG. 13A shows the dots printed in the state in which printing positions in the forward scan and the reverse scan are well registered; FIG. 13B, the printing positions are registered with a slight offset; and FIG. 13C, the printing positions are registered with a greater offset. As is obvious from the FIGS. 13A to 13C, in the present embodiment, the dots are complementarily formed in the forward and reverse scan. Namely, the dots in the odd number of columns are formed in the forward scan, and the dots in the even number of columns are formed in the reverse scan. Accordingly, FIG. 13A, in which the dots formed in the forward scan and the reverse scan are separated by about the diameter of the dot, shows the well registered state.

The printing pattern is designed to reduce the density of the overall printed portion as the printing position is offset. Namely, within a range of a patch as the printing pattern of FIG. 13A, the area factor is about 100%. As the printing positions are offset as shown in FIGS. 13B and 13C, the overlapping amount of the dot (white dot) of the forward scan and the dot (hatched dot) of the reverse scan becomes greater to enlarge the not-printed region, i.e., a region not formed with the dots, thereby decreasing the area factor so as to reduce the density on average.

In the present embodiment, the printing positions are offset by shifting the timing of printing. It is possible to offset on printing data.

In FIGS. 13A to 13C, although one dot in the scanning direction is taken as a unit, a unit may be appropriately set according to precision of printing registration or precision of printing registration detection.

Figure 14A:
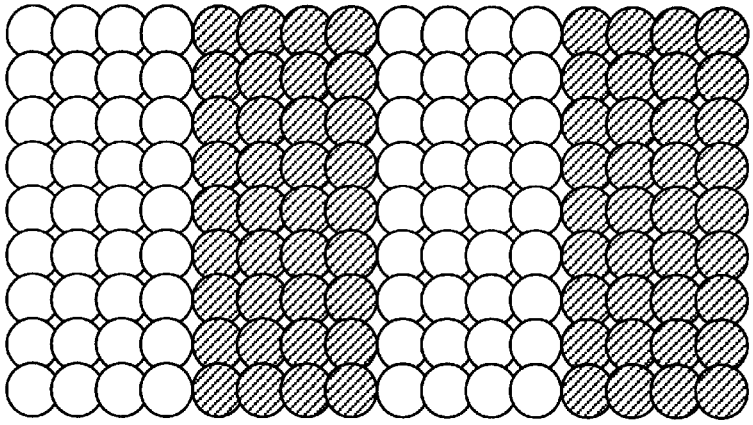
Figure 14B:
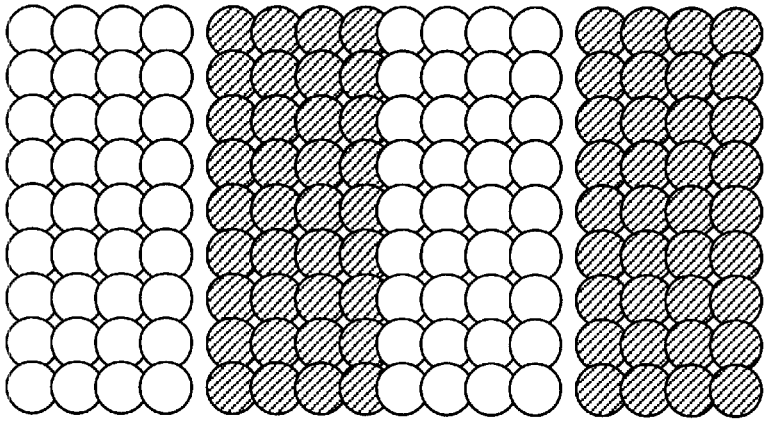
Figure 14C:
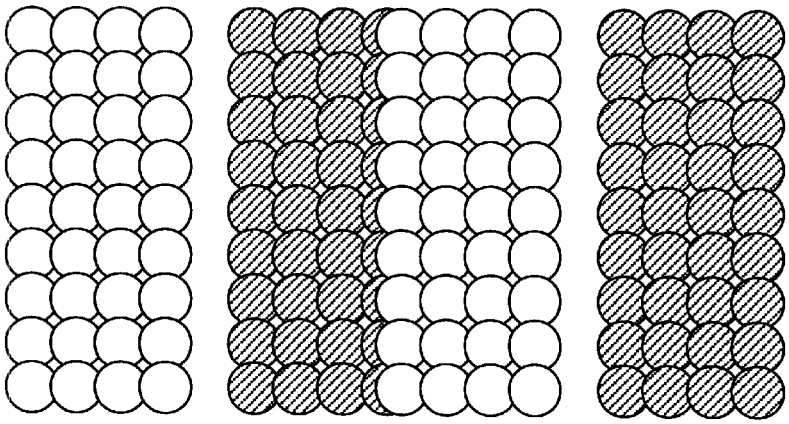

FIGS. 14A to 14C show the case where four dots are taken as a unit. FIG. 14A shows the dots printed in the state in which printing positions in the forward scan and the reverse scan are well registered; FIG. 14B, the printing positions are registered with a slight offset; and FIG. 14C, the printing positions are registered with a greater offset.

What is intended by this pattern is that the area factor is reduced with respect to an increase in mutual offset of the printing positions in the forward scan and the reverse scan. This is because the density of the printed portion is significantly dependent on variations of the area factor. Namely, although the dots are overlapped with each other so as to increase the density, an increase in not-printed region has a greater influence on the average density of the overall printed portion.

Figure 15:
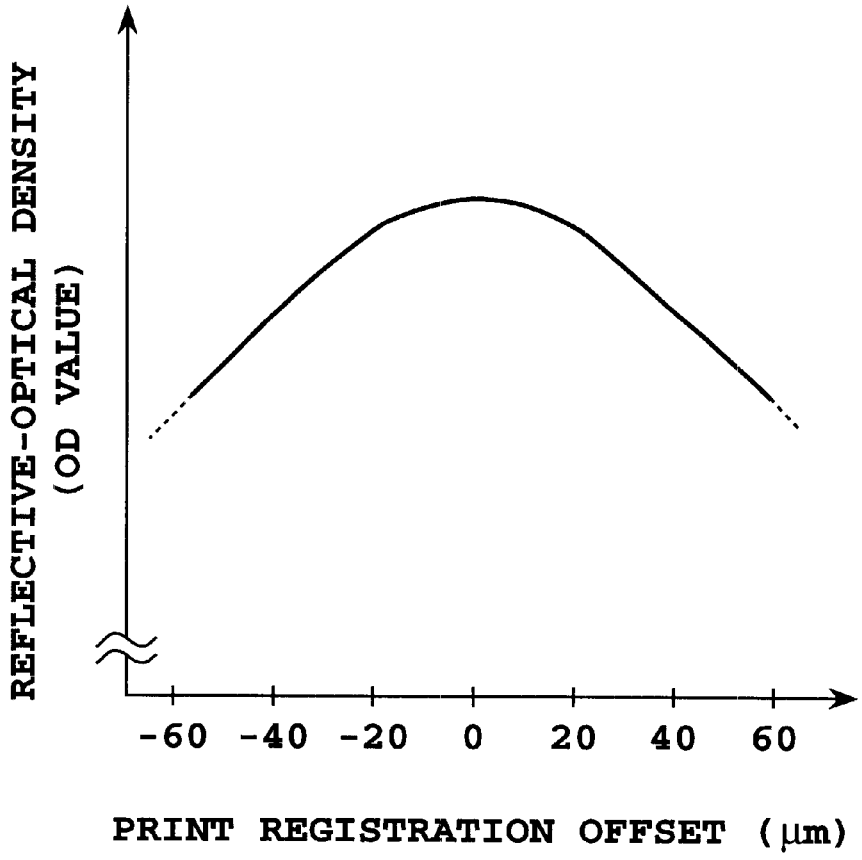
FIG. 15 is a graph illustrating the relationship between a printing position offset amount and a reflection optical density in the printing patterns in the first embodiment according to the present invention.

FIG. 15 is a graph schematically illustrating the relationship between an offset amount of the printing position and a reflection optical density in the printing patterns shown in FIGS. 13A to 13C and 14A to 14C in the present embodiment.

Figure 4A:
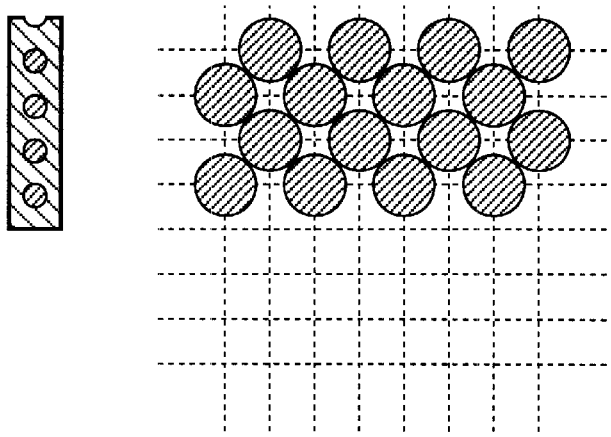
FIGS. 4A to 4C are illustrations for describing a checker or lattice arrangement printing and a inverted checker or lattice arrangement printing used in the multi scanning printing.
Figure 4B:
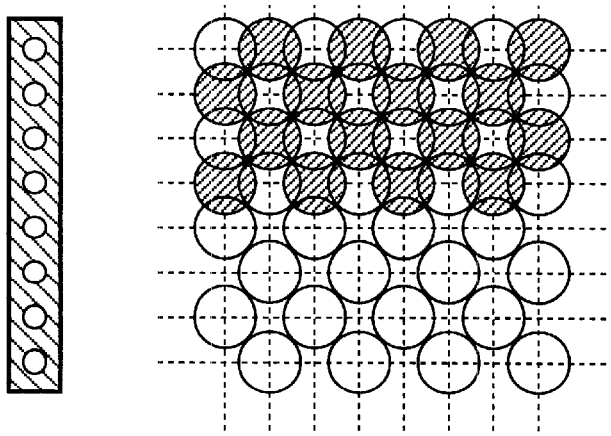
Figure 4C:
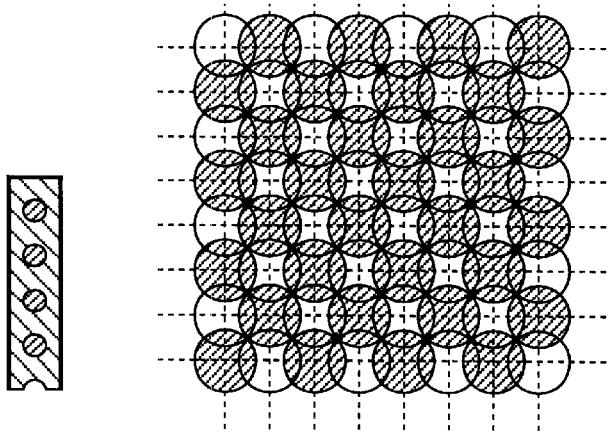

In FIG. 15, the vertical line represents a reflection optical density (OD value); and the horizontal line, a printing position offset amount ($\mu$m). Using the incident light Iin 35 and the reflection light Iref 37 shown in FIG. 4, a reflection index R=Iref/Iin and a transmission index T=1−R. Incidentally, although an optical density may be defined as the reflection optical density using the reflection index R or a transmission optical density using a transmission index T, the former is used in the present embodiment and is referred as "the optical density" or "density" simply, if there is no problem.

Assuming that d represents a reflection optical density, $R=10^{-d}$. When the amount of printing position offset is zero, the area factor becomes 100%, and therefore, the reflection index R becomes minimum, i.e., the reflection optical density d becomes maximum. The reflection optical density d decreases as the printing position offsets relatively to any of the plus and minus directions.

(Printing Registration Processing)

Figure 16:
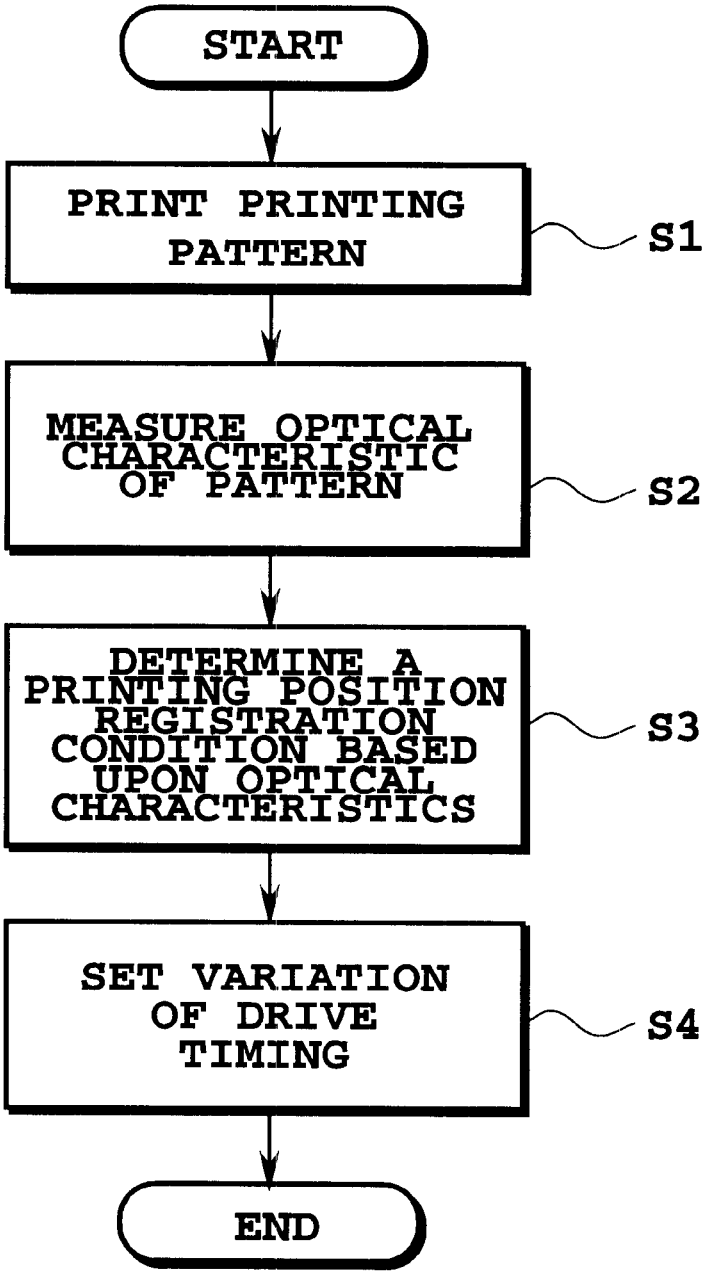
FIG. 16 is a flowchart illustrating schematic processing in the first embodiment according to the present invention.

FIG. 16 is a flowchart of printing registration processing.

Referring to FIG. 16, first of all, the printing patterns are printed (step S1). Next, the optical characteristics of the printing patterns are measured by the optical sensor 30 (step S2). An appropriate printing registration condition is determined based on the optical characteristics obtained from the measured data (step S3). As graphically shown in FIG. 18 (described later), the point of the highest reflection optical density is found, two straight lines respectively extending through both sides of data of the point of the highest reflection optical density are found by the method of least squares, and then, the intersection point P of these lines is found. Like the above approximation using straight lines, approximation using a curved line as shown in FIG. 19 (described later) may be used. Variations of drive timing are set based on the printing position parameter with respect to the point P (step S4).

Figure 17:
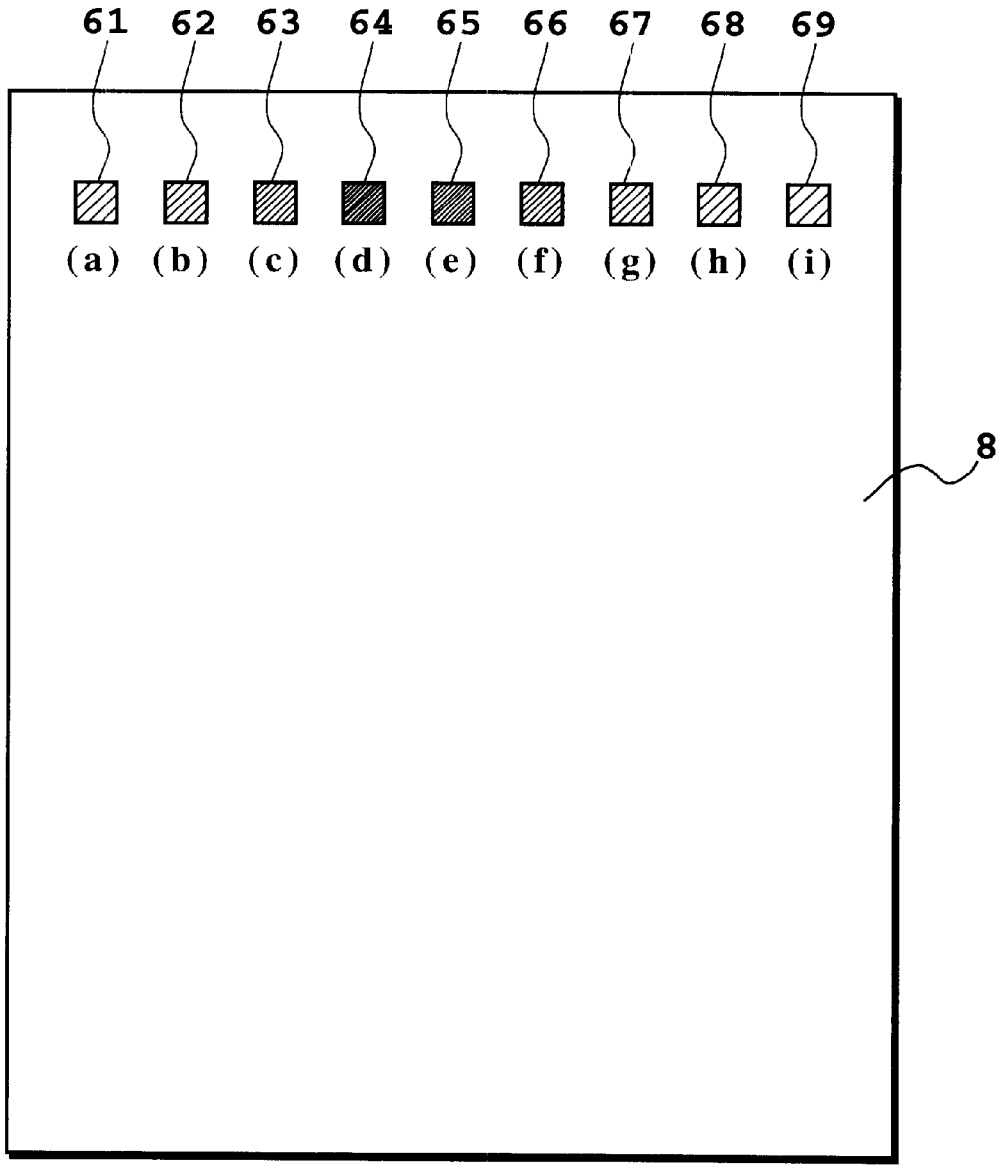
FIG. 17 is a schematic view illustrating the state in which the printing pattern is printed on a printing medium in the first embodiment according to the present invention.

FIG. 17 is an illustration showing the state in which the printing patterns shown in FIGS. 13A to 13C or FIGS. 14 to 14C are printed on the printing medium 8. In the present embodiment, nine patterns 61 to 69 different in relative position offset amount between the dots printed in the forward scan and the reverse scan are printed. Each of the printed patterns is also called a patch, for example, a patch 61, a patch 62 and so on. Printing position parameters corresponding to the patches 61 to 69 are designated by (a) to (i). The nine patterns 61 to 69 may be formed by fixing the printing start timing in the forward scan and setting the nine printing start timings in the reverse scan, i.e., a currently set timing, four timings earlier than the currently set timing and four timings later than the currently set timing. The processing as shown in FIG. 16 and printing of the nine patterns 61 to 69 on the basis of the processing can applied as a part of processing in general algorithm described later.

Then, the printing medium 8 and the carriage 2 are moved such that the optical sensor 30 mounted on the carriage 2 may be placed at positions corresponding to the patches 61–69 as the printed patterns thus printed. In the state in which the carriage 2 is stopped, the optical characteristics are measured one or more times. In this embodiment, a reflection optical density or a transmission optical density is used as a optical density. In spite of this, an optical reflection index, an intensity of reflected light or the like may be used.

In this way, since the optical characteristics are measured in the state in which the carriage 2 is stopped, the influence of noise caused by the driving of the carriage 2 can be avoided. A distance between the sensor 30 and the printing medium 8 is increased to widen a measurement spot of the optical sensor 30 more than the dot diameter, thereby averaging variations in local optical characteristics (for example, the reflection optical density) on the printed pattern so as to achieve highly precise measurement of the reflection optical density of the patch 61 etc.

In order to relatively widen the measurement spot of the optical sensor 30, it is desired that a sensor having a resolution lower than a printing resolution of the pattern, namely, a sensor having a measurement spot diameter greater than the dot diameter be used. Furthermore, from the viewpoint of determination of an average density, it is also possible to scan a plurality of points on the patch by means of a sensor having a relatively high resolution, i.e., a small measurement spot diameter and to take an average of the thus measured densities as the measured density.

In order to avoid any influence of fluctuations in measurement, it may be possible to measure the reflection optical density of the same patch a plurality of times and to take an average value of the measured densities as the measured density.

In order to avoid any influence of fluctuations in measurement due to the density variations on the patch, it may be possible to measure a plurality of points on the patch to average or perform other operations on them. Measurement can be achieved while the carriage 2 is moved for time saving. In this case, in order to avoid any fluctuation in measurement due to electric noise caused by the driving of the motor, it is strongly desired to increase the times of samplings and average or perform other operations.

Figure 18:
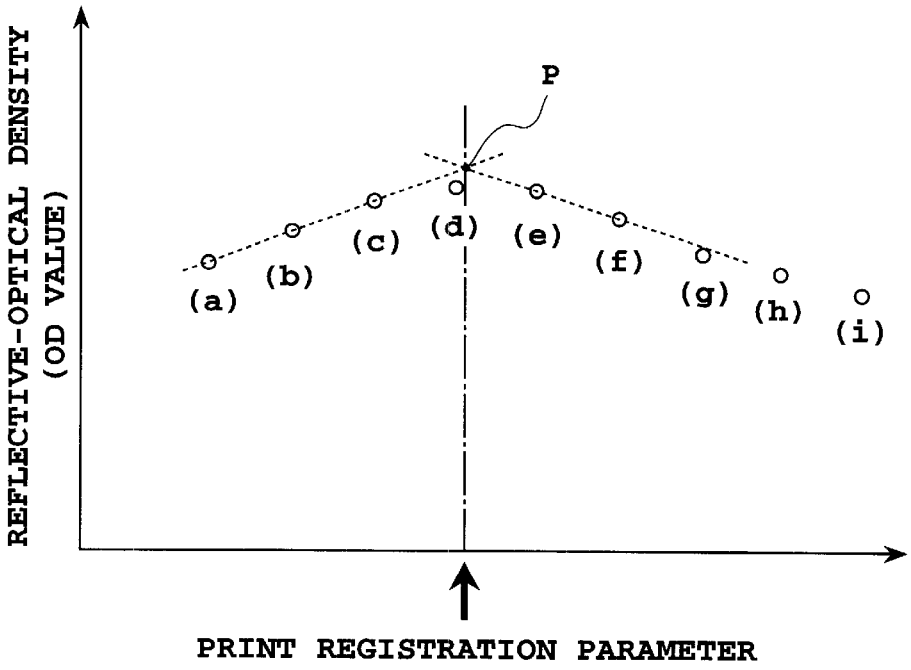
FIG. 18 is a graph illustrating a method for determining a printing registration condition in the first embodiment according to the present invention.
Figure 19:
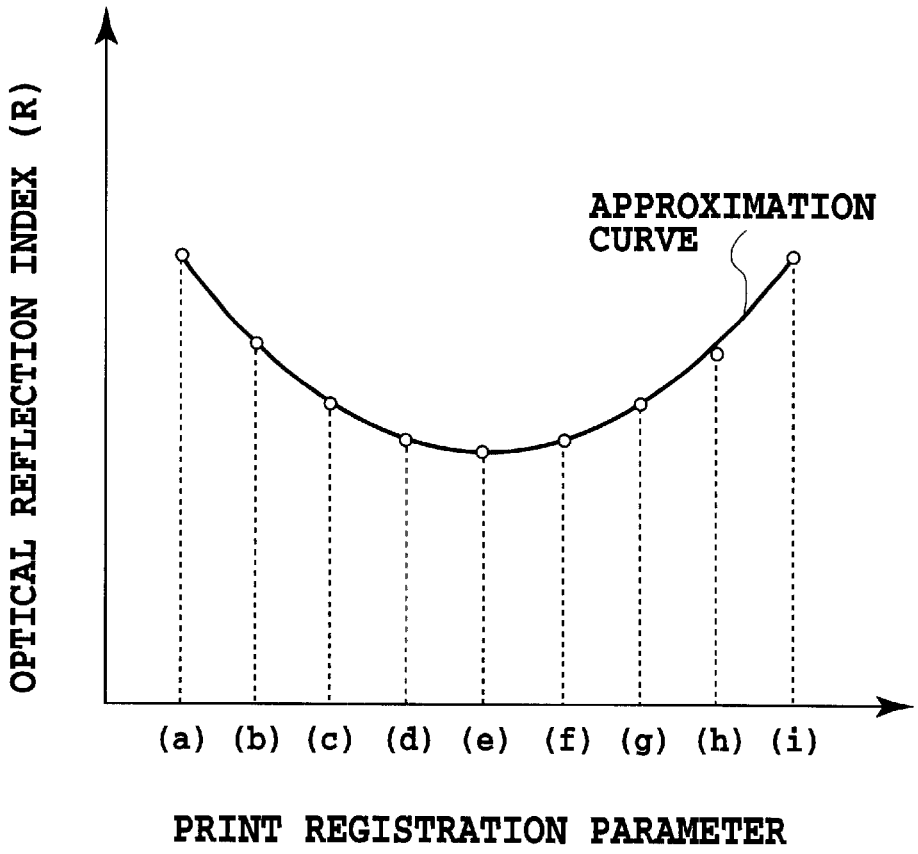
FIG. 19 a graph illustrating the relationship between measured optical reflection indexes and printing position parameters.

FIG. 18 is a graph schematically illustrating an example of data of the measured reflection optical densities.

In FIG. 18, the vertical line represents a reflection optical density; and the horizontal line represents a parameter for varying the relative printing positions in the forward scan and the reverse scan. The parameter is adapted to advance or retard the printing start timing of the reverse scan with respect to the fixed printing start timing of the forward scan.

When measurement results shown in FIG. 18 is obtained in the present embodiment, the intersection point P of the two straight lines respectively extending through two points (the points respectively corresponding to printing position parameters (b), (c), (e) and (f) of FIG. 18) on both sides of the point where the reflection optical density is highest (the point corresponding to a printing position parameter (d) in FIG. 18) is taken as the printing position where the best printing registration is attained. In the present embodiment, the corresponding printing start timing of the reverse scan is set based on the printing position parameter corresponding to this point P. But, when strict printing registration is neither desired nor needed, the printing position parameter (d) may be used.

As graphically shown in FIG. 18, by this method, the printing registration condition can be selected at a pitch smaller or a resolution higher than those of the printing registration condition used for printing the printing pattern 61 etc.

In FIG. 18, the density is not varied significantly irrespective of the variations of the printing condition between the points where the density is high corresponding to printing position parameters (c), (d) and (e). To the contrary, between the points corresponding to printing position parameters (a), (b) and (c) or (f), (g), (h) and (i), the density is varied sensitively relative to the variations of the printing registration condition. When the characteristics of the density close to symmetry as in the present embodiment are exhibited, printing registration can be achieved with higher precision by determining the printing registration condition with the points indicating the variations of the density sensitive to the printing registration condition.

A method according to the present invention for determining the printing registration condition is not limited to the foregoing method. It may be intended that numerical calculation is performed with continuous values on the basis of a plurality of multi-value density data and information of the printing registration condition for use in the pattern printing, and then, the printing registration condition is determined with precision higher than a discrete value of the printing registration condition for use in the pattern printing.

For example, as an example other than linear approximation shown in FIG. 18, a polynomial approximate expression in which the method of least squares with respect to a plurality of printing registration conditions is obtained by using the density data for printing. The condition for attaining the best printing registration may be determined by using the obtained expression. It is possible to use not only the polynomial approximation but also spline interpolation.

Even when a final printing registration condition is selected from the plurality of printing registration conditions used for the pattern printing, printing registration can be established with higher precision with respect to fluctuations of various data by determining the printing registration condition through numerical calculation using the above-described plurality of multi-value data. For example, in a method for selecting the point of the highest density from the data of FIG. 18, it is possible that the density at the point corresponding to the printing position parameter (d) is higher than that of the point corresponding to the printing position parameter (e) due to the fluctuations. Therefore, in a method for obtaining an approximate line from three points on each of both sides of the highest density point to calculate an intersection point, the influence of fluctuation can be reduced by performing calculation using data of more than two points.

Next, another method for determining printing registration condition shown in FIG. 18 is explained.

FIG. 19 shows an example of data of measured optical reflection indexes.

In FIG. 19, the vertical line represents an optical refection index; and the horizontal line, printing position parameters (a) to (i) for varying the relative printing positions in the forward scan and the reverse scan. For example, a printing timing of reverse scan is advanced or retarded to vary a printing position. In the example, a representative point on each patch is determined from the measured data, and the overall approximate curve is obtained from the representative point and a minimum point of the curve is determined as a matched point of the printing position.

Although the square or rectangular patterns (patches) are printed with respect to the plurality of printing registration conditions as shown in FIG. 17 in the present embodiment, the present invention is not limited to the construction. It is sufficient that there is only an area where the density can be measured with respect to the printing registration conditions. For example, all of the plurality of printing patterns (patches 61 etc.) in FIG. 17 may be connected to each other. With such pattern, an area of the printing pattern-can be made smaller.

However, in the case where such pattern is printed on the printing medium 8 by the ink-jet printing apparatus, the printing medium 8 is expanded and a cocking is caused depending upon the kind of printing medium 8 if the ink is ejected to an area in excess of a predetermined quantity, to possibly deteriorate the precision of deposition of the ink droplets ejected from the printing head. The printing pattern used as shown in FIG. 17 in the present embodiment has the merit of avoiding such phenomenon as much as possible.

In the printing patterns in the present embodiment shown in FIGS. 13A to 13C, a condition where the reflection optical density varies most sensitively relative to the offset of the printing position is that the printing positions in the forward scan and the reverse scan are registered (the condition shown in FIG. 13A), wherein the area factor becomes substantially 100%. Namely, it is desirable that the region where the pattern is printed should be covered substantially completely with the dots.

However, the foregoing condition is not essential for the pattern, the reflection optical density of which becomes smaller as the offset of the printing positions becomes greater. But, it is desired that a distance between the dots respectively printed in the forward scan and the reverse scan in the state in which the printing positions in the forward scan and the reverse scan are registered should range from a distance where the dots are contacted to a distance where the dots overlap over the dot radius. Therefore, according to the offset from the best condition of printing registration, the reflection optical density varies sensitively. As described below, the distance relationship between the dots is established depending upon the dot pitch and the size of the dots to be formed, or the distance relationship is artificially established in pattern printing when the dots to be formed are relatively fine.

The printing patterns in the forward scan and the reverse scan are not necessarily aligned in the vertical direction.

Figure 20A:
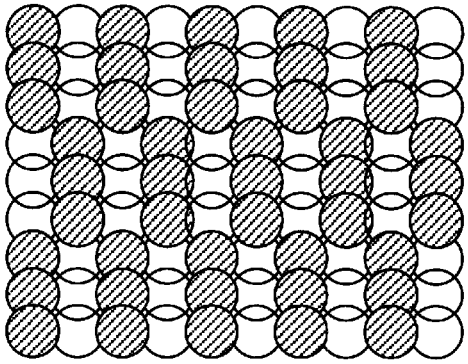
Figure 20B:
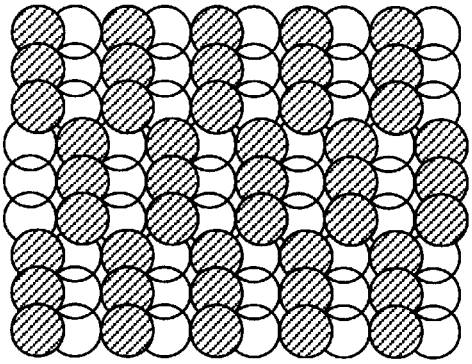
Figure 20C:
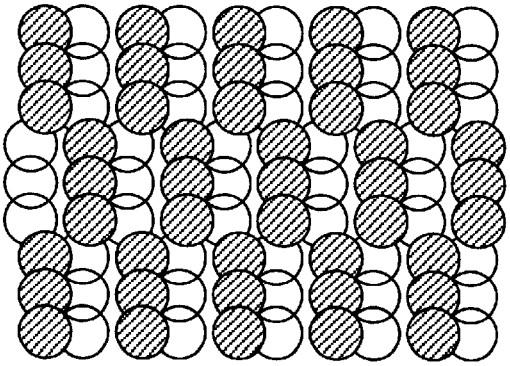

FIGS. 20A to 20C show patterns in which the dots to be printed in the forward scan and the dots to be printed in the reverse scan are intricate mutually. It is possible to apply the present invention to these patterns. FIG. 20A shows the state in which printing positions are well registered; FIG. 20B, the printing positions are registered with a slight offset; and FIG. 20C, the printing positions are registered with a greater offset.

Figure 21A:
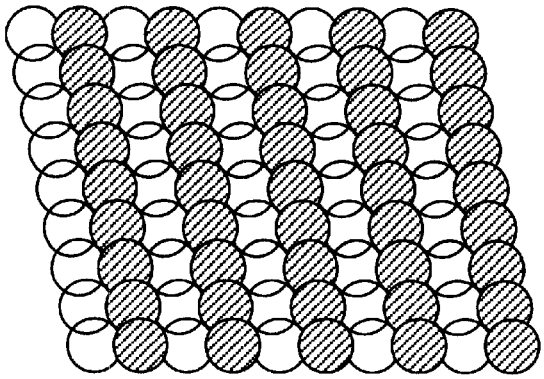
Figure 21B:
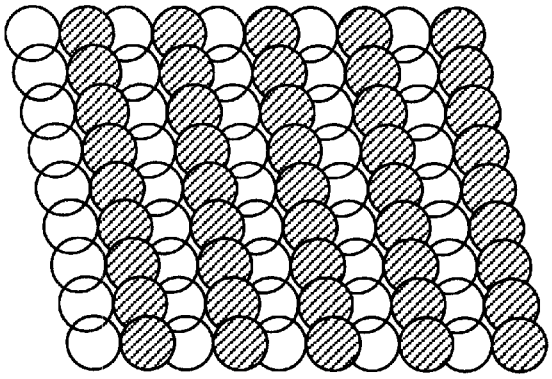
Figure 21C:
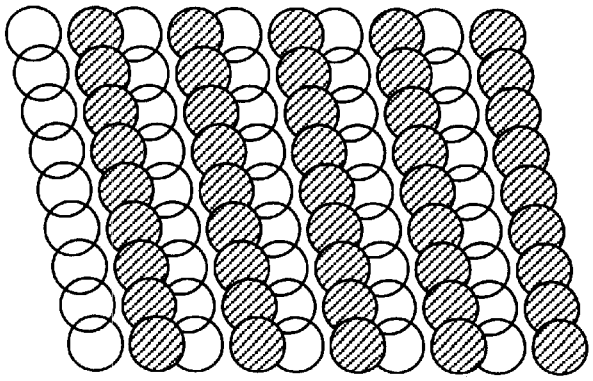

FIGS. 21A to 21C show patterns where dots are formed obliquely. It is possible to apply the present invention to these patterns. FIG. 21A shows the state in which printing positions are well registered; FIG. 21B, the printing positions are registered with a slight offset; and FIG. 21C, the printing positions are registered with a greater offset.

Figure 22A:
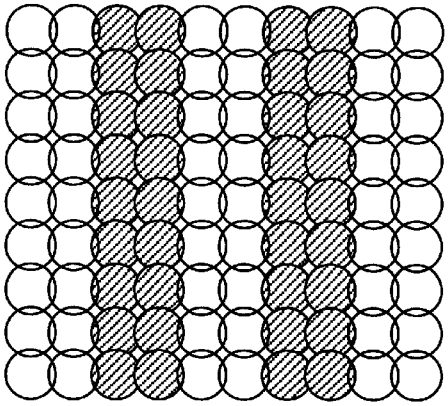
Figure 22B:
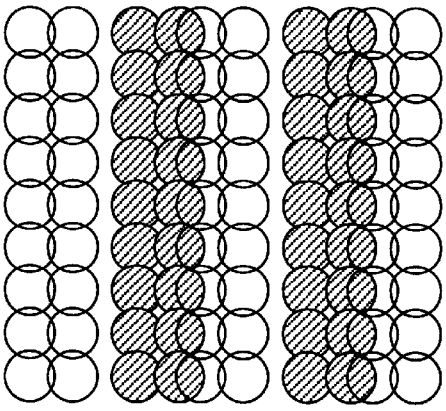
Figure 22C:
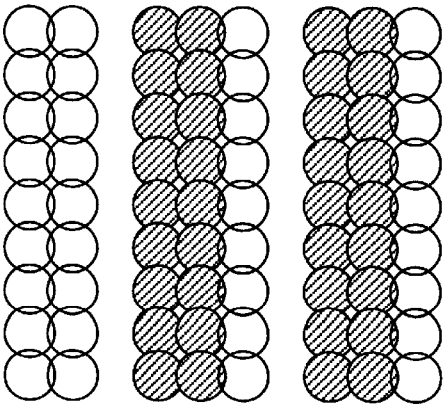

FIGS. 22A to 22C show patterns in which dots are formed at a plurality of columns in forward and reverse scan with respect to printing position offsetting.

FIG. 22A illustrates dots in the case where the printing positions are well registered; FIG. 22B, where the printing positions are registered with a slight offset; and FIG. 22C, where the printing positions are registered with a greater offset. When printing registration is performed by varying the printing registration condition over a greater range such as a printing start timing, the patterns shown in FIGS. 22A to 22C are effective. In the printing patterns shown in FIGS. 13A to 13C, since the set of the dot arrays to be offset is one for each of the forward scan and the reverse scan, the dot array may overlap with the dot array of another set as the offset amount of the printing position is increased. The reflection optical density does not become further smaller even when the offset amount of the printing position becomes greater. In contrast to this, in the case of the patterns shown in FIGS. 22A to 22C, it is possible to enlarge the distance of the offset of the printing position to cause the dot array to overlap with the dot array of another set in comparison with the printing patterns of FIGS. 13A to 13C. By this, the printing registration condition can be varied in greater range. This is actually used in a coarse adjustment described below to cope a position shift to 4 dots.

Figure 23A:
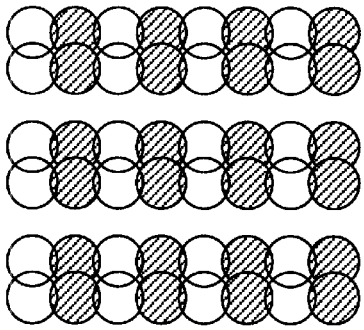
Figure 23B:
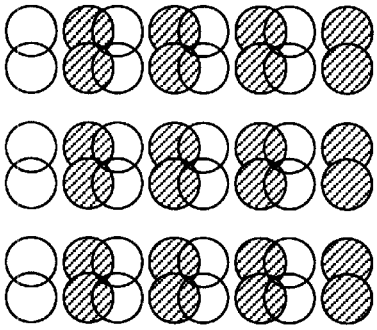
Figure 23C:
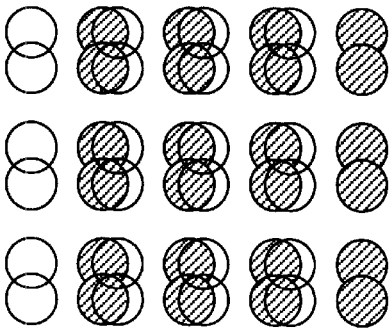

FIGS. 23A to 23C show printing patterns in which dots are thinned on each column.

FIG. 23A illustrates dots in the case where the printing positions are well registered; FIG. 23B, where the printing positions are registered with a slight offset; and FIG. 23C, where the printing positions are registered with a greater offset. It is also possible to apply the present invention to these patterns. This pattern is effective in the case where the density of the dot formed on the printing medium 8 is great, and the density as a whole becomes too great to measure a difference in density according to the offset of the dots by the optical sensor 30 when the patterns shown in FIGS. 13A to 13C are printed. Namely, by reducing the dots as shown in FIGS. 23A to 23C, a not-printed region on the printing medium 8 is increased to lower the density of the overall patch.

Conversely, when the printing density is too low, the dots are formed by performing printing twice at the same position or only at a part.

The characteristics of the printing pattern to reduce the reflection optical density as the offset amount of the printing position is increased require a condition where the dot printed in the forward scan and the dot printed in the reverse scan are matched in contact in the carriage scanning direction. However, it is not necessary to satisfy such condition. In such case, the reflection density may be lowered as the offset amount of the printing positions in the forward scan and the reverse scan is increased.

(3.2) Printing Registration Among a Plurality of Heads

A printing position in a carriage scanning direction between different heads is described. Furthermore, it relates to printing registration in the case where a plurality of kinds of printing mediums, inks, printing heads and so on are used. Namely, the size and density of dots to be formed may be varied depending upon the kind of printing medium or the like to be used. Therefore, in advance of judgment of a printing registration condition, judgment is made as to whether a measured reflection optical density is suitable for the judgment of the printing registration condition. As a result, if it is judged that the measured reflection optical density is not suitable for the judgment of the printing registration condition, the level of the reflection optical density is adjusted by thinning the dots in the printing pattern or overprinting the dots, as described above.

In advance of judgment of the printing registration condition, judgment is made as to whether or not the measured reflection optical density is sufficiently lowered according to the offset amount of the printing position. As a result, if judgment is made that the reflection optical density is inappropriate for performing judgment of the printing registration condition, the dot interval, in the carriage scanning direction set in advance in the printing pattern is modified to again print the printing pattern and measure the reflection optical density.

Concerning the printing pattern explained above, the first one of the two printing heads for the printing registration prints the dots printed in the forward scan, while the second printing head prints the dots printed in the reverse scan, thereby achieving printing registration.

Figure 24:
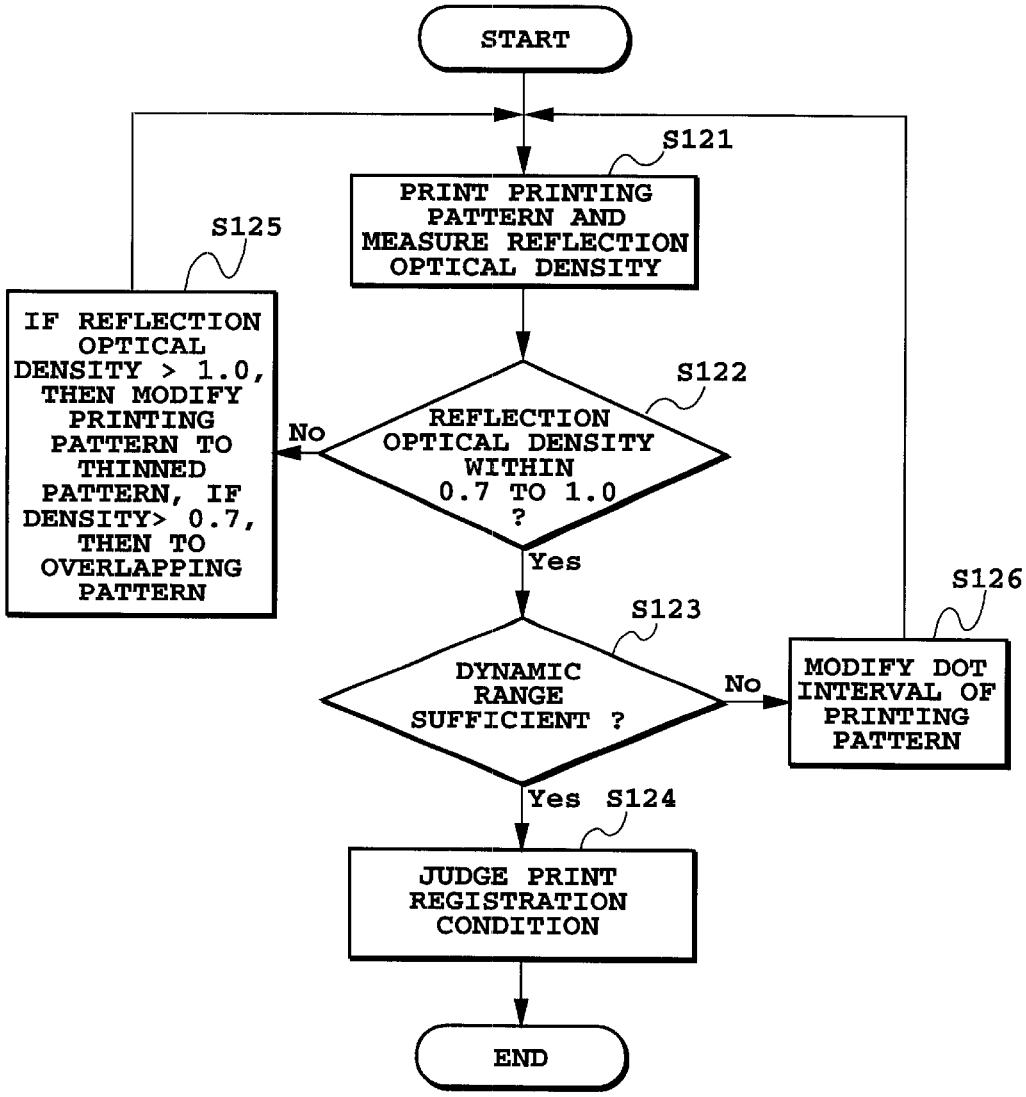
FIG. 24 is a flowchart illustrating printing registration condition judgment processing in a second embodiment according to the present invention.

FIG. 24 is a flowchart illustrating printing registration processing in the second embodiment. This processing can be applied as a part of processing in general algorithm described later.

As shown in FIG. 24, at step S121, the nine patterns 61–69 shown in FIG. 17 are printed as the printing patterns. The reflection optical density of the printing pattern is measured in the same manner as in the bi-directional printing.

Next, at step S122, a decision is made as to whether or not the highest one among the measured reflection optical densities falls within a range of 0.7 to 1.0 of an OD value. If the value falls within the predetermined range, the operation proceeds to a next step S123.

If the result at step S122 is that the reflection optical density does not fall within the range of 0.7 to 1.0, the operation proceeds to step S125. At step S125, the printing pattern is modified to patterns shown in FIGS. 23A to 23C where the dots of the printing pattern are thinned to two thirds when the value is greater than 1.0, and then, the operation is returned to step S121. On the other hand, if the reflection optical density is smaller than 0.7, the printing pattern shown in FIGS. 23A to 23C is overprinted over the printing pattern shown in FIGS. 13A to 13C.

It is also possible to prepare a large number of printing patterns for further modifying the printing pattern so as to repeat the loop from step S121 to step S125 when inappropriateness is judged even in the second judgment. However, in the present embodiment, on the assumption that three kinds of patterns cover almost all cases, the operation proceeds to the next step even when inappropriateness is judged in the second judgment.

Even if the printing medium 8, the printing head or the density of the pattern to be printed with ink is varied, printing registration adapting to such variation becomes possible by the judgment processing at step S122.

Next, at step S123, a decision is made as to whether or not the measured reflection optical density is sufficiently lowered with respect to the offset amount of the printing position, namely, whether or not a dynamic range of the value of the reflection optical density is sufficient. For example, in the case where the value of the reflection optical density shown in FIG. 18 is obtained, a decision is made as to whether or not a difference between the maximum density (the point corresponding to the printing position parameter (d) in FIG. 18) and two next values (the difference between points corresponding to printing position parameters (d) and (b), the difference between points corresponding to printing position parameters (d) and (f) in FIG. 18) is greater than or equal to 0.02. If the difference is smaller than 0.02, judgment is made that the interval of the printing dots of the overall printing pattern is too short, namely, that the dynamic range is not sufficient. Then, the distance between the printing dots is enlarged at step S126, and the processing from step S121 onward is performed.

The processing at steps S123 and S124 will be explained in greater detail with reference to FIGS. 25A to 25C, FIGS. 26A to 26C and FIG. 27.

Figure 25A:
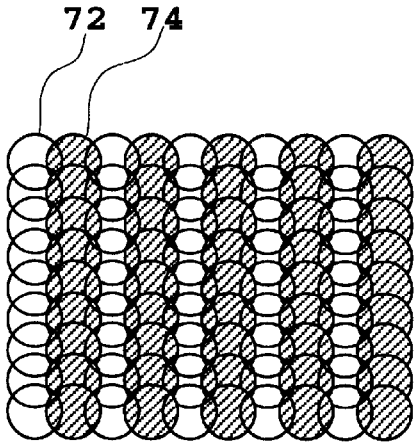
Figure 25B:
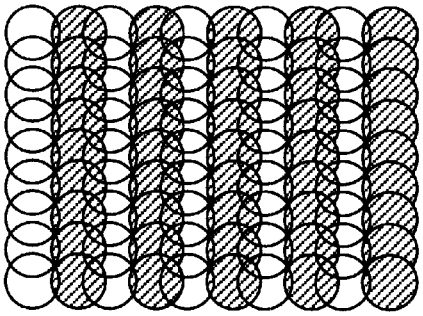
Figure 25C:
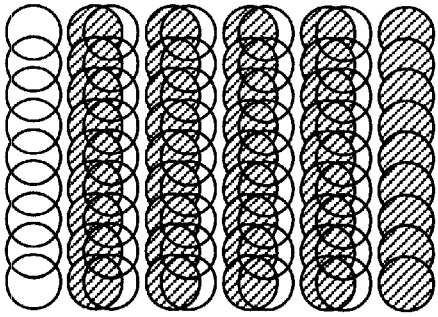

FIGS. 25A to 25C schematically illustrate the printed portion in the case where the printing dot diameter of the printing pattern shown in FIGS. 20A to 13C is large.

In FIGS. 25A to 25C, white dots 72 represent dots printed by the first printing head, and hatched dots 74 represent dots printed by the second printing head. FIG. 25A illustrates dots in the case where the printing positions are well registered; FIG. 25B, where the printing positions are registered with a slight offset; and FIG. 25C, where the printing positions are registered with a greater offset. As is obvious from comparison of FIGS. 25A and 25B, when the dot diameter is large, the area factor is maintained at substantially 100% even if the printing positions of the white dots and the hatched dots are slightly offset, and thus, the reflection optical density is hardly varied. Namely, the condition where the reflection optical density is sensitively decreased according to variation of the offset amount of the printing position, as described in the first embodiment, is not satisfied.

Figure 26A:
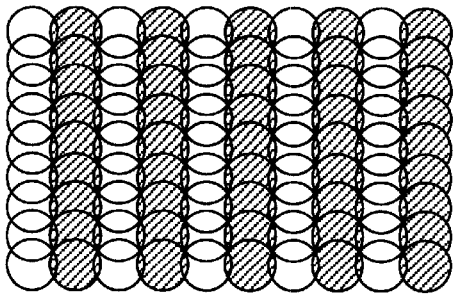
Figure 26B:
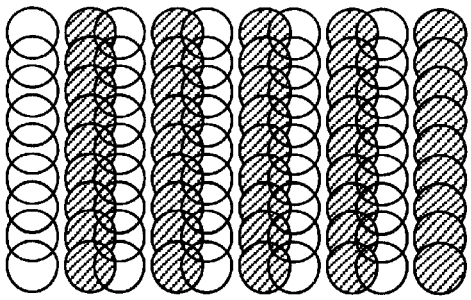
Figure 26C:
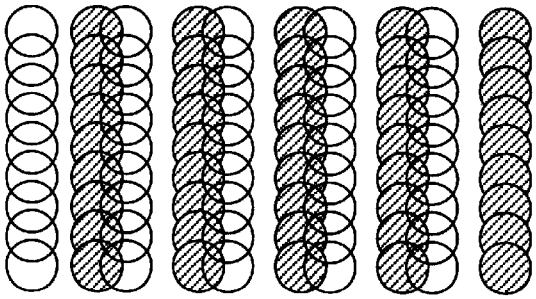

On the other hand, FIGS. 26A to 26C show the case where the interval between the dots in the carriage scanning direction in the overall printing pattern is enlarged without changing the dot diameter. FIG. 26A illustrates dots in the case where the printing positions are well registered; FIG. 26B, where the printing positions are registered with a slight offset; and FIG. 26C, where the printing positions are registered with a greater offset. In this case, the area factor is reduced according to occurrence of the offset between the printed dots to lower the entire reflection optical density.

Figure 27:
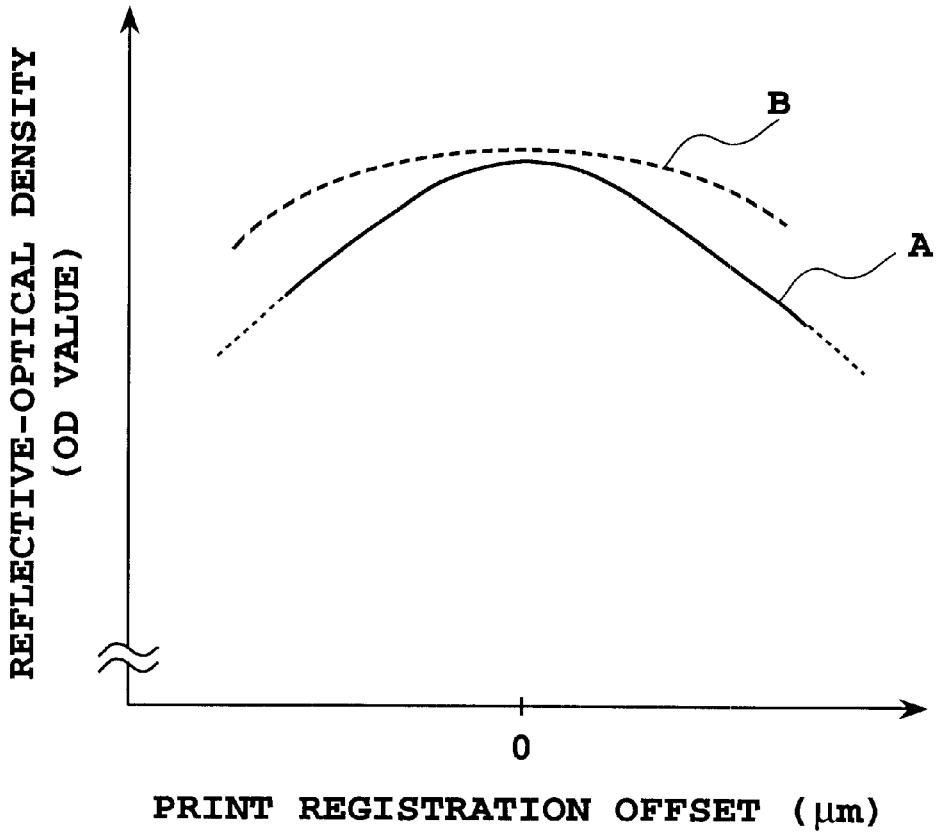
FIG. 27 is a graph illustrating the relationship between a printing position offset amount and a reflection optical density according to the distance between the dots of the printing pattern in the second embodiment according to the present invention.

FIG. 27 is a graph schematically illustrating the behavior of the density characteristics in the case where the printing patterns shown in FIGS. 25A to 25C and 26A to 26C are used.

In FIG. 27, the vertical line represents an optical reflection density; and the horizontal line, an offset amount of the printing position. A solid line A indicates variations of the value of the reflection optical density in the case where the printing is performed under a condition where the reflection optical density is sensitively lowered according to the variation of the offset amount of the printing position as set forth, and a broken line B indicates variations of the value of the reflection optical density in the case where the dot interval is smaller than the former case. As can be clear from FIG. 27, when the dot interval is too small, the reflection optical density cannot be varied too much for the above-described reason even if the printing registration condition is deviated from the ideal condition. Therefore, in the present embodiment, the decision at step S123 of FIG. 24 is made to enlarge the distance between the dots based on the result of the decision, thereby establishing the printing condition suitable for performing judgment of the printing registration condition.

In the present embodiment, the initial dot interval is set short. Then, the dot interval is gradually enlarged until the proper dynamic range of the reflection optical density can be attained. However, if the proper dynamic range of the reflection optical density is not obtained even after the dot interval is enlarged four times, the operation proceeds to the next step for making judgment of the printing registration condition. In the present embodiment, the dot interval is adjusted by varying the driving frequency of the printing head while maintaining the scanning speed of the carriage 2. Consequently, the distance between the dots becomes longer as the driving frequency of the printing head becomes lower. In another method for adjusting the distance between the dots, the scanning speed of the carriage 2 may be varied.

In any case, the driving frequency or scanning speed for printing the printing pattern is different from that to be used in actual printing operation. Therefore, after the printing registration condition is judged, the difference in driving frequency or scanning speed must be corrected accordingly. This correction may be performed arithmetically. Alternatively, it is possible to preliminarily prepare data of printing timings relating to the actual driving frequency or scanning speed for each of the nine patterns 61–69 shown in FIG. 17 so as to use the data based on the result of the printing registration condition. Otherwise, in the case shown in FIG. 18, the printing timing to be used for printing can be obtained by linear interpolation.

A method of judgment of the printing registration condition is similar to that of the bi-directional printing. In printing registration in the forward scan and the reverse scan in bi-directional printing, varying the distance between the dots of the printing pattern with respect to the dot diameter as performed in the present embodiment is effective similarly to the present embodiment. In this case, the printing patterns for the forward scan and the reverse scan are prepared for respective printing patterns of several kinds of distances between the dots to be used. Then, data of the printing timings are prepared for the respective printing patterns and the distances between the dots, thus determining the printing timing to be used in printing by performing linear interpolation based on the result of the judgment of the printing position.

It should be noted that a processing for changing printing patterns and the like shown in the flowchart of FIG. 24 also are applicable to the registration for the bi-directional printing and the registration in the longitudinal direction described as follows which are appropriately modified.

(3.3) Printing Registration in the Longitudinal Direction

Printing registration between a plurality of heads in a direction perpendicular to a carriage scanning direction is descried.

In the printing apparatus in the present embodiment, in order to perform correction of a printing position in the direction perpendicular to the carriage scanning direction (auxiliary scanning direction), ink ejecting openings of the printing head are provided over a range wider than a width (band width) in the auxiliary scanning direction of an image formed by one scan so as to permit correction of the printing position at each interval between the ejection openings by shifting the range of the ejection openings to be used. Namely, as a result of shifted correspondence between the data (image data or the like) to be output and the ink ejection openings, it becomes possible to shift the output data per se.

In the printing registration for the bi-directional printing and the printing registration between a plurality of heads in the main scanning direction described above, the printing pattern, in which the measured reflection optical density becomes maximum when the printing position is registered, is used. However, in the present embodiment, the reflection optical density becomes minimum when the printing positions are registered. With an increasing offset amount of the printing positions, the reflection optical density in the pattern is increased.

Even in the case of printing registration in a paper feeding direction as in the present embodiment, similarly to the above description, it is possible to use a pattern, in which the density becomes maximum under the condition where the printing positions are registered and is decreased with an increasing offset amount of the printing positions. For example, it becomes possible to perform printing registration while paying attention to dots formed by ejection openings in the adjacent positional relationship in the paper feeding direction between two heads, for example.

Figure 28A:
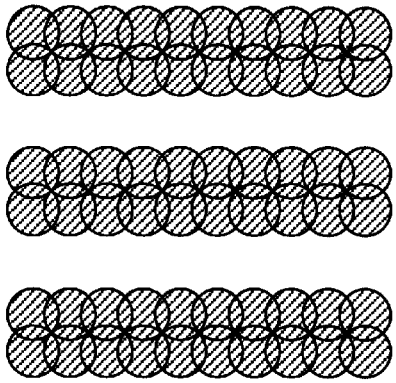
Figure 28B:
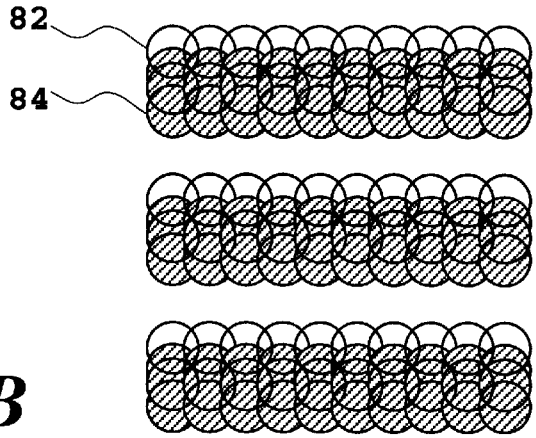
Figure 28C:
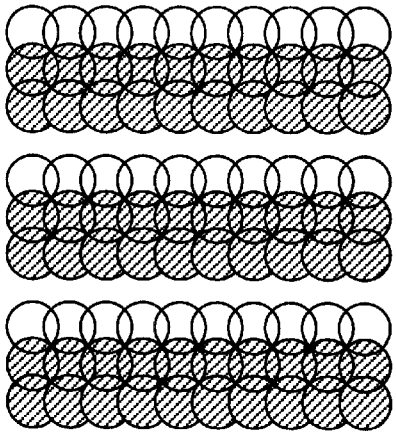

FIGS. 28A to 28C schematically show the printing pattern to be used in the present embodiment.

In FIGS. 28A to 28C, a white dot 82 represents a dot printed by a first printing head, and a hatched dot 84 represents a dot printed by a second printing head, respectively. FIG. 28A illustrates dots in the case where the printing positions are registered, wherein since the above-described two kinds of dots are overlapped, the white dot is not visually perceived; FIG. 28B, where the printing positions are slightly offset; and FIG. 28C, where the printing positions are further offset. As can be seen from FIGS. 28A to 28C, with an increasing offset amount of the printing positions, the area factor is increased to increase an average reflection optical density as a whole.

By offsetting the ejection openings of one of the two printing heads concerned in printing registration, five printing patterns are printed while varying printing registration condition with respect to offsetting. Then, the reflection optical density of the printed patch is measured.

Figure 29:
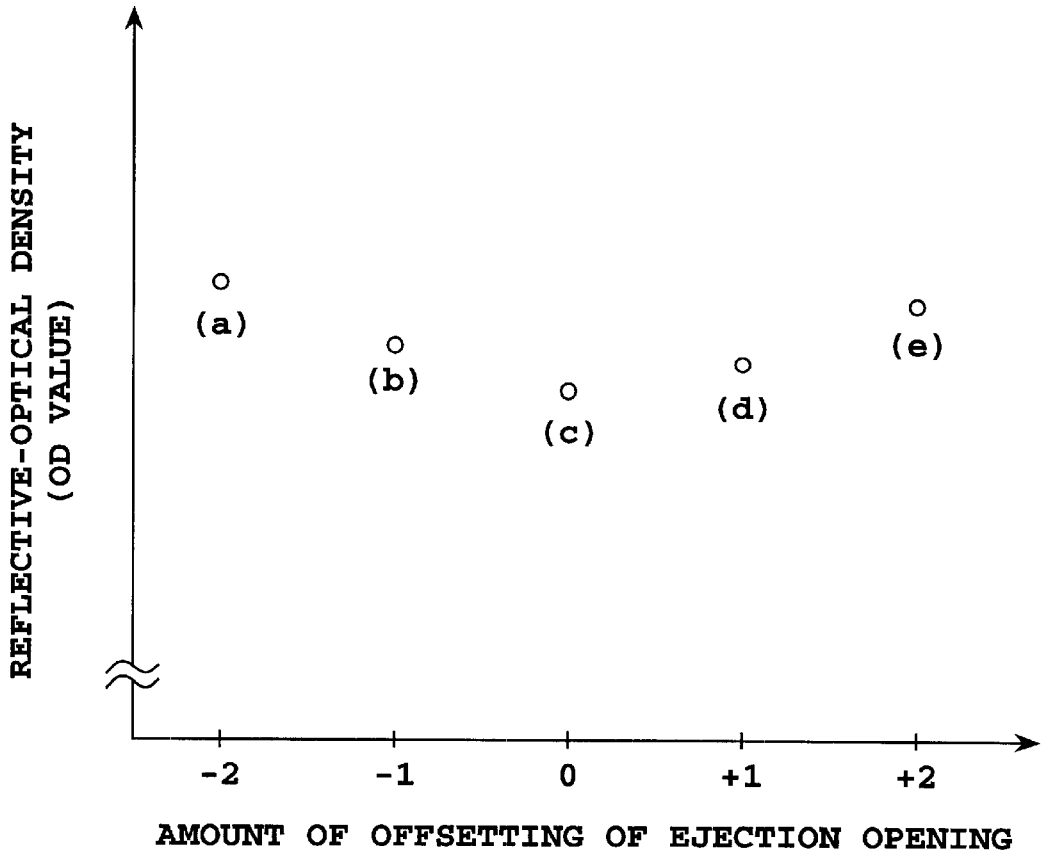
FIG. 29 is a graph illustrating the relationship between a printing ejection opening offset amount and a reflection optical density in the third embodiment according to the present invention.

FIG. 29 graphically shows an example of the measured reflection optical density, in which five patterns are illustrated for example.

In FIG. 29, the vertical line represents a reflection optical density; and the horizontal line, an offset amount of the printing ejection openings. Among the measured reflection optical densities, the printing condition where the reflection optical density becomes the minimum ((c) in FIG. 22) is selected as the condition where the best printing registration is established.

Moreover, a pattern used at a time of execution of each registration processing as described in the above items (3.1) to (3.3) is not limited to only the printing registration in each processing, and it is needless to say that an appropriate change is added if necessary and the above pattern can be used for the other actual printing registration in the same manner.

Further, the items (3.2) and (3.3) show an example in the relationship between two print heads, but can be applied to the relationship between three print heads or more in the same manner, and for example, in the three print heads, printing positions of a first head and a second head are registered and thereafter positions of the first head and a third head have only to be registered.

4. First Example of Algorithm of Dot Alignment Processing

The above is fundamental and next one example of an algorithm of an automatic dot alignment processing will be described.

Figure 30:
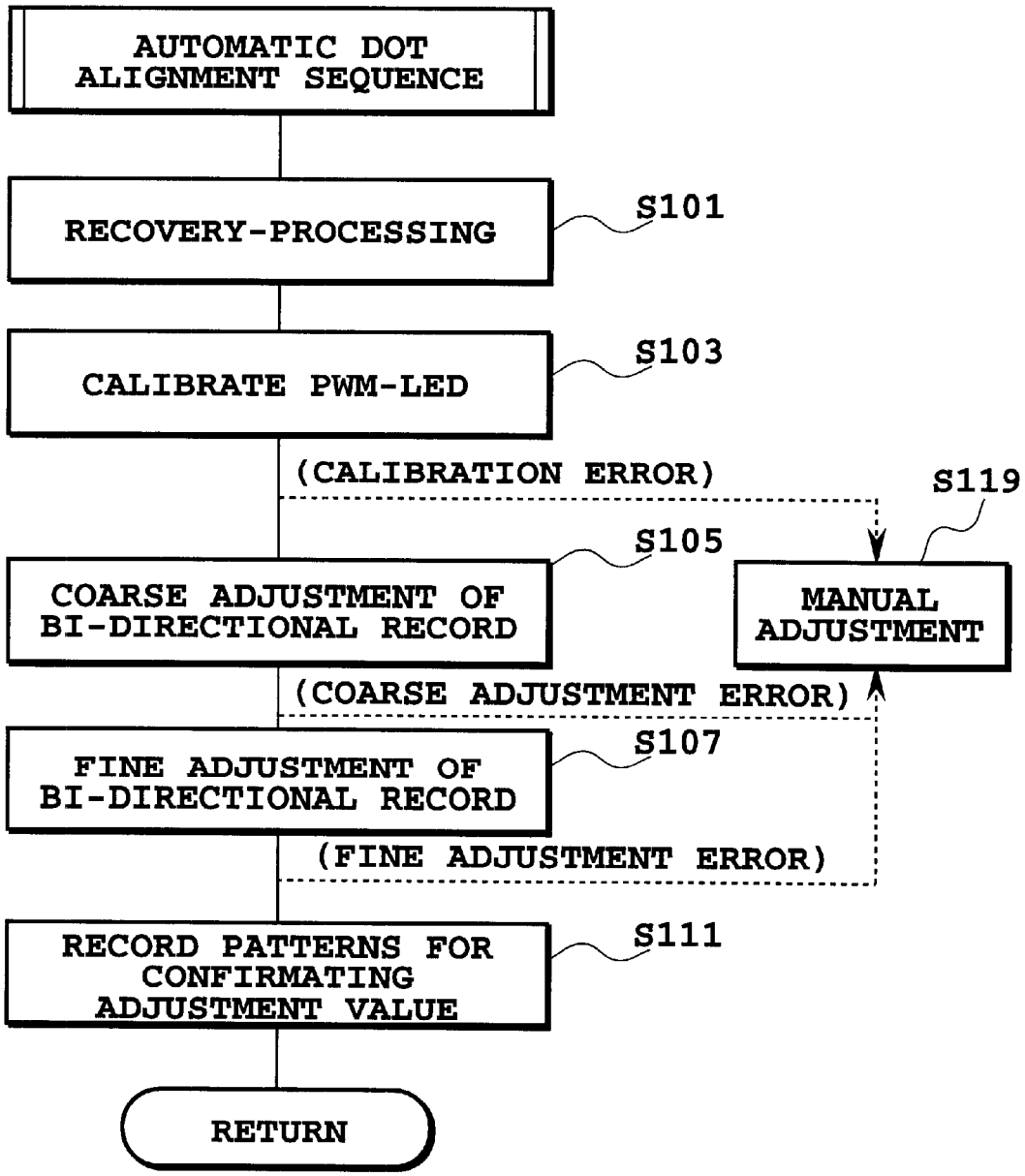
FIG. 30 is a flowchart showing one example of an entire algorithm of an automatic dot alignment processing capable of using in the invention.

FIG. 30 shows an outline of an automatic dot alignment processing algorithm in this example, generally comprising: a recovery processing step (step S101); a sensor calibration processing step (step S103); a coarse and a fine adjustment steps of a bi-directional record (steps S105, S107); and an adjustment value confirmation pattern printing processing step (step S111), and these steps are executed for registering depositing positions in respective prints in a forward scan and in a reverse scan under optimum conditions using mainly the same print head.

Moreover, means for activating this algorithm is an input from an activation switch provided in a body of the printing apparatus or applications on a side of the host computer 110, and additionally at a time of apparatus turn-on, a timer activation, etc. as required. Further, these may be combined.

Further, for example, in the case where such a calibration as procures data except in a usable range is caused in a sensor calibration processing, or in the case where a strength of reflection lights are extremely increased by influences of disturbance lights, etc. in a processing of a dot alignment processing, and as the results, a coarse adjustment error or a fine adjustment error occurs, a normal manual adjustment is executed (step S119). This processing will be described below.

In the case where a sensor error is temporary which is caused by reception of accidental disturbance lights, the apparatus informs a user that he takes a time or adjusts conditions and then the dot alignment processing can be again activated. This point was explained in the item (1.5), including explanation of conditioning which are transferred to the manual adjustment.

Hereinafter, processing contents at each step will be in detail described.

(4.1) Recovery Processing

As mentioned above, a recover processing is a sequential operations for setting or holding an ink ejection state of the print head such as sucking, wiping, preliminary ejecting and the like to be normal prior to execution of an automatic dot alignment in a normal state, and the recovery processing is performed prior to the execution in the case where an execution instruction of the automatic dot alignment is made. Thereby, it is possible to perform printing a pattern for printing registration in a state that an ejection state of the print head is stable and set correction conditions of printing registration with high reliability.

The recovering operations are not limited to a series of operations such as sucking, wiping, preliminary ejecting and the like, but may be only preliminary ejecting or only preliminary ejecting and wiping. It is preferable that the preliminary ejecting in this case is set so as to perform preliminary ejecting having the greater number of ejection than that at a time of printing. Further, in a combination of the number of times of sucking, wiping, preliminary ejecting and order of operations, there are in particular no conditions for limitation.

Further, it may be decided whether execution of sucking recovery prior to automatic dot alignment control is required in response to an elapsed time from sucking recovery at a previous time or not. In this case, it is first decided whether a specified period of time elapses from previous sucking operations immediately before the automatic dot alignment is carried out or not. If the sucking operations are executed within a specified period of time, the automatic dot alignment is executed. In the meantime, if the sucking recovering operations are not executed within the specified period of time, after a series of recovering operations containing the sucking recovery are executed, the automatic dot alignment can be carried out.

Further, it is decided whether the print head ejects an ink at the specified number of ejection or more from the previous sucking recovery or not, and in the case where the ink is ejected at the specified number of ejection or more, after the recovery operations are executed, the automatic dot alignment may be executed. Further, by use of both the elapsed period of time and the number of ink ejection as decision materials, a combination may be made so that, if any one reaches a specified value, the sucking recover is executed.

Thus, as it is possible to prevent the sucking recovery from being excessively executed, this can contribute to saving of a consumption amount of inks and a reduction of an ink discharge amount to a disused ink processing portion, and also the recovering operations prior to the automatic dot alignment can effectively be carried out.

Further, recovery conditions are variable in response to the elapsed time from the previous sucking recovery or the number of ink ejection, and for example, in the case where the elapsed period of time is short, only preliminary ejection and wiping are carried out without executing the sucking operations, and in the case where the elapsed period of time is long, the recovery conditions may be changed, for example, the sucking recovery is midway executed.

As mentioned above, the recovering operations are executed as required, but a structure of executing the recovery operations is not always required to use, and if the printing apparatus is originally high in reliability, the recovering operations in the automatic dot alignment processing are not required to execute. It is more preferable that high reliability is secured and besides the automatic dot alignment processing is executed.

(4.2) Sensor Calibration

Next, in one example of a calibration of LED included in an optical sensor 30, a supply power is PWM-controlled so as to perform a calibration so that it is desirably used in a linear area, in order to obtain a specified range as output characteristics of the optical sensor. Specifically, the supply current is PWM-controlled, and a current amount flowing at intervals of 5% is controlled, for example, from a full power of 100% duty to a power of 5% duty, thereby to obtain an optimum current duty, so that LED of the optical sensor 30 is driven as an example.

The reason why is as follows:

That is, lights are irradiated from the light-emitting side of the optical sensor 30 on a pattern in which printing registration conditions are changed, and in order to decide the optimum printing registration conditions from relative values of the reflected lights output, unless the optimum light amount is irradiated and an optimum electric signal is applied to a photosensing side, a reliable output difference cannot be obtained.

In order to obtain a sufficient output difference (an output difference between patterns when printing positions are changed at a minimum in actual printing registration patterns), it is strongly desirable that a calibration of a sensor itself (a light-emitting portion side and/or a photosensing portion side) is performed.

This is preferable when correcting variations peculiar to a density sensor (an optical sensor), a sensor mounting tolerance in the printing apparatus, an atmosphere difference such as a state of lights, humidity, an air of an environment (mist, smoke), a temporal change of a sensor itself, influences of an output reduction due to heat storage, mist adhered to the sensor, influences of an output reduction due to paper powders, or the like. Further, from this viewpoint, a sensor calibration method of the invention can be adapted to not only an optical sensor for use in execution of the automatic dot alignment, but also an optical sensor for detecting presence or absence of a printing medium and a paper width, a sensor used for head shading, or the like, namely an optical sensor used in widely obtaining any information from an object to be measured.

Here, a calibration on a side of a luminous portion will be described.

Figure 31:
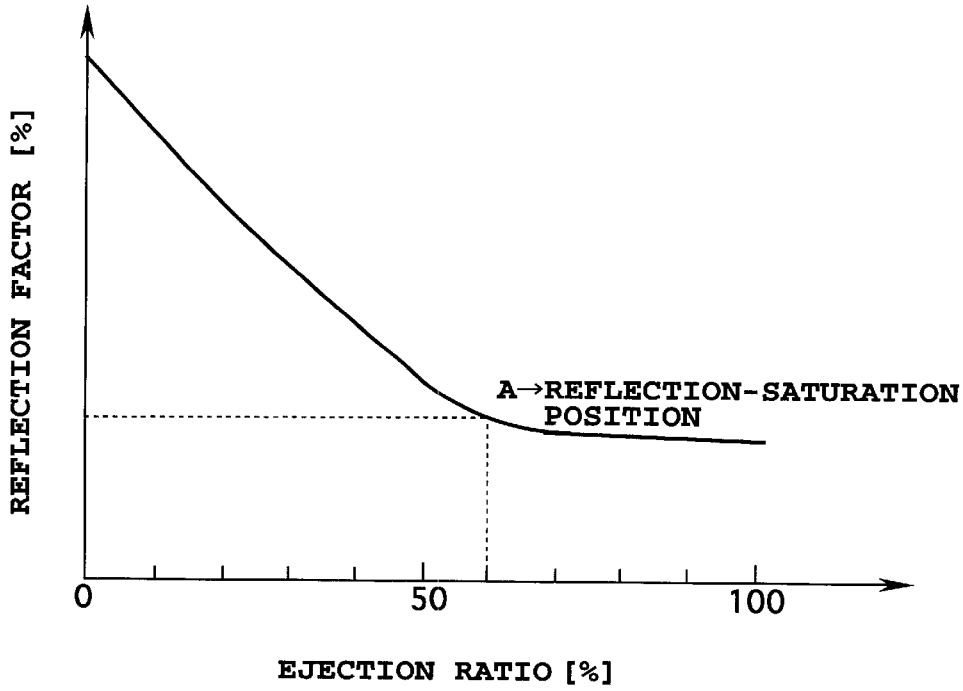
FIG. 31 is a diagram showing a characteristic of a reflection factor in the case of varying an ink ejection ratio for the predetermined region.

FIG. 31 shows the relationship of reflectivity in the case where an ink deposition rate on a specified area is changed, and as shown in FIG. 31, there are characteristics that reflectivity is saturated at a certain deposition rate or more (a position A or more). Output characteristics of the sensor itself are to measure a change of reflected lights with respect to irradiated lights on the light-emitting side, and depend firmly on an area factor in a specified area. In this example, since even if the ink is deposited at a deposition rate or more at a position A, the area factor is not substantially changed, the reflectivity is not also changed. Even in the actual printing registration, a range depending largely upon a change of this are factor, namely an unsaturated and linear range of reflectivity instead of the deposition rate is essential.

Figure 32:
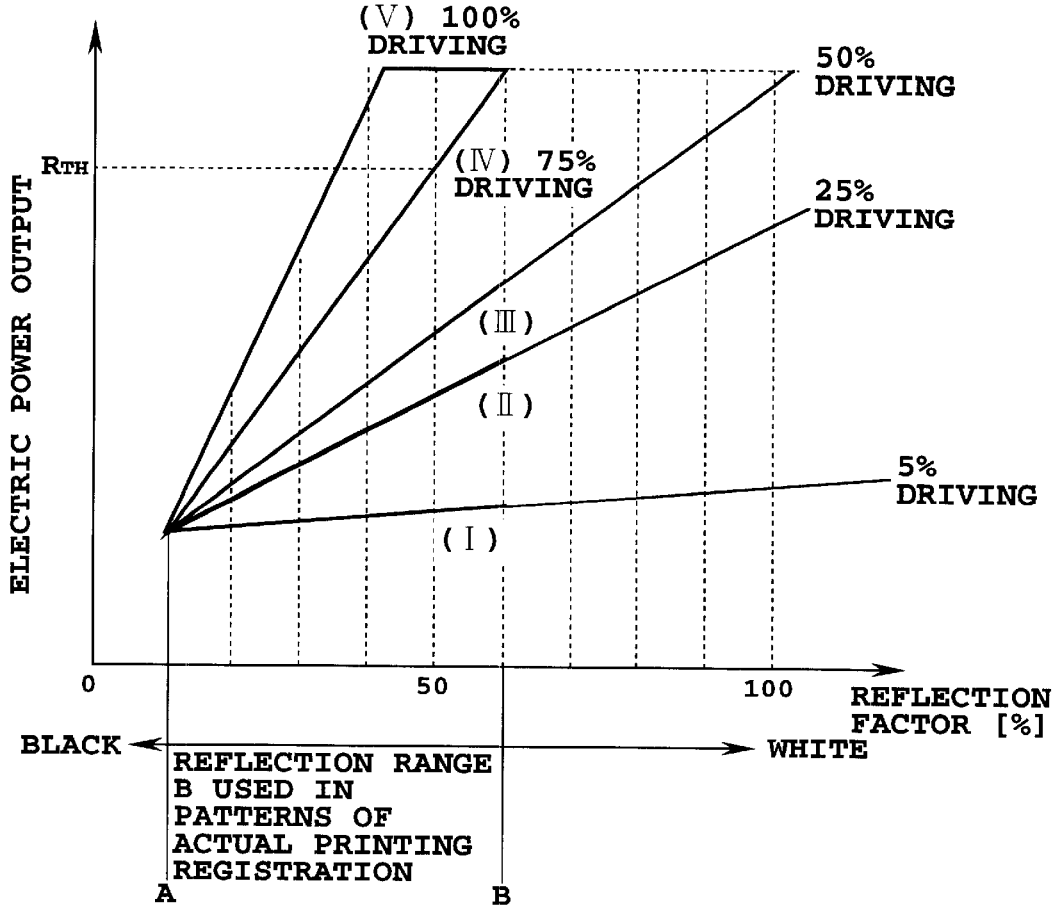
FIG. 32 is a diagram showing results of densities of measurement objects whose reflection factors are different from each other, while varying electric signals of a light-emitting portion of the optical sensor being used in the embodiment.

FIG. 32 shows output characteristics measured when a maximum rated value of an electric signal applied to the light-emitting side is set at 100% and an electric signal (a driving signal) is set at 5%, 25%, 50%, 75% and 100%, in response to a pattern in which reflectivity is changed. If a light amount is too weak, an amount of reflected lights is too small between outputs of patterns of different reflectivity and a difference in output is scant. On the contrary, if a luminous amount is too strong, reflected lights are increased in a pattern of reflectivity inclining toward a white ground in outputting patterns of different reflectivity, and at a time of exceeding detection capability on a side of light reception, there is scarcely a difference from an output of a white ground. Therefore, if such pattern in a reflectivity area exists in actual printing registration patterns, an output difference cannot preferably be obtained. Here, it is material that the output difference in the reflectivity area of the pattern used for the printing registration can be obtained. In the case where the reflectivity area of the pattern of the actual printing registration is limited to a range of A to B in FIG. 32, output characteristics of (i) to (iv) are linear, but in the case of the actual printing registration, characteristics of (iv) can secure an excellent S/N ratio.

A modulation of a driving signal on the light-emitting side is made in a processing of the MPU 101 inside a printer and the modulation unit amount can be processed in minimum unit which a luminous amount is changed.

The modulation is same in a calibration on a photosensing side, and the optimum electric signal applying conditions can be decided when reflectivity of printing registration patterns are measured by the above method. The modulation of a driving signal of the photosensing side is performed by a processing of the MPU 101 inside the printer and the modulation unit amount can be processed in minimum unit which a luminous amount is changed.

Further, there can be provided a buffer for storing an output value inside the printer and means which the output value can be compared with the threshold value set in a printer section in advance and by which can be processed.

Here, a referencing object to be measured is required in order to perform the above calibration. In this embodiment, the sensor calibration is performed as the assumption of the dot alignment processing, and at the time of the dot alignment, the predetermined patches are printed on a printing medium, whereby a pattern for the sensor calibration which is an object to be measured is printed on the printing medium. The sensor calibration may be performed every each of the dot alignment processes (coarse adjustment and fine adjustment with respect to a bi-directional printing in a first example of the dot alignment processing, in addition, coarse adjustment and fine adjustment between a plurality of heads in a second example described below, and further vertical adjustment) or the sensor calibration pattern may designed to be printed and formed only at a heading portion (page head) of the printing medium, and a sensor calibration of one time also may be designed to perform prior to a series of dot alignment processes.

Moreover, a printing medium being formed patches for the dot alignment processing as described above is utilized, and in addition, is mounted on a body of the printing apparatus (for example, such structure is added to a platen), and it is possible to utilize a printing medium, a metal plate or the like in which only an object to be measured is separate.

Next, an object to be measured (a calibration pattern) used for a sensor calibration is composed of a color reacting to sensor luminous wavelengths sensitively. The color may be single, or a plurality of colors may be combined if reflectivity is not changed according to positions in a specified area.

Moreover, in the case where the sensor calibration pattern changing reflectivity is used, the pattern may be a pattern which each pattern becomes is an independent patch, and partial patterns changing reflectivity may be continued.

Moreover, in the sensor calibration, after an electric signal is coarsely changed to perform coarse adjustment, it may be minutely changed to make fine adjustment, or it may be minutely changed from the beginning.

Further, in the sensor calibration, while an electric signal to be applied is changed in a processing of a main scan of the carriage, a measurement may be executed, and after the carriage is stopped and it is changed, a measurement may be executed. Furthermore, the calibration may be executed within one scan or within a plurality of scans.

Next, several specified example of a sensor calibration are described.

(4.2.1) First Example of Sensor Calibration Processing

A pattern changing reflectivity is measured by changing an electric signal being applied to the light-emitting side and/or a photosensing side, and by use of the reflectivity closest to sensitivity characteristics (an inclination of output characteristics) preset in ROM, etc. inside a printer or one more than those, hereafter, the printing registration measurements are performed. The pattern changing the above reflectivity may be in a reflectivity area used in an actual registered pattern, or in the whole area of reflectivity (0 to 100%).

FIG. 32 shows results derived by measuring reflection density (an output) of objects to be measured having different reflection indexes (for example, patterns formed at a reflection index at intervals of 10% between 0 to 100%) by changing an electric signal on the light-emitting side. A reflection index is taken in the horizontal axis and reflection density (an output) is taken in the vertical axis in FIG. 32.

Figure 33:
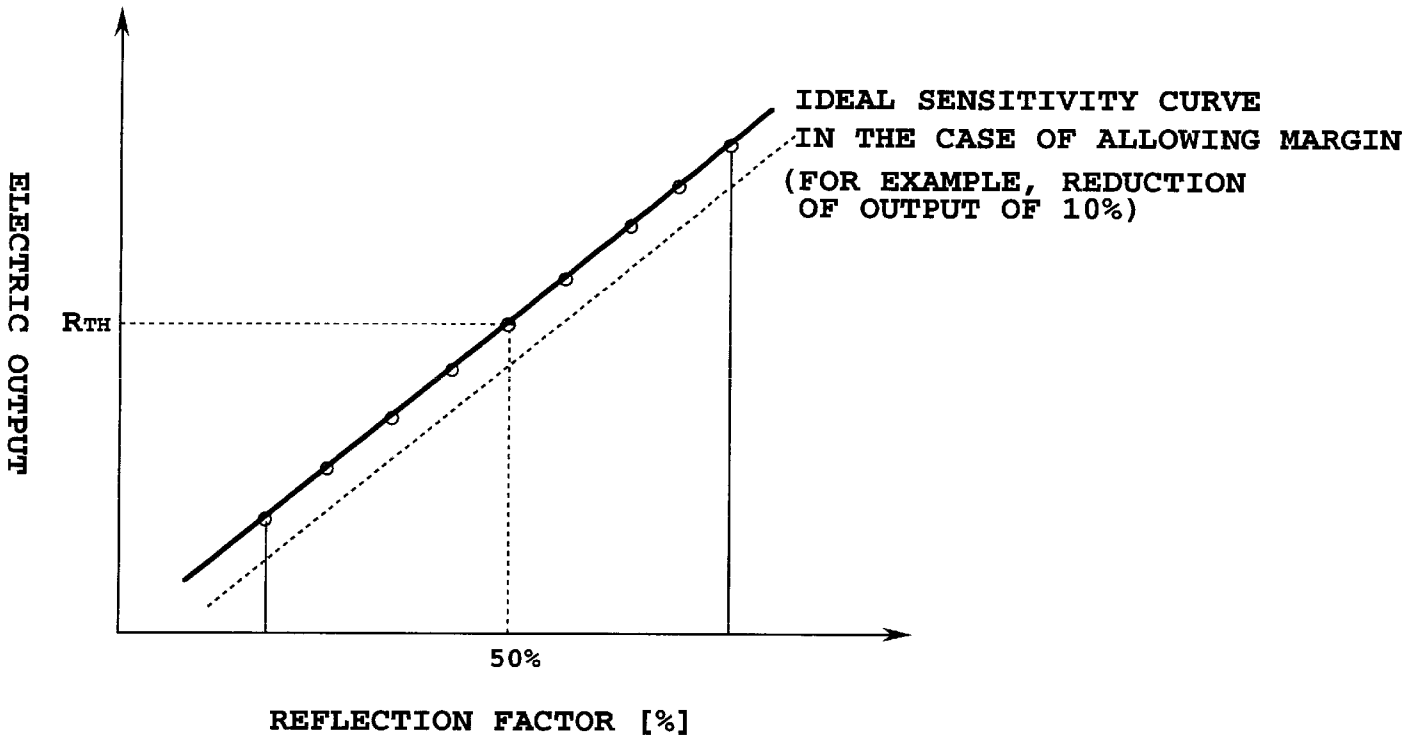
FIG. 33 is a diagram showing an ideal sensitivity characteristics of the optical sensor.

FIG. 33 shows ideal sensitivity (output) characteristics in a state that, when the reflection index is changed, reflected lights density (output) is changed linearly. In the case where a duty of an electric signal applied to the light-emitting side is too small and a change amount of the reflected lights from a specified pattern is lower than resolution of the photosensing side, an output change is scant as shown in characteristics (i) of FIG. 32. If a duty is too large, the reflection concentration (output) itself is not changed at a time when the reflected light amount exceeds a maximum detection width of the photosensing side as shown in characteristics (v), similarly. Here, it is a premise that an output change occurs in an all reflection index area (0 to 100%), but an area deriving sufficiently the output change conforming to a reflection index area of the printing registration used actually may be used. Here, conditions deriving sufficiently the output change mean that, in the case where a printing position is offset at a minimum in an actual printing registration pattern, the output change can be obtained.

And, ideal output characteristics as shown in FIG. 33 for using the actual printing registration are provided in a body of the apparatus and a drive duty on the light-emitting side and/or the photosensing side which can approximate to these characteristics (there may be a flexibility to a certain degree, for example, characteristics of 10% down shown by a broken line in FIG. 33 are used) is selected.

(4.2.2) Second Example of Sensor Calibration Processing

An electric signal applied to the light-emitting side and/or an photosensing side is set as a constant amount and the pattern changing a reflection index is measured, and sensitivity characteristics (an inclination of output characteristics) are computed from a plurality of output data (two at a minimum), and in the case where a measured value except a measured value used for computing the sensitivity characteristics is deviated from values estimated from the characteristic curve, the electric signal to be applied is changed and the same decision is repeated. In the case where a plurality of applied amounts are correct from this decision, one having the greatest inclination of the output characteristics there among may be selected, or a certain flexibility has previously been set inside the printer and a selection is performed as required. In the same manner as described above, these output characteristics may be within the range of reflection indexes used in the actual registered pattern, or in the entire reflection index area (0 to 100%).

Figure 34:
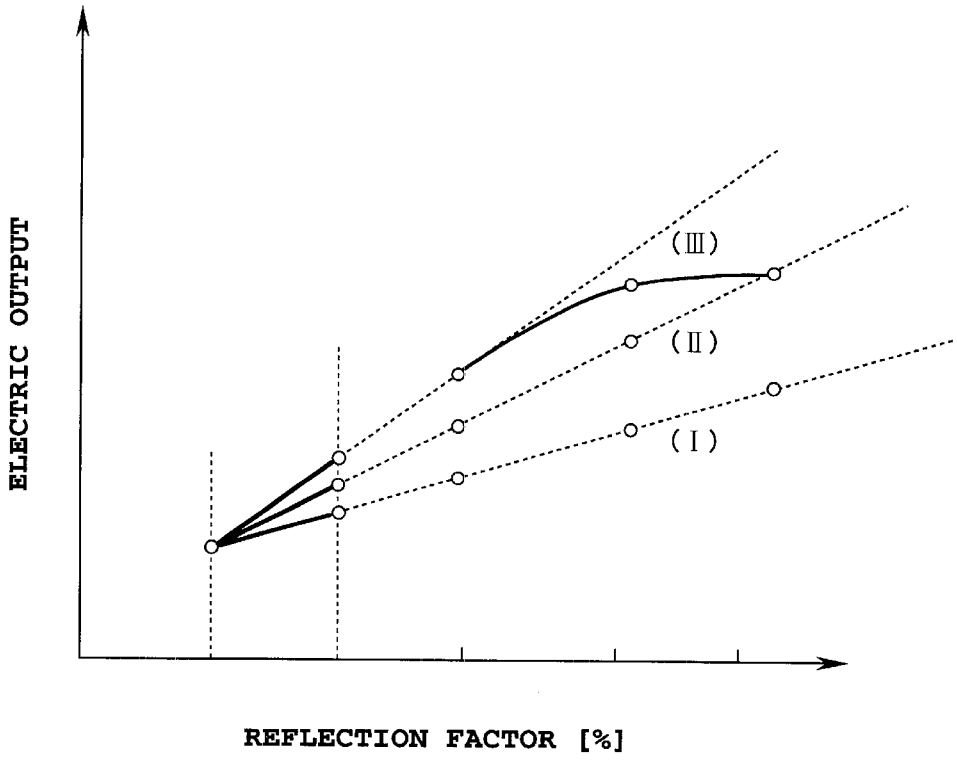
FIG. 34 is a diagram for illustrating one example of a sensor calibration processing capable of using in the algorithm shown in FIG. 30.

That is, as shown in FIG. 34, a duty of an electric signal being applied to the light-emitting side and/or the photosensing side is set a constant amount, and reflection density (an output) of a plurality of measured patterns (two at a minimum) is obtained, and imaginary sensitivity characteristics (an inclination of output characteristics) is computed therefrom, and in the case where a measured value except a measured value used for computing the imaginary characteristics is deviated from the characteristic curve (for example, characteristics (iii)), the same operations are repeatedly carried out at a duty other than that, and a duty indicating characteristics ((ii) or (i)) closest to ideal characteristics (a linear inclination) is selected (there may be flexibility to a certain degree).

(4.2.3) Third Example of Sensor Calibration Processing

A specified pattern (a white patch of dot deposition rate 0%, a solid patch formed at the other deposition rate than that or the like) is measured by changing an electric signal applied to the light-emitting side and/or the photosensing side, and the following printing registration measurement is designed to perform by using one which the output value (reflection density) reaches a threshold value previously set inside the printer.

That is, if reflected light density (an output) of an object to be measured in which a reflection index is fixed (for example, only a solid patch formed at the deposition rate of 50%) is measured, the output characteristics can be approximately estimated. One which utilizes these features corresponds to this example.

Figure 35:
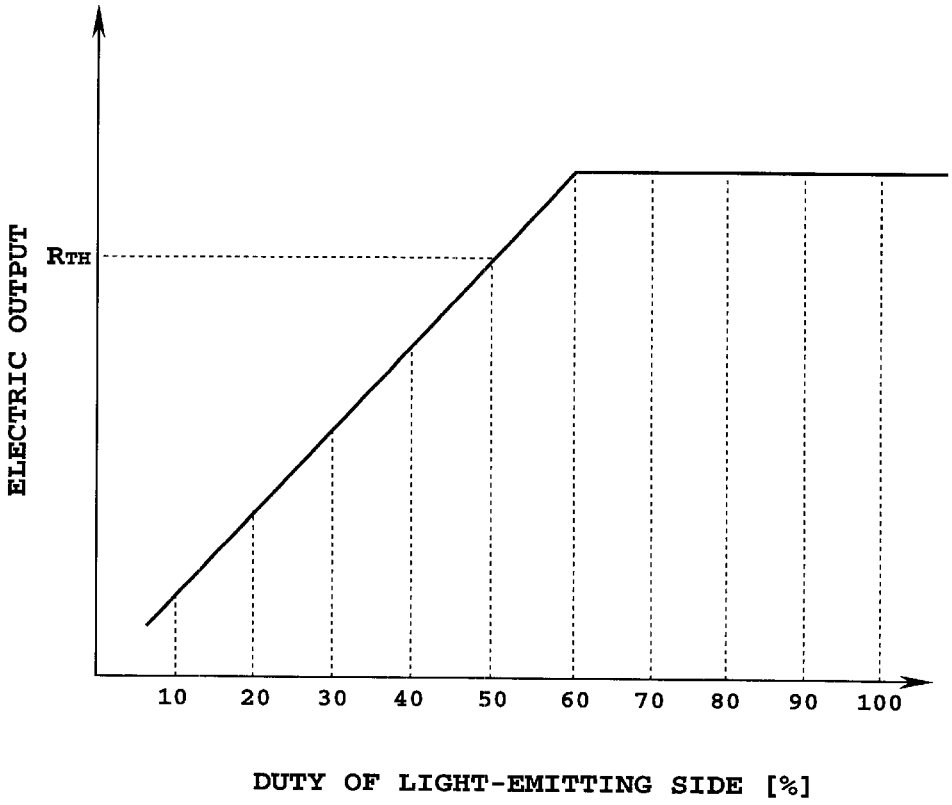
FIG. 35 is a diagram for illustrating an another example of a sensor calibration processing capable of using in the algorithm shown in FIG. 30.

FIG. 35 shows output characteristics in the case where printing of pattern with a deposition rate of 50% is performed on a printing medium and a calibration on the light-emitting side is performed by using this. When a pulse width (a duty) of an electric signal being applied to the light-emitting side is varied, the output is not changed from a certain duty. This state is the case where reflected lights of a detection width or more on the photosensing side are detected. Then, the output is compared with a threshold value Rth prepared beforehand in the printing apparatus, and a duty closest to the threshold value (there may be flexibility to a certain degree) is selected.

(4.2.4) Fourth Example of Sensor Calibration Processing

The described-above processes are combined to execute. Namely, for example, in the processing of the third example, an electric signal is changed to measure and the processing may be designed to switch to the first example or the second example at a time of exceeding the threshold value.

Figure 36:
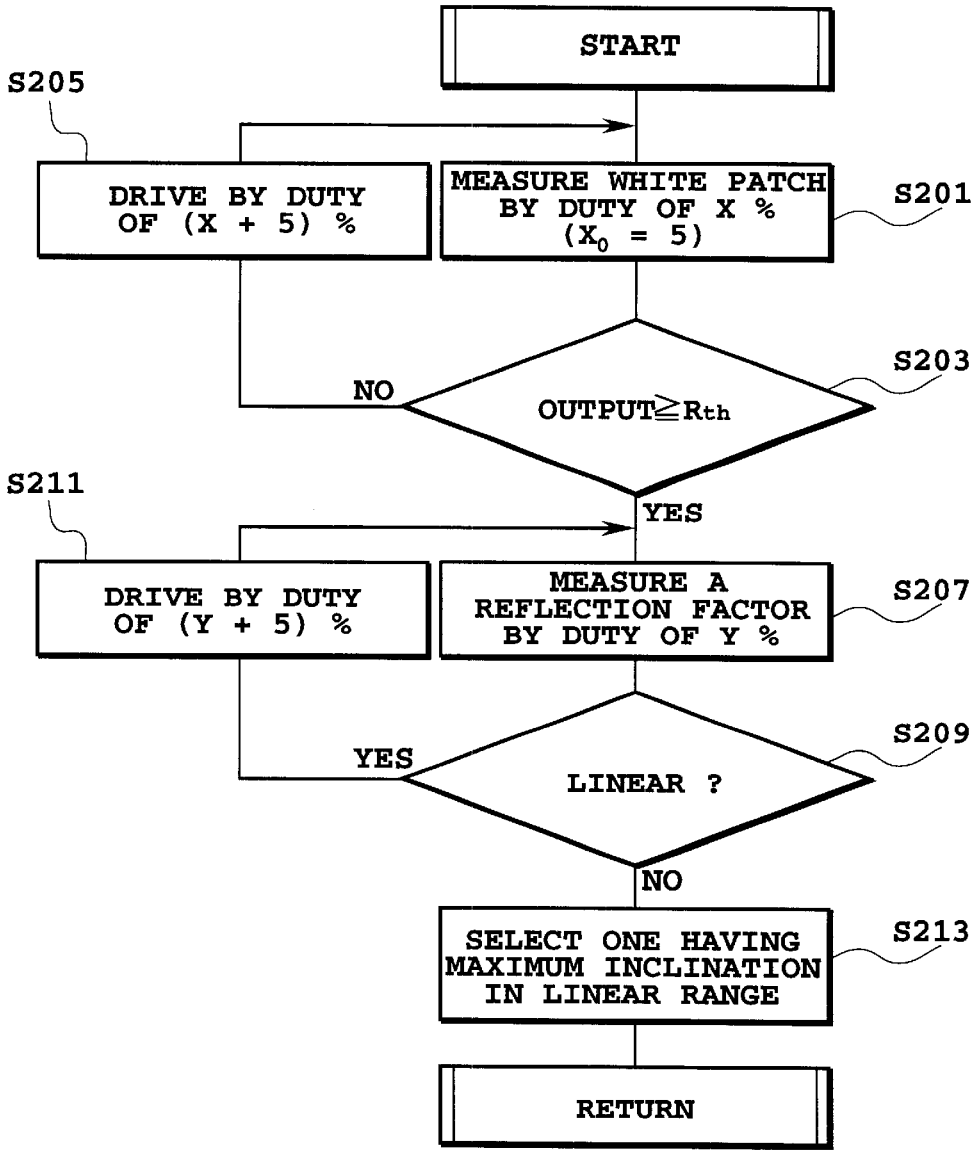
FIG. 36 is a diagram for illustrating a further example of a sensor calibration processing capable of using in the algorithm shown in FIG. 30.

FIG. 36 is an example of a processing algorithm of this example, and as shown in the third example, the predetermined pattern for the sensor calibration (for example, a white patch of a deposition rate 0%) is measured, changing a duty applied to the light-emitting side (steps S201, S205) and the duty is compared with the threshold value set previously (step S203), and one of output characteristics which is linear is selected as shown in the first example from the duty exceeding the threshold value (steps S207, S209, S211). The output characteristics is selected, changing a duty at intervals of 5% in an adjustment procedure using the threshold value, for example, and thereafter a linear area having the greatest inclination is obtained by changing a duty at intervals of 1%. Thereby, a coarse adjustment and a fine adjustment are performed in the sensor calibration and the optimal sensor drive duty is decided accurately and speedily and it becomes possible to be shifted to the subsequent printing registration.

Moreover, the processing procedure of FIG. 36 is used as it is substantially when the fourth example is used, and it is occasionally added modifications, etc. when the first to third examples are used, and it can be positioned as step S103 of FIG. 30.

Further, error processing means is provided in the printing apparatus, taking into consideration the case where even the optimal or suitable duty cannot be decided, despite that any one of the above calibrations is carried out. In this case, as mentioned above, it is possible to again repeat the same processing (an automatic registration adjustment), or to notify a user of a message urging the other means (a manual registration adjustment) from the body of the printing apparatus, the host device or the like.

(4.3) Coarse Adjustment of Printing Registration for Bi-directional Printing

Next, a coarse adjustment of a printing registration for a bi-directional printing (step S105 of FIG. 30) will be explained. In this embodiment, a tolerance precision of a relative depositing position of printing dots when performing bi-directional printing by the printing apparatus and the print head shall be within ±4 dots. Accordingly, a pattern having a width of 4 dots is used in the coarse adjustment.

Figure 37A:
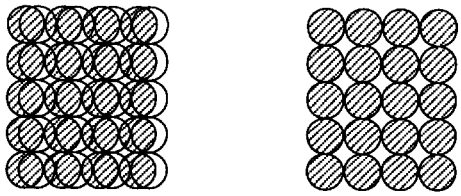
FIGS. 37A to 37E are schematic views for describing an example of a coarse adjustment processing of printing registration for bi-directional printing capable of using in the algorithm shown in FIG. 30.
Figure 37B:
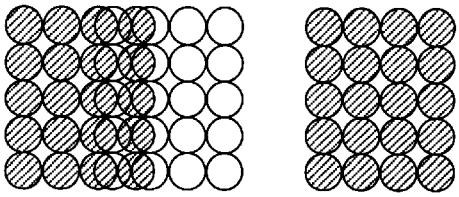
Figure 37C:
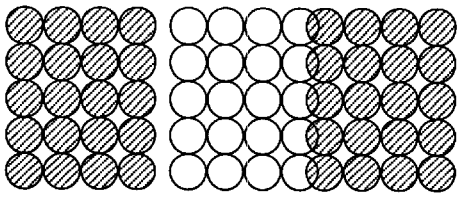
Figure 37D:
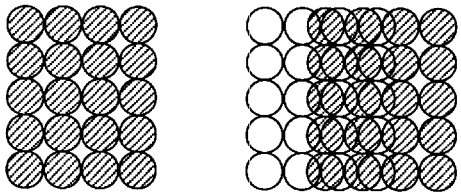
Figure 37E:
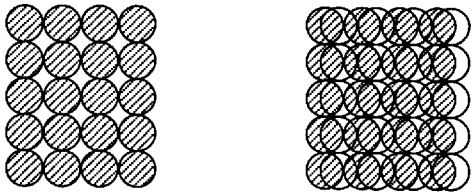

FIGS. 37A to 37C show an example of a pattern of a patch for use in the coarse adjustment. A reference dot is formed by a printing in a forward scan, and offset dots in which printing is performed, changing registration conditions, are formed by a reverse scan. In the case where printing is performed in a non-adjustment, an offsetting or shifting amount is defined as 0 dot. The offsets caused when printing is performed in this state (FIG. 37C) are caused by depositing position precision of the printing apparatus and the print head, and are generated due to variations, etc. upon the respective manufacturing. This example can adjust this offset automatically.

FIGS. 37A to 37E show that printing of each pattern is performed within a range of an offsetting amount: ±4 dots, and it is enough that the offsetting amount in these patterns is 4 dots at a maximum.

Figure 38:
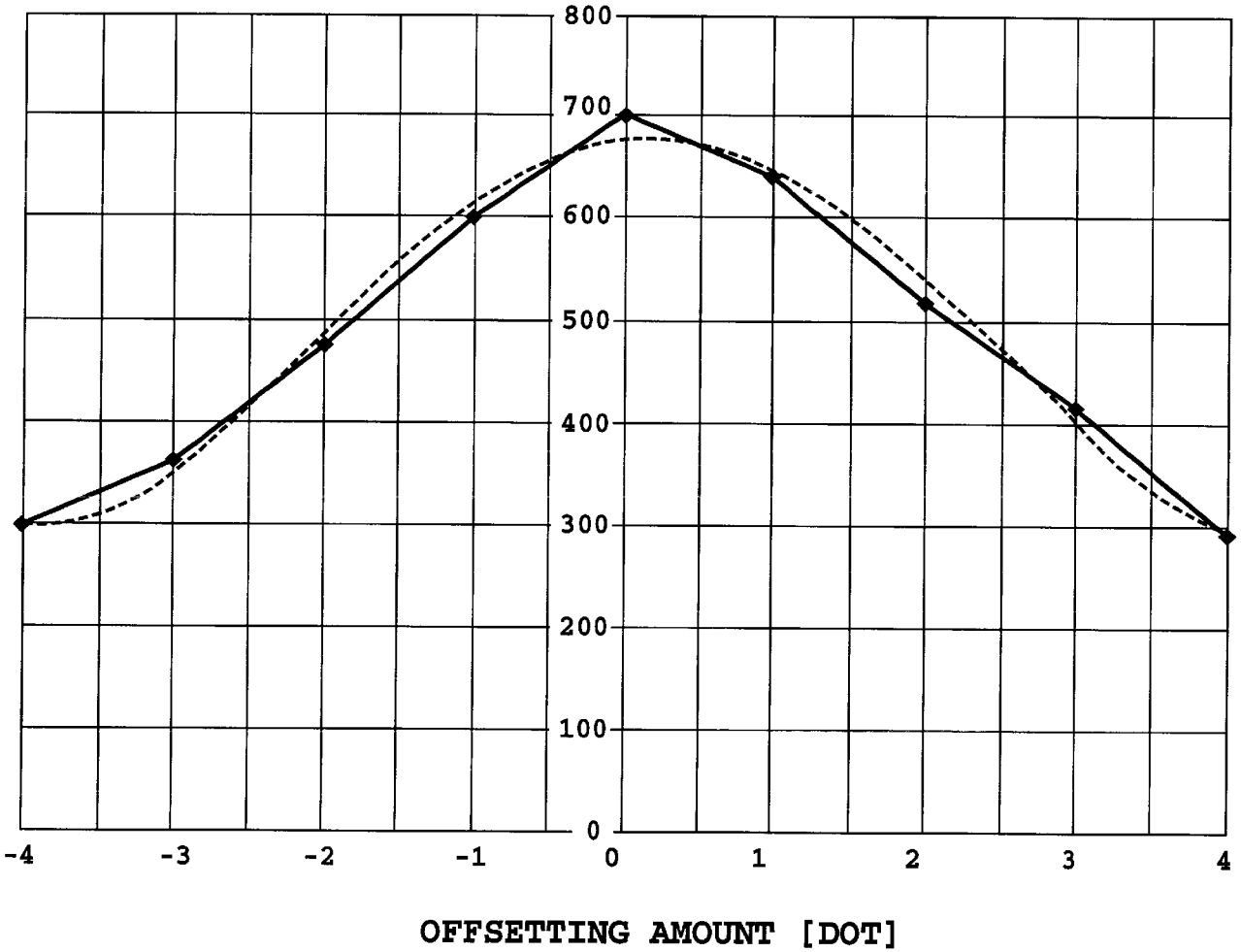
FIG. 38 is a diagram for describing a manner obtaining adjustment values by the coarse adjustment shown in FIGS. 37A to 37E.
Figure 39A:
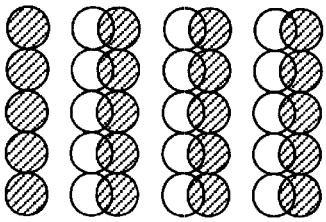
FIGS. 39A to 39E are schematic views for describing an example of a fine adjustment processing of printing registration for bi-directional printing capable of using in the algorithm shown in FIG. 30.
Figure 39B:
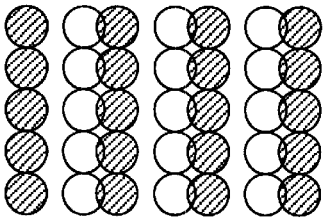
Figure 39C:
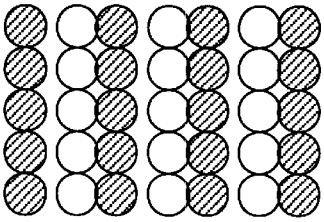
Figure 39D:
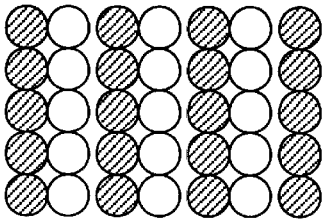
Figure 39E:
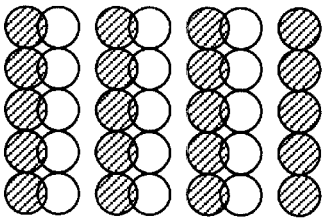

A solid line in FIG. 38 shows characteristics of an output (a value after reflected light is received and is converted by an A/D converter) of an optical sensor with respect to the offsetting amount in this case. Moreover, characteristics approximating the output characteristics for the offsetting amount by the polynomial are shown by a broken line. From these approximated characteristics, the point which reflection density is the maximum can be defined as an adjustment value of offset, in other words an adjustment value when bi-directional printing is performed.

Moreover, the adjustment value in this case can be set more finely than an interval of the offset amount. Moreover, the offsetting amount showing a maximum of reflection density may be an adjustment value of the bi-directional printing without making approximation at this time. An interval of the offsetting amount of a pattern may be set as a 2-dot interval and naturally as a 1-dot interval. Moreover, it may be an unequal interval and offsetting with precision of a 1-dot interval or less, and the adjustment can be made if within a scope of tolerance precision of a depositing position and at an interval in which approximate characteristics can be obtained.

(4.4) Fine Adjustment of Printing Registration for Bi-directional Printing

Next, a fine adjustment of a printing registration in a bi-directional printing (step S17 of FIG. 30) is explained. When a fine adjustment is executed with finer adjustment precision, it is a premise that an adjustment is performed within a one-dot interval similarly to the coarse adjustment, and the fine adjustment is performed within ±0. 5 dot. As the fine adjustment is performed with high precision, a pattern with a minimum width is used.

FIGS. 39A to 39E show an example of a pattern used for a fine adjustment. Similarly to a coarse adjustment, a reference dot is printed by the forward scan printing and an offsetting dot in which printing is performed, changing registration conditions, is printed by a backward scan printing. In the case where printing is performed with a non-adjustment (FIG. 39C), an offset amount is 0 dot. In this example, registration conditions are set at an interval of 0.25 dot. Here, similarly to the coarse adjustment, characteristics approximating output characteristics of an optical sensor with respect to the offsetting amount by the polynomial are acquired, and a point maximizing reflection density from these approximation characteristics can be set as an adjustment value of an offset, in other words, an adjustment value when bi-directional printing is performed.

Moreover, the adjustment value in this example can set more finely than an interval of an offset amount, namely 0.25 dot. Moreover, if the demanded adjustment precision is equal to an interval of an offsetting amount, the offsetting amount showing a maximum of reflection density may be set as an adjustment value of a bi-directional printing without performing approximation.

However, in this example, the following system is used in order to further improve adjustment precision:

This system will be described using FIGS. 40 to 43.

Figures 40A, 40B, 40C:
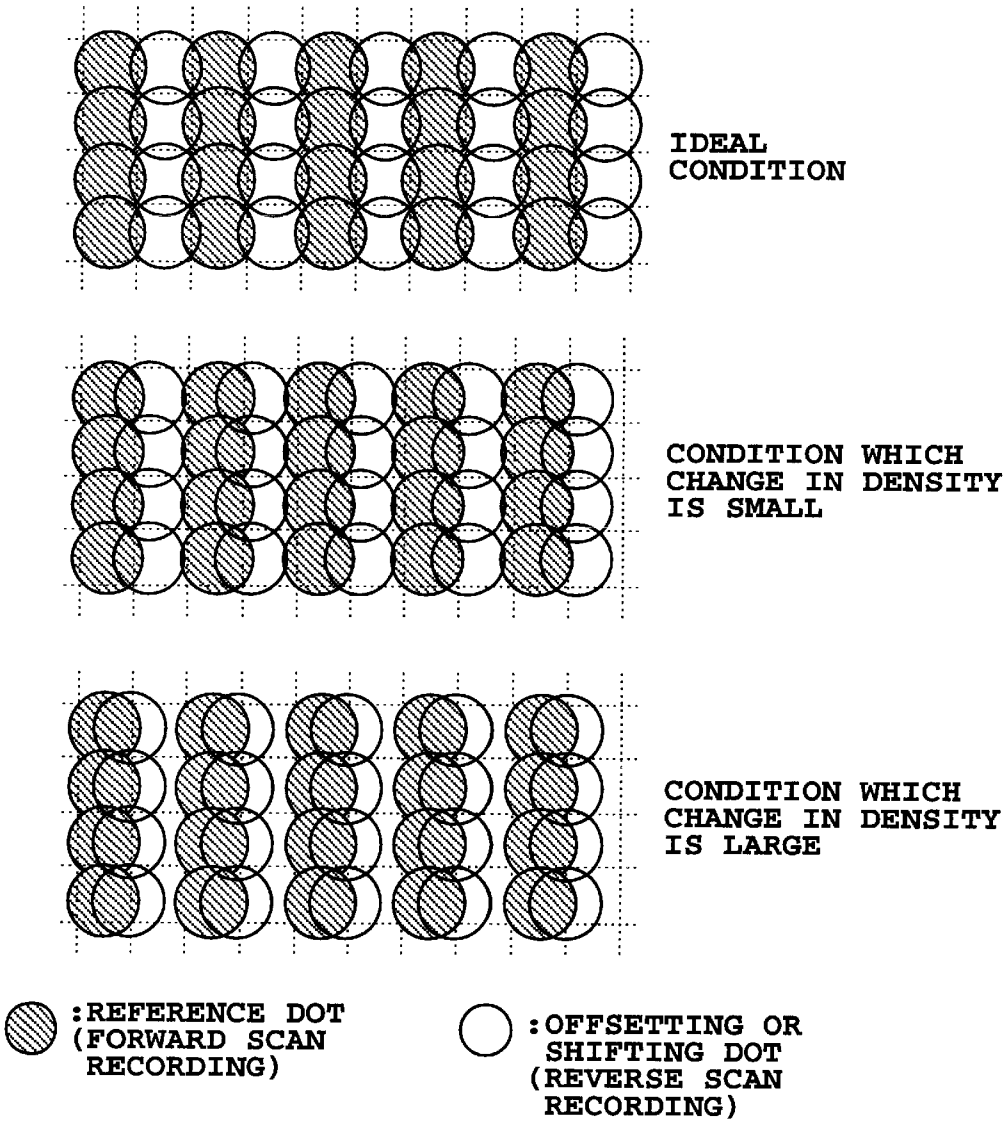
FIGS. 40A to 40C are schematic views as a prerequisite for describing another example of the fine adjustment processing of printing registration for bi-directional printing capable of using in the algorithm shown in FIG. 30.

First, in the forward scan and the reverse scan, when dot alignment is performed in the case, as shown in FIG. 40A, which print dots are formed on alternate one dot complementarily with respect to horizontal or main scanning, even if a patch is formed by offsetting a dot formation position in the forward scan printing, there is a case where density change is scant and a preferable density output cannot be obtained as shown in FIG. 40B. On the contrary, there is a case where density change is large compared with an ideal state and a sufficient density output can be obtained as shown in FIG. 40C.

Here, in the case of considering only two dots of the reference dot adjoining each other and an offset dot, when being under the condition which the two dots are contacted each other, the area of the range which is covered with the dots is greatest and even if the dots are separated more than that, the total of the area covered with the dots is not changed. In other words, there is no change in density. On the contrary, when the dots are shifted closer to each other from the contacting condition, the area of the region covered with the dots is reduced in accordance with the change of the depositing position. In other words, density is changed in accordance with the depositing position.

From the relation of the pixel density and a dot diameter, in order to make the area factor to 100%, when the dot is defined as a diameter of size of $\sqrt{2}$ times of one pixel, and under the condition that the formation position is registered the overlapped parts exist inescapably in the dots which are adjoined are each other, there is on overlapped part between adjoining two dots, necessarily. Therefore, the condition that the deposition position are registered can be the region where the density is changed greatly in the deposition position of the dot.

From the above, preferable characteristics of density output can be obtained with respect to depositing position of offsetting dot where each dot is formed at a pitch of two dots or more in the main scanning direction, rather than where each dot is formed at a pitch of one dot shown in FIG. 40A. This will be described later reference to FIGS. 42A to 42D.

Figure 41:
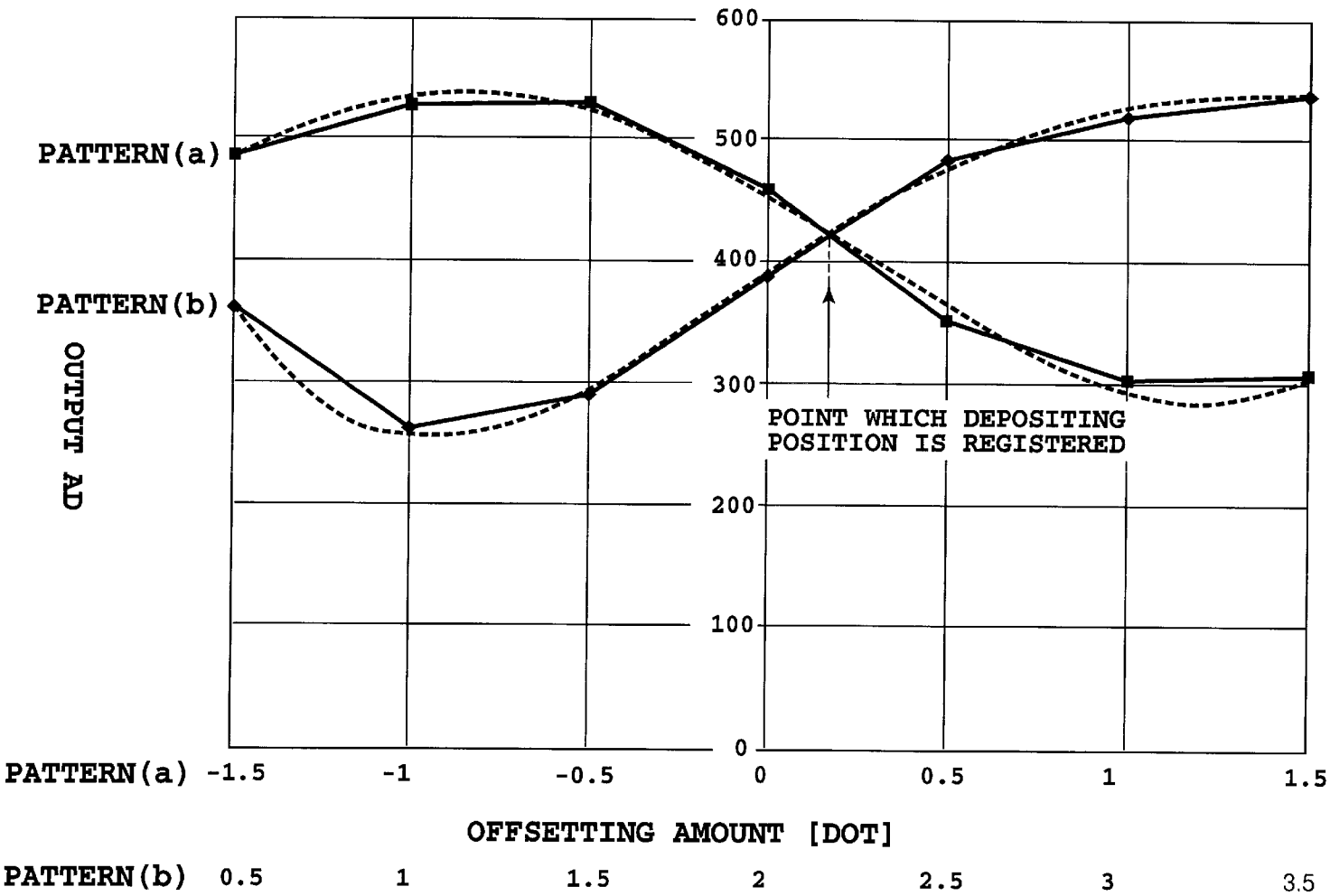
FIG. 41 is a diagram for describing a characteristics of a printing patterns according to the other example of the fine adjustment processing of printing registration for bi-directional printing capable of using in the algorithm shown in FIG. 30.

As shown in FIG. 41, a change in density (a broken line is one obtained by an approximation by the polynomial) of a patch group (a pattern (a)) formed, changing registration conditions of a depositing position of dots in the reverse scan (a dot offsetting amount) with respect to a reference dot formed by the forward scan and a change in density (a broken line is one obtained by an approximation by the polynomial) of the patch group (a pattern (b)) obtained by forming dots in the reverse scan at a position which is line-symmetrical every registration condition with respect to a reference dot become a similar property and the characteristics of the change in density have been reversed by directiveness of the adjusting direction simply. Using this characteristics, the intersection of the characteristics of two kind changes in density can be determined as the adjusting position where the depositing position of the dot have just registered.

Since the offset of the delicate formation position appears sensitively on the change in density, this adjustment method is adapted to the strict adjustment of the depositing position, and a dot alignment (a printing registration) with high accuracy can be realized.

Moreover, in this method, a characteristic curve in response to directiveness of the adjusting direction may be set as an approximate curve acquired from measured values and the approximate curve may be acquired from a plurality of points in the vicinity of an intersecting points.

As is described above, the adjusting position is acquired from an intersecting point of the characteristic curve by using a curve approximation or a linear approximation, but if an adjusting interval is an interval of required precision, the approximation expression of the characteristic curve is not required to acquire. For example, a point where a difference of output OD values (density) of two characteristics is smallest may be defined as an adjusting position and this system is not in particular limited to a configuration using the approximation expression.

When obtaining the pattern (a), as shown in FIGS. 42A to 42D, each patch (FIGS. 42A, 42B, 42D) offsetting the depositing position in the print in the reverse scan at an interval of 0.5 dot in a positive and negative direction (a leftward direction in the drawings is positive) with respect to a patch in which an offsetting or shifting amount is 0 dot (FIG. 42C) may be formed. On the other hand, when obtaining the pattern (b) (an inverse pattern) formed at a position where the dot in the reverse scan is line-symmetrical to the pattern (a) with respect to the reference dot, as shown in FIGS. 43A to 43D, with respect to a patch (FIG. 43C) formed under the condition that the dots in the reverse scan are, first, shifted to a leftward direction of the drawings by two-dot with respect to the case where the offsetting amount is 0 in the pattern (a), each patch (FIGS. 42A, 42B) reducing the offsetting amount by the printing in the reverse or backward scan at an interval of 0.5 dot in a positive direction may be formed, and a patch (FIG. 42D) increasing the offsetting amount by the printing in the backward scan at an interval of 0.5 dot in a negative direction may be formed.

Moreover, in this example, although a dot alignment processing acquiring an intersecting point of characteristics of two patterns for the fine adjustment is performed and the dot alignment processing for the coarse adjustment can also be performed, as a matter of course.

(4.5) Printing of Confirmation Pattern

Finally, a confirmation pattern is printed in order that a user can confirm a success in the dot alignment. A ruler mark pattern, etc. easy to be recognized by the user is used for the confirmation pattern, and bi-directional printing is performed by using an adjusting value acquired by the coarse adjustment and fine adjustment. In other words, printing patterns of two types of an adjustment pattern measuring density for adjusting and a confirmation pattern for confirming an adjustment are formed on a printing medium (three types if a type at a time of a sensor calibration is added).

Moreover, a specified example of a pattern formed on a printing medium will be explained in a dot alignment processing corresponding to a mode.

(4.6) Effects of this Embodiment, etc.

In the first embodiment of an algorithm of the dot alignment processing, by providing an adjusting system at two stages of the coarse adjustment and the fine adjustment in the printing registration of the bi-directional printing, the algorithm from a maximum of tolerance precision of a relative depositing position of print dots in the body of the printing apparatus and the bi-directional printing of the print head to an adjustment with high precision can be executed through a series of automatic dot alignment sequence.

Moreover, it is possible to reduce a scope of a fine adjustment, namely to adjust speedily by making previously a coarse adjustment. This is effective for improvement in a throughput of the entire sequence. Moreover, in the case where only a manual adjustment is performed by a user, the user is induced midway to decide and an adjustment mistake by error decision may occur, but this can be suppressed by this embodiment.

As explained above, in this embodiment, in a printing method printing respectively by a forward scan and a reverse scan by using the same print head to form images, by acquiring an optimal adjustment value using this dot alignment processing, it becomes possible to perform printing by setting a depositing position in a forward scan and a depositing position in a reverse scan of the print dots under optimal position conditions, thereby to realize the printing method capable of performing bi-directional printing without an offset of the depositing positions.

Moreover, in this example, the coarse adjustment is first performed and then the fine adjustment is performed, and this order can be reversed. The reason will be described later.

Moreover, in the embodiment, fluctuations of an area changing caused by precision in the depositing position of the dots printed are detected as reflection density. Accordingly, it is firmly desirable that the pattern formed for the sensor calibration and the printing registration is performed printing in a color that the print dots have sufficient absorbing characteristics with respect to an incident light. In the case where a red LED is used, Black or Cyan is preferable from the viewpoint of the absorbing characteristics, and sufficient density characteristics and S/N ratios can be obtained. Then, in this example, black dots most superior in the absorbing characteristics were used.

Figure 44:
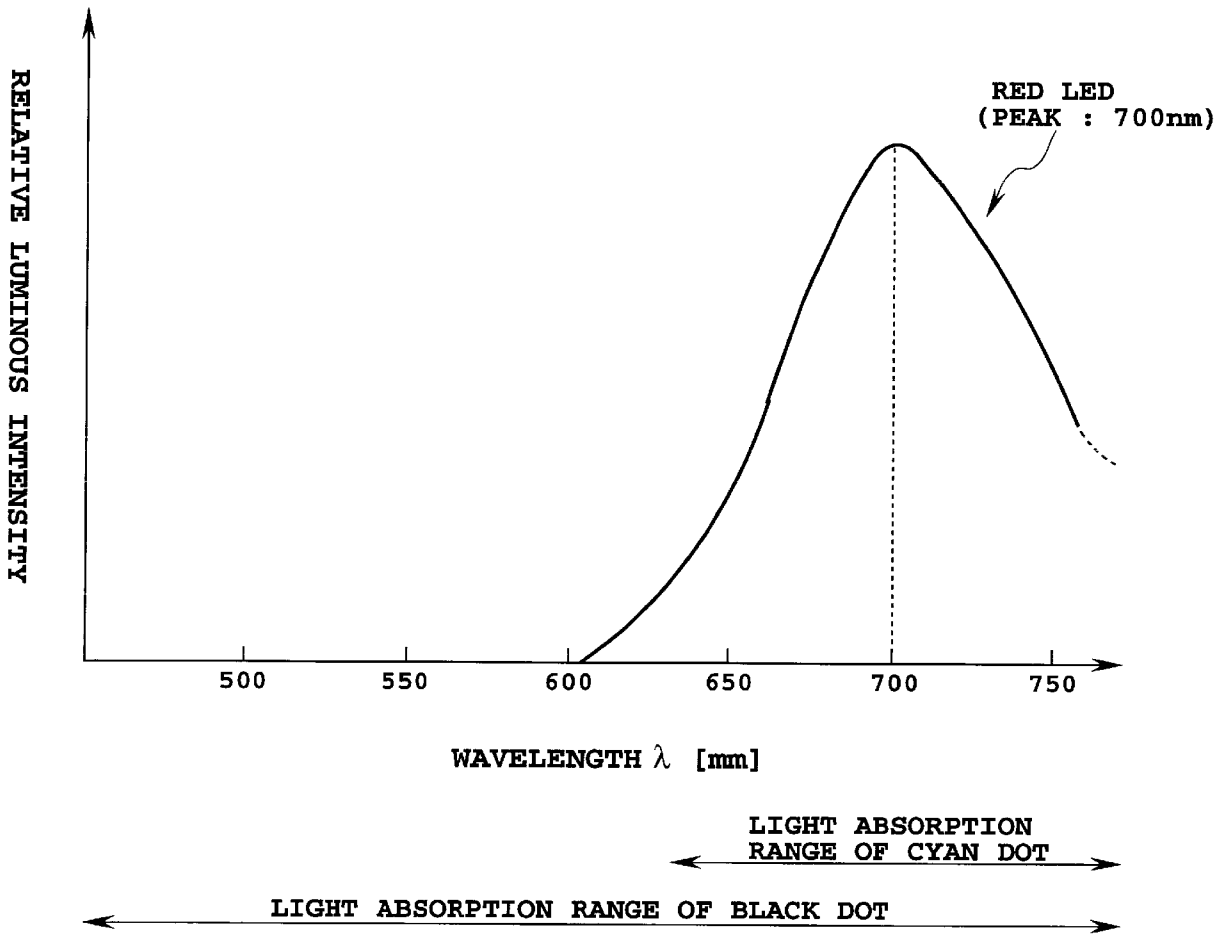
FIG. 44 is a diagram for describing selection of an ink forming the printing patterns being used in a printing registration processing.

This is because Black enables to absorb lights for all the areas in spectrum characteristics of red lights as shown in FIG. 44. Cyan corresponds to a complementary color of red and has high absorption characteristics, but a red light itself is not an ideal light and has an extent in the spectrum characteristics. Therefore, a spectrum component which cannot be completely absorbed by Cyan dots exists. Accordingly, the absorption characteristics are slightly lower than Black which can absorb in all the areas.

However, it is possible to cope with each color by deciding a color used for dot alignment in response to characteristics of LED used. On the contrary, it is possible to also select LED in response to a color forming the pattern. For example, it is possible to make dot alignment in each of colors (C, M, Y) with respect to Black by mounting a blue LED, a green LED, etc. in addition to a red LED. Moreover, in the case where each color ejection portion (head) is separately constituted and used by being arranged in parallel, it is preferable that every color is performed printing registration. Therefore, a sensor corresponding thereto is prepared and each calibration may be performed as required.

5. Second Example of Algorithm of Dot Alignment Processing

In this example, the case where a dot alignment processing between a plurality of heads is also performed will be explained. That is, in this example, in addition to the dot alignment of the bi-directional printing, vertical and lateral dot alignments between two heads are executed.

Figure 45:
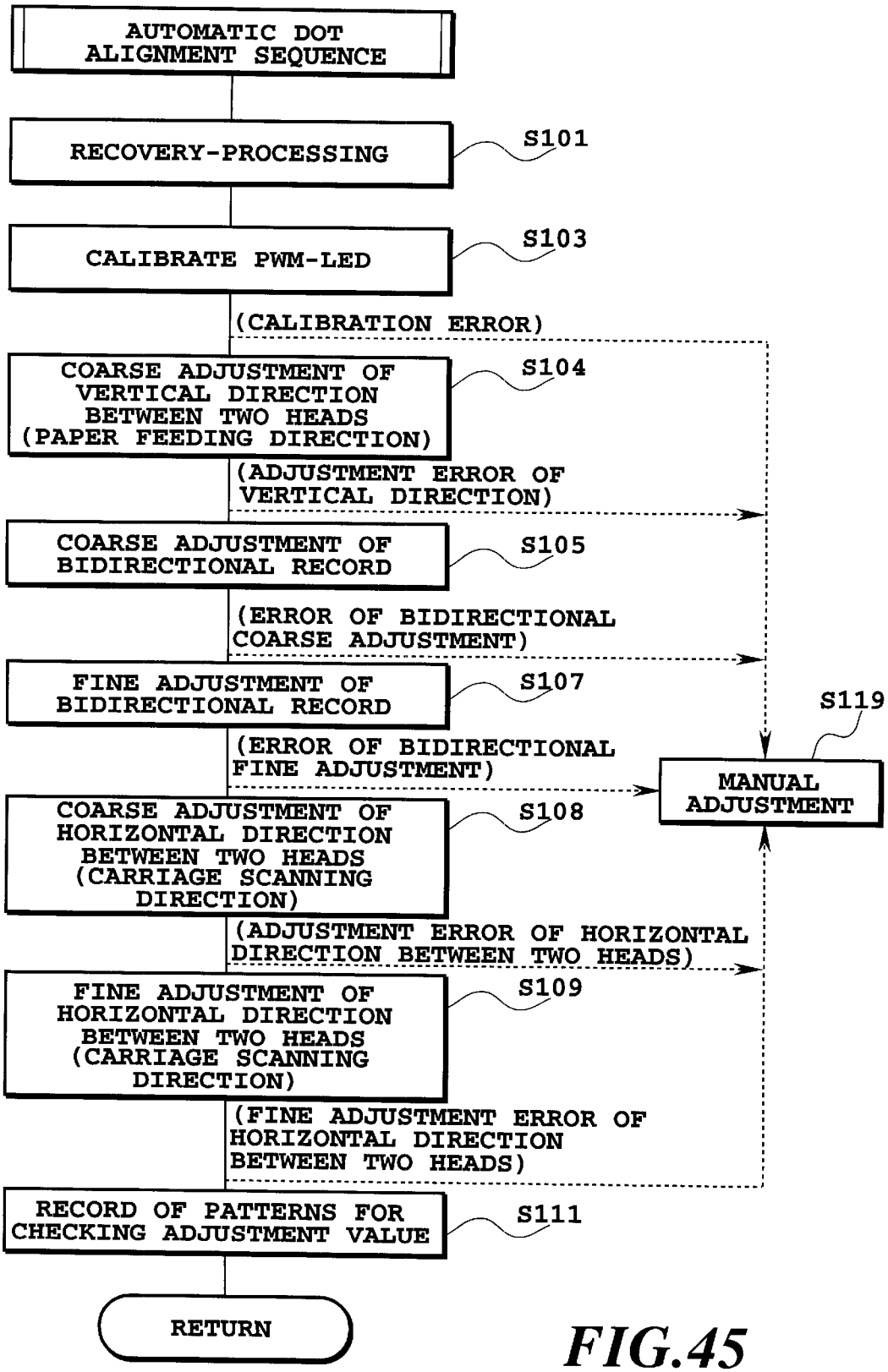
FIG. 45 is a flowchart showing another example of an entire algorithm of an automatic dot alignment processing capable of using in the invention.

FIG. 45 shows an outline of an automatic dot alignment processing algorithm in this example, and this example generally comprises a recovery processing step (step S101); a sensor calibration processing step (step S103); a vertical adjustment step between two heads (step S104); a coarse and fine adjustment step of a bi-directional record (steps S105, S107); a coarse and fine adjustment step in a horizontal scan direction between two heads (steps S108, S109); and an adjustment value confirmation pattern printing processing step (steps S111).

Moreover, means for activating this algorithm is an input from an activation switch provided in the body of the printing apparatus or applications on a side of the host computer 110, and additionally at a time of apparatus turn-on, a timer activation, etc. as required. Moreover, these may be combined.

The recovery processing (step S101) is same as the above example. Moreover, for example, in the case where calibration errors such as procuring of data except a usable range is caused in a sensor calibration processing, or in the case where a strength of reflection lights are extremely increased by influences of disturbance lights, etc. in a processing of a dot alignment processing, and as the results, a coarse adjustment error or a fine adjustment error occurs, a manual adjustment is executed (step S119), etc. These cases are same as the above example.

The sensor calibration processing (step S103) is substantially same as the above example. In this example, since printing registration between a plurality of heads of different colors is carried out, it is possible to differ a formation color of patterns used in the processing from the above example taking this into consideration the printing registration.

After the sensor calibration is executed, a vertical coarse adjustment between two heads is performed as an initial adjustment in this example (step S104).

In the printing apparatus according to this embodiment, in order to correct a printing position in a direction perpendicular to a carriage scan direction (a vertical scan direction), ink ejection openings of each print head (an ejection portion) are provided ranging over a wider range than a maximum width (a band width) in the vertical scan direction of images formed in one time scan, and a range of the ejection openings used for printing are changed, whereby the printing apparatus is constituted so as to correct the printing positions in unit of intervals of the ejection opening. That is, a correspondence of output data (image data, etc.) to an ink ejection openings are shifted, and as this result, the output data itself can be offset.

That is, the vertical adjustment is performed at a position of image data and vertical printing positioning precision depends upon a resolution of the print head and a control resolution in a direction of feeding a printing medium. Therefore, only a coarse adjustment is performed. However, a fine adjustment can be performed in the same manner as the other as required.

The apparatus according to this embodiment uses a head arranging in parallel a Black ink ejection portion arraying a nozzle group for ejecting ink of black as shown in FIG. 6A and each color ink ejection portion arraying a nozzle group for ejecting each ink of Y, M and C integrally and in an inline manner in response to a range of arraying the ejection openings of Black. Accordingly, in particular, if the printing registration between Black and, for example, C is performed when the vertical dot alignment processing between a plurality of heads (ejecting portions) is performed, nozzle groups of M and Y inks which are manufactured integrally and in an inline manner in the same processing as an ejection opening group of a C ink is substantially performed printing registration with respect to the Black ejection portion, and namely, the dot alignment processing between the plurality of heads (ejecting portions) is completed. Accordingly, in particular, a red LED is adopted as a light emitting section when the dot alignment processing between the plurality of heads (ejecting portions) is carried out, while it is enough if Black and C inks having sufficient absorption characteristics for a red light are used to form a measuring patch so that the printing registration is carried out.

However, it is possible to correspond to each color by deciding a color used for the dot alignment in response to characteristics of LED used. Conversely, the LED can be selected in response to a color forming a pattern. For example, a blue LED, a green LED, etc. in addition to a red LED may be mounted, whereby the dot alignment can be carried out for Black in each of color ejecting portions (heads). Moreover, in the case where each color ejecting portion (head) is separately constituted and arranged in parallel with each other in the main scanning direction in the printing apparatus, it is preferable that the printing registration is performed in every color. Therefore, a sensor corresponding thereto is prepared and a calibration is carried out as required. The method is also same in a lateral adjustment described below.

Next, similarly to the above example, a coarse adjustment of the bi-directional printing is performed (step S105), and further a fine adjustment of the bi-directional printing is performed and the adjustment is executed with maximum precision (step S107). In the case of the bi-directional printing, an adjustment of relative depositing position precision of a forward scan printing and a reverse scan printing is performed by adjusting a drive timing in each scan. Here, the corresponding adjustment may be only performed in only Black, or may be performed in another color. A processing corresponding to a color relating to a bi-directional printing has only to be performed.

Next, a coarse adjustment in a lateral direction (the horizontal scan direction) between two heads is performed (step S108). Moreover, a lateral fine adjustment is performed (step S109). The lateral adjustment is performed by adjusting a drive timing between respective head. These coarse and fine adjustments are also processed similarly to the description using FIGS. 37 to 43 in the above example in the two heads.

The apparatus according to this embodiment uses a head arranging in parallel a Black ink ejection section arraying a nozzle ejecting an ink of Black as shown in FIG. 6A and each color ink ejecting portion arraying a nozzle group for ejecting an ink of Y, M and C integrally and in an inline manner in response to a scope of arraying the ejecting openings of Black. Accordingly, in particular, if the printing registration between Black and, for example, C is performed when the lateral dot alignment processing between a plurality of heads (ejecting portions) is performed, a nozzle group of M and Y inks which is manufactured in an inline manner in the same processing as an ejection opening group of a C ink is substantially performed printing registration with respect to a Black ejection section, and namely, the lateral dot alignment processing between the plurality of heads (electing portions) is completed. Accordingly, in particular, ared LED is adopted as the light emitting section when the dot alignment processing between the plurality of heads (ejecting portions) is carried out, while it is enough if Black and C inks are used to form a measuring patch so that the lateral printing registration is carried out.

Finally, similarly to the above example, a confirmation pattern is performed printing and this automatic dot alignment sequence is terminated (step S111).

Moreover, in this example, in the lateral dot alignment, not only an adjustment in the forward scan printing between the respective heads is performed, but also an adjustment in the reverse scan printing is performed. This is because that in the case where the dot alignment of the bi-directional printing is adjusted by the single head, even if the adjustment value is used by the other print heads, a depositing position offset occasionally occurs. When an ejection direction of an ink is different in each print head or an ejection speed is different, a state of the bi-directional printing is different in each print head. This is the reason. In such the phenomenon, in the case where only one of adjustment values of the bi-directional printing can be set, the dot alignment is executed by a single print head which the bi-directional printing references. Next, by use of the print head which the bi-directional printing references as a reference even in a lateral direction, the lateral dot alignment is carried out in each of the scan prints. Thereby, it is possible to suppress a generation of offsets of the bi-directional or lateral depositing position caused by the characteristics of the print head.

Moreover, in the case where a plurality of adjustment values of the bi-directional printing can be set, the dot alignment of the bi-directional printing is carried out in each of the print heads, and the lateral dot alignment is carried out only in a single direction, thereby to adjust the depositing position even when the characteristics of each print head are different.

Moreover, at a time of a dot alignment processing or at a time of actual printing operations using the results, the following can be applied for offsetting the depositing position:

In the bi-directional printing, the ejection start position is controlled using an interval equal to a generation interval of a trigger signal of a carriage motor 6, for example. In this case, an interval of 80 nsec (nanosesonds) can be set by a software for the gate array 140, for example. However, only a required resolution is enough and about 2880 dpi (8.8 mm) is sufficient precision.

Concerning a lateral direction of a printing using a plurality of heads, the image data are controlled at an interval of 720 dpi. The offset within one pixel is controlled by changing 720 dpi driving block selecting order between the plurality of heads in a form in which a nozzle group is divided into several blocks and driven in time-sharing, and further the offset of one pixel or more is controlled by offsetting the image data to be printed between the plurality of heads.

Concerning a vertical direction of a printing using the plurality of heads, the image data are controlled at an interval of 360 dpi and the image data to be printed are controlled by offsetting between the plurality of heads.

6. Dot Alignment Processing in Response to Mode, etc.

Next, the case where automatic dot alignment control is modified (a modification in response to a size of a print dot, for example) in response to a mode, etc. included in the printing apparatus (for example, a mode of performing a high resolution printing, etc. by modifying a size of the print dot) will be explained.

In the case of an ink-jet printing apparatus, a size of printing dots is mainly decided by an ink amount ejected from the print head.

Figure 46:
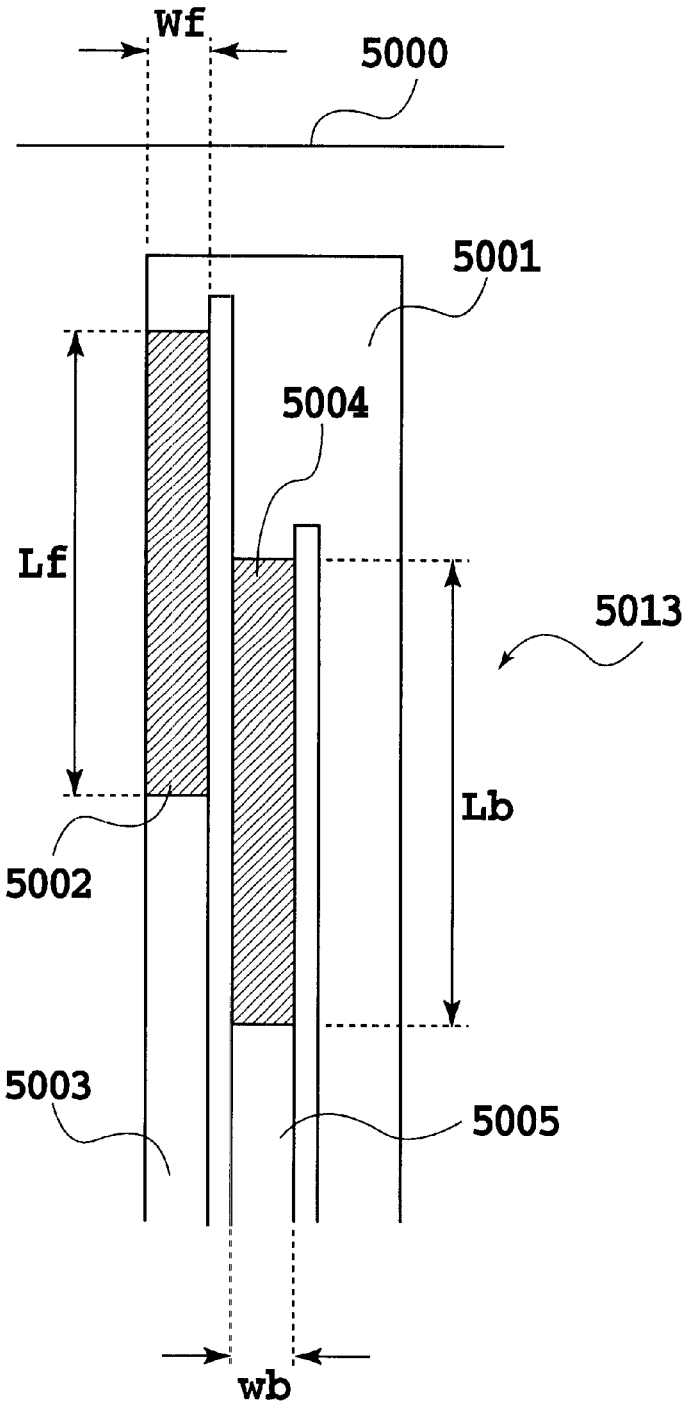
FIG. 46 is a schematic view showing a constitution example of a print head capable of using for obtaining a different ejection amount.

FIG. 46 is an enlarged view showing a constitutional example of an ejection heater portion capable of changing an ejection ink amount. Here, reference numeral 5000 denotes an edge of the heater board HB described in FIG. 7, and this side face is an ink ejecting opening side with respect to an ejecting heater. In the shown example, an ejecting heater portion 5013 has two ejecting heaters 5002, 5004. Herein, a size of the ejecting heater 5002 on a front side in an ejection opening direction is Lf=131 mm in length and Wf=22 mm in width, and a size of the ejecting heater 5003 on a rear side is Lb=131 mm in length and Wb=20 mm in width. Reference numeral 5001 denotes a common wire which is connected to a ground line. Reference numerals 5003, 5005 are separate wires for driving selectively the heaters 5002, 5004 which are connected to a heater driver for turning on/off a heater.

The two ejecting heaters 5002, 5004 are provided in a single ejection opening, whereby in the case where a fine printing is required, any ejecting heater is driven and a bubble is generated in only a corresponding portion. Thereby, printing is performed with ink dots having a relatively small ejection amount to realize a high resolution. On the other hand, in the case where so-called solid printing is performed, both the heaters are driven and a relatively large bubble covering above them is generated, whereby printing is performed with ink dots having a relatively large ejection amount and printing efficiency can be improved.

In such case where the ejecting ink amount is different, an adjustment value of the dot alignment is different in some cases from a viewpoint of the horizontal scan speed, an ejection speed and an ejection angle. Accordingly, in the case where the above-described dot alignment is carried out only for a single ejection amount, the depositing position is different in some cases even if the adjustment value is used for the other ejection amount.

On the contrary, a dot alignment may be carried out in each size of printing dots. That is, an optimal adjustment value is set on respective printing dots, so that it becomes possible to perform printing at a correct depositing position of the printing dots in the respective printing.

Moreover, a carriage speed (a horizontal scan speed), an ejection speed, an ejection angle and the like are factors of changing the depositing position of the printing dots.

Figure 47:
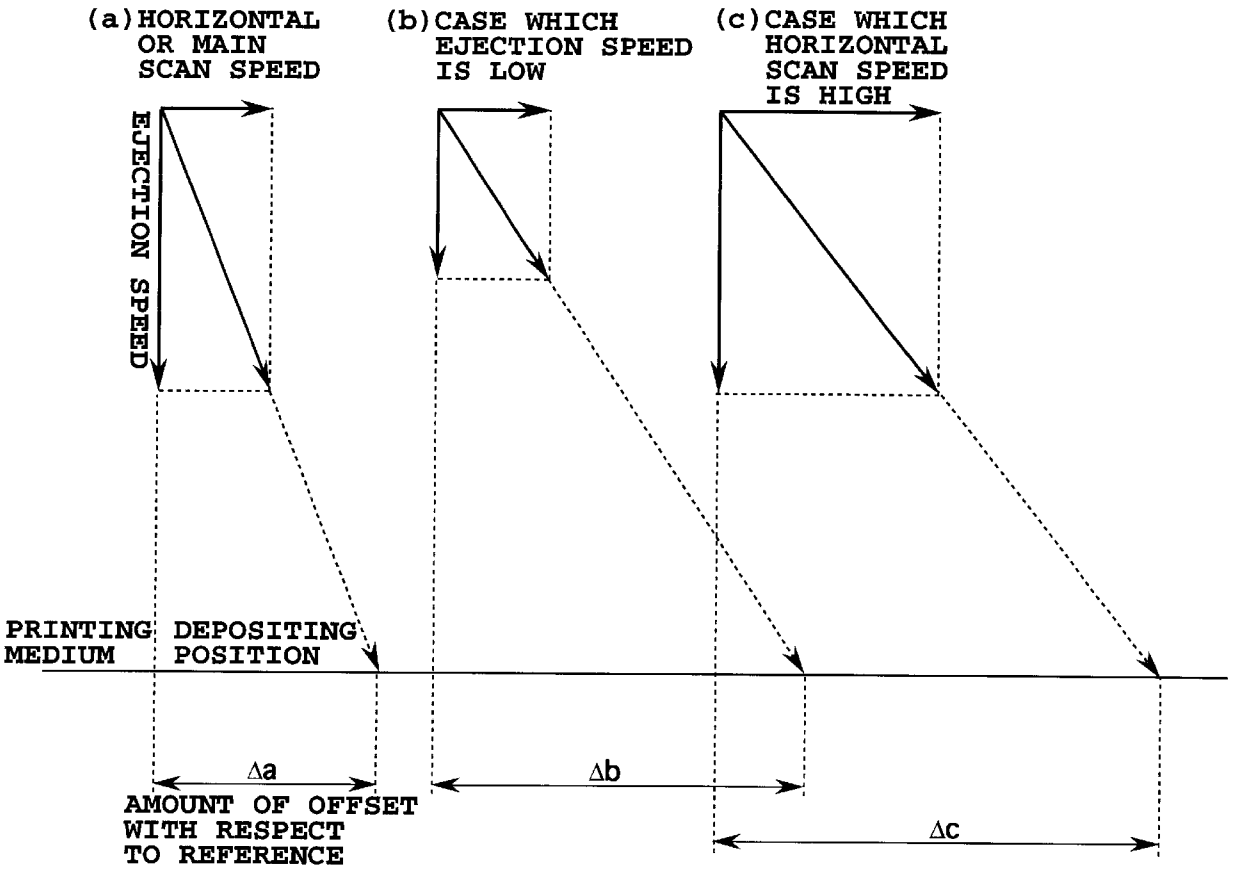
FIG. 47 is a schematic view describing a offset in an ink depositing position responsive to a horizontal scanning speed and an ink ejecting speed.

For example, with respect to an offset amount Δa of the depositing position in the case (a) of FIG. 47, an offset amount Δb of the depositing position in the case (b) where an ejection speed is small is increased, and an offset amount Δc of the depositing position in the case (c) where a main scan speed is large is also increased. Accordingly, the dot alignment may be executed in each of the horizontal scan speed, the ejection speed and the ejection angle, and such way is actually effective.

FIG. 48 is an illustration for explaining a dot alignment processings in response to modes included in the printer or a configuration of a head.

Here, "printer 1" is a printer having a configuration as shown in FIG. 5, and indicates that "head 1" or "head 2" can be used. The "head 1" and "head 2" are heads of a form shown in FIG. 6A. The "head 1" has the shown configuration, and at a time of the dot alignment processing, a registration processing (in vertical and lateral directions between the two heads) in Black dots and C dots in response to each mode or a registration processing (in a bi-directional-horizontal scan direction) of Black dots are performed. The "head 2" has ejecting section in which nozzle groups of Black, LC (thin or light cyan) and LM (thin or light magenta) is arrayed in an inline manner, while has ejecting section in which nozzle groups, etc. of C and M are respectively arrayed in an inline manner in a form of arranging in parallel in response to the nozzle group of LC and LM, and at a time of the dot alignment processing, a registration processing (in vertical and lateral directions between the two heads) in LC dots and C dots in response to each mode or a registration processing (in a bi-directional-horizontal scan direction) of Black dots are performed.

The "printer 2" is a printer which performs monochrome printing, and "head 3" or "head 4" arraying nozzle groups ejecting a Black ink can be used.

Moreover, each head has an ejection heater section as shown in FIG. 46 and can obtain a large or small ejection amount corresponding to a resolution. A main scan speed of each resolution can be decided as follows: For example, 30 inch/sec in the case of 180×180 dpi, 20 inches/sec in the case of 360×360 dpi, 20 inches/sec in the case of 720×720 dpi, and 10 inches/sec in the case of 1440×720 dpi. Moreover, an ink ejection amount of each drop size can be set at 80 pl (picoliter) for "large size" in the "head 1" and "head 4" and 40 pl for "small size", and can be set at 40 pl for "large size" in the "head 2" and "head 3" and 15 pl for "small size".

The adjustment of the embodiment can correspond to a bi-directional printing, and lateral and vertical prints of two heads, and further a two-stage adjustment of a coarse adjustment and a fine adjustment can be performed. As shown in FIG. 48, an appropriate adjustment can be executed in response to a configuration of a printer and a head, a combination of a head and the other, and further the adjustment can be performed in each of a resolution, a main scan speed, an ejection speed, etc., respectively. Moreover, as an ejection angle is different according to mounting precision by a print head or precision in manufacturing, it is preferable that the adjustment is executed in each of print heads required.

And, adjustment values decided in each mode are respectively stored in a nonvolatile memory device such as EEPROM (which can be added to a configuration of the controller 100 of FIG. 9, for example). As described above, a one-time dot alignment is executed in each of printing modes and this is stored, whereby the adjustment values used in response to a printing mode are read out and it becomes possible to perform printing with the adjustment of an optimal depositing position performed in each mode.

Moreover, record contents of FIG. 48 are examples containing a numeric value, and it is needless to say that the present invention is not limited thereto.

Next, an actual adjustment patterns will be illustrated.

Figures 49, 49A:
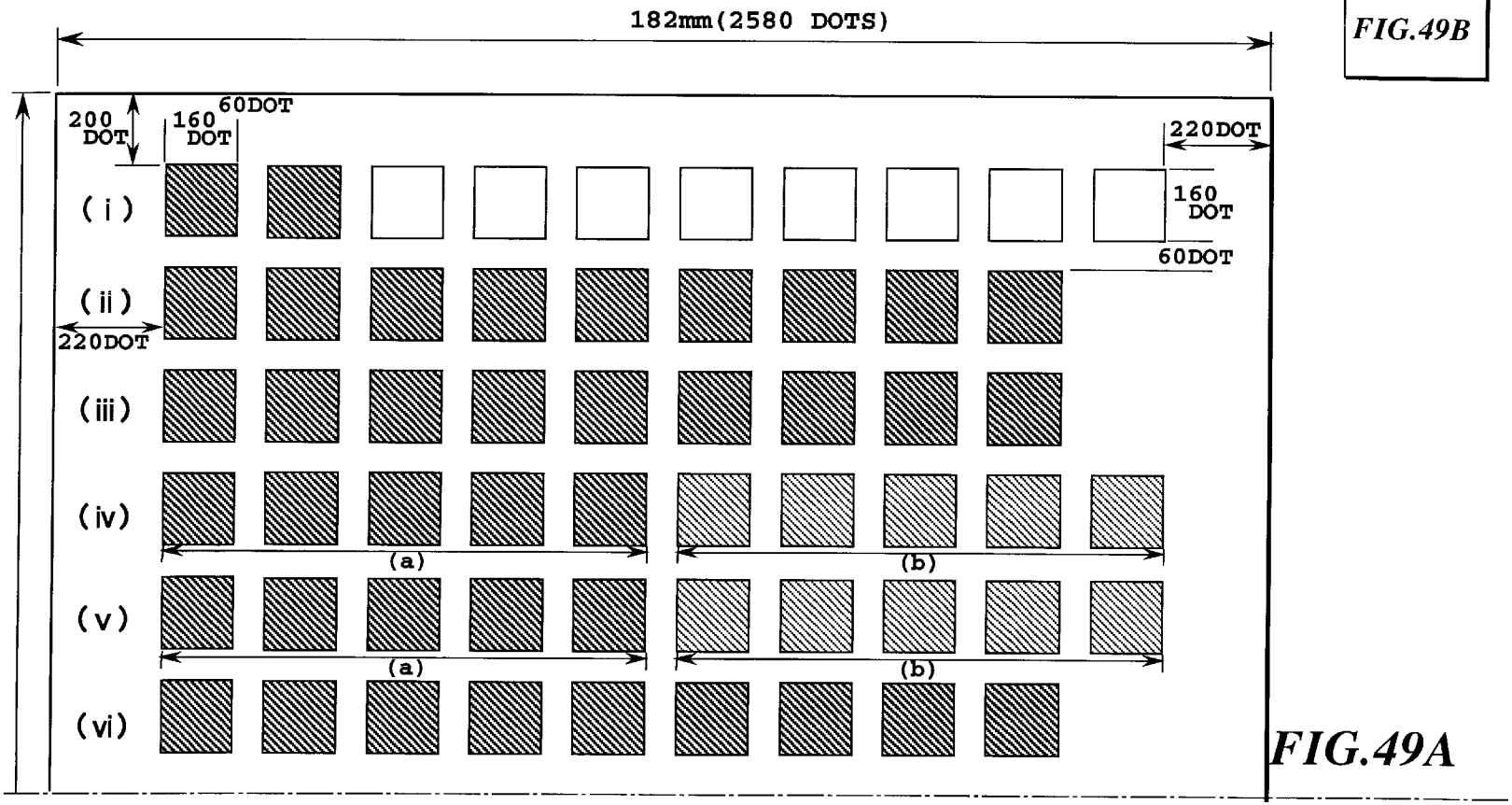
FIG. 49 is a diagram showing the relationship of FIGS. 49A and 49B.
FIG. 49A is an illustration showing one example of the printing patterns being formed or used in the dot alignment processing.
Figure 49B:
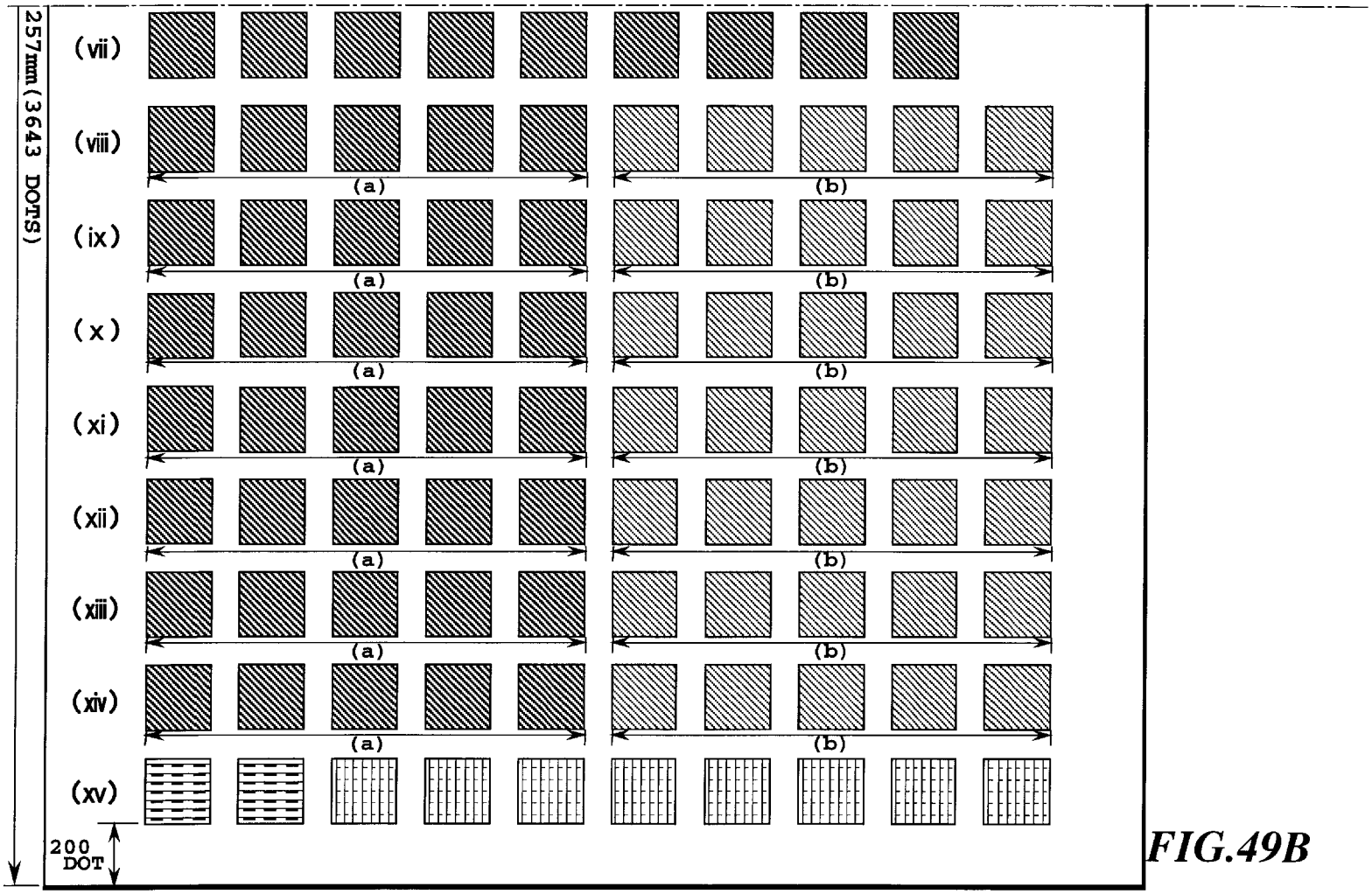
FIG. 49B is an illustration showing one example of the printing patterns being formed or used in the dot alignment processing.

FIG. 49 is a diagram showing the relationship of FIGS. 49A and 49B showing an example of an adjustment pattern, which is formed and utilized in a step of a processing to which a basic processing algorithm of FIG. 45 is applied. The shown pattern is formed corresponding to a size of B5 version (182 mm (2580 dots)×257 mm (3643 dots)), and there are formed, from an upper portion of a page, a patch group (i) formed for the sensor calibration as at step S103 of FIG. 45;

a patch group (ii) of 360×360 dpi formed in the vertical coarse adjustment processing between two heads as at step S104;

a patch group (iii) of 360×360 dpi formed in the bi-directional printing coarse adjustment processing as at step S105 (9 patches formed by offsetting from −4 to +4 at an interval of 1 dot);

a patch group (iv) of 360×360 dpi formed in the bi-directional printing fine adjustment processing as at step S107 (5 patches (a) formed by offsetting from −1 to +1 at an interval of 0.5 dot and 5 patches (b) of the inverted pattern), and a patch group (v) of 180×180 dpi similarly;

a patch group (vi) of 720×720 dpi formed in the bi-directional printing coarse adjustment processing as at step S105 (9 patches formed by offsetting from −4 to +4 at an interval of 1 dot);

a patch group (vii) of 360×360 dpi formed in the lateral coarse adjustment processing between two heads as at step S108 (9 patches formed by offsetting from −4 to +4 at an interval of 1 dot); and a patch group (viii) of 360×360 dpi formed in the lateral (in particular, forward) fine adjustment processing between two heads as at step S109 (5 patches (a) formed by offsetting from −1 to +1 at an interval of 0.5 dot and 5 patches (b) of the inverted pattern), and a patch group (ix) of 360×360 dpi formed in the lateral (reverse) fine adjustment processing between two heads similarly, and each patch group ((x) to (xiv)) of 180×180 dpi, 720×720 dpi and 1440×720 dpi formed in the lateral (bi-directional) fine adjustment processing between two heads similarly (together with the inverted pattern), and a confirmation pattern (xv) formed in a processing as at step S111 is added to the end.

The adjustment pattern shown therein includes one corresponding to various printing modes, and for example, in the printing apparatus of a single head which is not performed an adjustment between two heads, the adjustment between two heads is not required and only a bi-directional adjustment may be performed. A printing mode to be used in the printing apparatus has to be only contained.

Moreover, a plurality of patterns (patches) formed in each processing are formed in a separated manner in the illustrated example, but as mentioned above, these may be formed connectedly or successively. That is, if a correspondence of each dot formation position condition in each processing to a pattern formation position is reliable, the plurality of patterns may be formed as a successive single-pattern. Moreover, if a correspondence of each processing and a pattern formation position corresponding thereto is reliable, patterns in processings may be formed successively.

Moreover, in the case where an ejection speed is different according to a color of used inks, the dot alignment is executed in each color, and the optimal adjustment value of the depositing position may be provided in each color.

Moreover, such adjustment may be performed by one operation for all modes provided in the printing apparatus when a processing procedure is activated, and it may be performed in only a mode designated in response to selection by a user, etc.

Moreover, an activation of the adjustment processing is performed by operations of a start switch, etc. provided in the body of printer, and indication through application of the host device 110, and additionally, for example, taking into consideration a temporal change of each section of the printing apparatus and the head, in the case where the adjustment has not been performed for a long-termed period, an adjustment processing can also be activated or urged using controlling means such as a timer. Moreover, even in the case where a head cartridge 1000 is exchanged, the adjustment processing can be activated or urged.

7. Manual Adjustment and Others (7.1) Manual Adjustment

Next, a manual adjustment (step S119 in the processing procedure of FIG. 30 or FIG. 45) which is performed will be described below, when the automatic dot alignment sequence cannot be performed.

In the apparatus according to the embodiment, the detection of density is performed using an optical sensor. Another dot alignment method is therefore necessary, for example, when the optical sensor cannot be operated electrically or cannot operate optically. In these cases, manual adjustment should be performed. The conditions for shifting to the manual adjustment will be described below.

In order to use the optical sensor, calibration is performed. In this case, if data obtained is clearly outside the usable range, it is a calibration error and the dot alignment operation is stopped. For example, the case where extremely low power of LED in the optical sensor leads to an extremely small quantity of light applied to a measured object, the case where degradation in detection capability caused by the expiration of the life of a photo transistor etc. leads to low power, or the case where the invasion of external light etc. lead to an extremely large quantity of reflected light detected by the photo transistor or the like are the cases where the optical sensor cannot be operated normally.

In these cases, status of that condition is sent to the host computer to display the occurrence of an error via an application. In addition, the display to perform the manual adjustment is performed to urge the execution. Alternatively, when a calibration error is detected, the dot alignment operation is stopped and printing urging to perform the manual adjustment may be performed on a printing medium being fed.

In the manual adjustment, a one-dot ruled line pattern is used. A reference ruled line pattern is printed on a printing medium by the first printing and then a plurality of ruled lines which the relative position condition is different (the ruled line which the offsetting amounts is different) are printed by the second printing. The user observe the printed medium to judge which condition is optimal. Therefore, the position which the depositing positions are registered best is designed to be able to observe at the actual dot position for an easier judgment using a one-dot ruled line.

The manual adjustment includes coarse adjustment and fine adjustment. The latter is performed after the former.

In the coarse adjustment, a ruled line pattern corresponding to tolerance limits of the depositing position which a printing apparatus and its print head have is used. For example, if accuracy of tolerance is +4 dots, the coarse adjustment shown in FIG. 50A is performed.

Figure 50A:
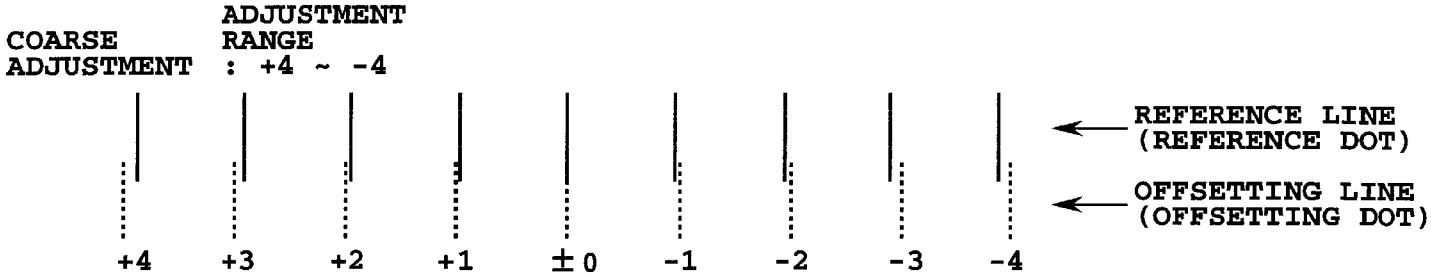
FIGS. 50A and 50B are illustrations describing the coarse adjustment and the fine adjustment of the dot alignment processing by manual operation respectively.

In FIG. 50A, each of reference lines and shifted lines is defined to be printed by a printing method to be adjusted. In this case, the illustration is shown, assuming that the depositing position would be registered when the offsetting or shifting amount is just 0 dot.

The user observe such pattern to judge which condition gives the best depositing position (whether the registration is registered or not) to store through entering the adjustment value into the body of the printing apparatus or inputting it from the host apparatus (a menu of a printer driver etc.).

Figure 50B:
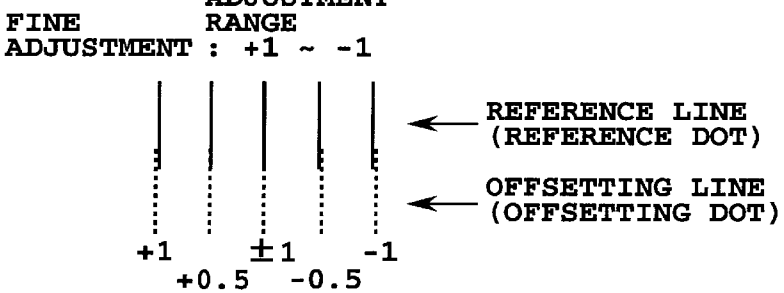

Moreover, in order to perform adjustment with higher accuracy, the fine adjustment is performed by printing the pattern shown in FIG. 50B.

In FIG. 50B, the adjustment is performed every 0.5 dot, but it can be selected according to adjustment capability (resolution and accuracy of adjustment) which a printing apparatus has. As in the coarse adjustment, the user judges which condition gives the best depositing position (whether the registration is registered or not) to perform adjustment. The fine adjustment where adjustment is performed with higher accuracy can be performed on the assumption that the depositing position are adjusted to a certain extent by the coarse adjustment. Without the coarse adjustment, reference lines and shifted lines could be printed on quite different positions respectively. It happens in principle when dot alignment is performed using such a simple ruled line. In this case, only one point is given as the value for adjustment.

(7.2) Difference Between the Manual Adjustment and the Automatic Alignment

In the above automatic dot alignment, on the other hand, reflection density values (or output values of the optical sensor) are measured and a value for adjustment is determined from the measured values. Unlike the manual adjustment, therefore, fine adjustment can be performed without coarse adjustment.

The image patterns used in the automatic dot alignment are ones for measuring reflection density. As in FIG. 37, for example, patterns with the same width are printed by the first and second prints respectively. Each patch (a solid pattern of 100% or a pattern thinned out to a certain extent at need) is finally printed. Not the position but reflection density of its printed dots is measured using an optical sensor. And an optimal adjusting point for the depositing position is determined based on the characteristics of the reflection density.

The cases where adjusting patterns shown in FIGS. 37 and 39 are used will be considered below.

Figure 51A:
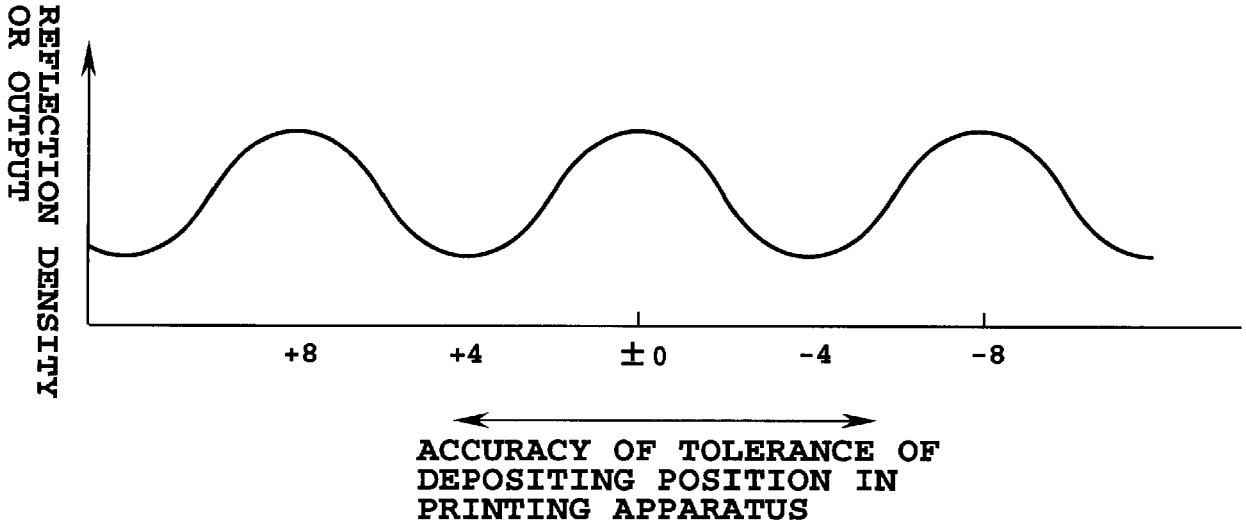
FIGS. 51A and 51B are illustrations describing the coarse adjustment and the fine adjustment of the automatic dot alignment respectively.

FIG. 51A shows reflection density when a 4-dot pattern shown in FIG. 37 is shifted beyond the adjustment limits.

Each patch consists of two pattern elements of 4 dots horizontally arranged (the first printing and the second printing). Therefore, if the pattern elements are shifted each other beyond the adjustment limits and the width from +4 to −4 (8 dots) is considered as one cycle, the maximum or minimum value exists in this range and the very same density characteristic will repeat itself at this cycle. That is to say, this characteristic has features as a trigonometric function and can be represented as $A \cos \theta$. Wherein A represents two times amplitude or the difference between the maximum density and the minimum density, n represents offsetting or shift amount by the dot, and m represents the width of accuracy of tolerance or tolerance range; $\theta = 2\pi n/m$.

That is to say, in this automatic dot alignment processing, a plurality of adjusting points exist in terms of density because of simply taking reflection density into consideration (for example, with a point giving the maximum reflection density as a value for adjustment, three points in the above figure correspond to values for adjustment: +8, 0, and −8). However, accuracy of tolerance of the depositing position which a printing apparatus and its print head have is finite. For example, if accuracy of tolerance is ±4 dots, as is stated above, the maximum and minimum density values are within this range. That is to say, this range includes one cycle. Conversely, determining the width of a pattern used for the coarse adjustment according to accuracy of tolerance of deposition positions which a printing apparatus and its print head have (making width in two pattern elements wider than tolerance limits) ensures the above relationship.

In this way, if an adjusting unit of 1 dot is used, dot alignment can be performed with an accuracy of at least ±1 dot from this density characteristic. But it depends on accuracy of adjustment.

Figure 51B:
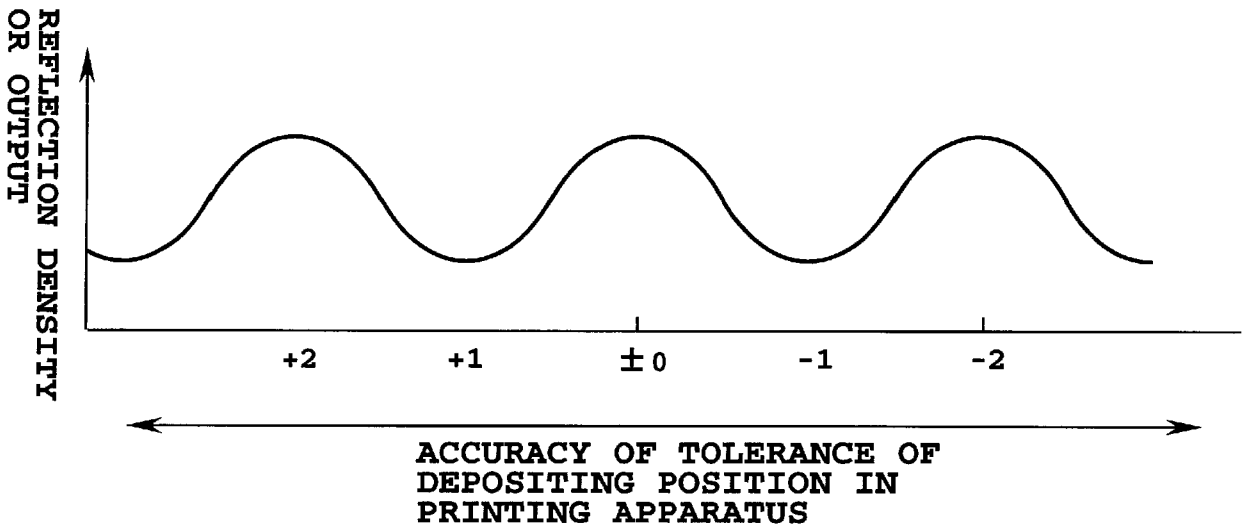

FIG. 51B shows the result of a one-dot pattern shown in FIG. 39 being shifted beyond the adjustment limits in the fine adjustment.

As in FIG. 37, each patch consists of two one-dot pattern elements (the first and second prints). Therefore, if the pattern elements are shifted each other beyond the adjustment limits and the width from +1 to −1 (two dots) is considered as one cycle, the maximum or minimum value exists in this range and the very same density characteristic will repeat itself at this cycle.

The dot alignment will be considered below. A plurality of adjusting points considered from the density exist. For example, with a point giving the maximum reflection density as a value for adjustment, three points in the above figure correspond to values for adjustment: +2, 0, and −2. Actually, becoming resolution of a fine increment. At this point, an adjusting point for the depositing position may be any one of these three points. Because the fine adjustment will be performed within one dot in the range.

The coarse adjustment with an accuracy of ±1 dot has been performed and, therefore, the optimal point of the above three can be identified.

The coarse adjustment is a method of coarsely adjusting within accuracy of tolerance of depositing positions which a printing apparatus and its print head have, while the fine adjustment is a method of adjusting with the highest accuracy which the printing apparatus can attain. They are different from each other in adjusting range and adjusting unit.

The two methods can be performed in any order. That is to say, the coarse adjustment may be performed first or the fine adjustment may be performed first. Because they are different in adjusting unit and they do not affect each other's characteristics. And because the above cyclic characteristic exists. This is the greatest difference between the manual adjustment according to the present invention and common manual adjustment. The two methods different in adjusting range and adjusting unit are combined to quickly obtain a correct value for adjustment without wasting printing media.

As stated above, an adjusting pattern used for the manual adjustment is quite different from that used for the automatic dot alignment.

A printing method or printing apparatus to which the present invention applies is characterized by having these two adjusting patterns different from each other in characteristic and can use one of these two adjusting patterns as required. When an optical sensor cannot be operated electrically or cannot be used optically by the influence of external light etc., as stated above, the depositing position can be adjusted using the manual adjustment.

8. Registration in Performing Image Formation by Bi-directional Printing Accompanied by Variations of Ink Ejection Quantity In the case where a quantity of ink to be ejected is different, an ejection speed is generally different. For example, in the case where large and small droplets are ejected by a print head having an ejecting heater portion shown in FIG. 46 on the condition that a scanning speed and a distance to a printing medium are constant, a small droplet ejection speed is lower than a large droplet ejection speed. Consequently, if the large and small droplets are used together and an image is formed by bi-directional printing, dots formed with the small droplets cannot be registered with dots formed with the large droplets simply by accepting the printing position condition established for the bi-directional printing with the large droplets.

Referring to FIG. 52, explanation will be made on misalignment of the dots formed with the large and small droplets.

In FIG. 52, patterns (a) and (b) illustrate ideal depositing positions when the large dots are formed with the large droplets at 360 dpi in a main scanning direction and ideal depositing positions when the small dots are formed with the small droplets at 720 dpi in the main scanning direction, respectively. Furthermore, a pattern (c) illustrates ideal depositing positions when the large and small dots are formed in mixture at 720 dpi (360 dpi between the large dots and between the small dots) in the main scanning direction.

A pattern (d) illustrates the result of dot formation in a manner similar to the pattern (c) on the assumption that an ejection speed of the large droplet is 20 m/s, an ejection speed of the small droplet is 18 m/s, a carriage speed (a main scanning speed) is 20 inch/s and a distance from an ejection opening to a surface to be printed is 1.4 mm in a printing apparatus which uses a head capable of ejecting ink in a direction perpendicular to the surface to be printed of a printing medium (i.e., a vertical direction if the surface to be printed is oriented in a horizontal direction). In this case, the dot formed with the small droplet is offset by about 5 $\mu$m in the main scanning direction from the dot formed in the ideal depositing position or from the dot formed with the large droplet to which the dot formed with the small droplet should be adjacent. An optimum printing position condition is established for the large droplet, and further, the small droplet is to be ejected prior to the large droplet in the forward direction while the large droplet is to be ejected prior to the small droplet in the reverse direction. Under such conditions, the dots are offset by about 5 $\mu$m right in the forward direction and left in the reverse direction, respectively, with respect to the ideal depositing positions, and as a result, the total offset amount of the printing positions between the small droplets in both of the forward and reverse directions becomes about 10 $\mu$m.

A pattern (e) illustrates the result of dot formation on the same conditions as those of the pattern (d) except that the ejection speed of the small droplet is 10 m/s. In this case, in view of operation of the printing apparatus, the dot formed with the small droplet overlaps the dot formed with the large droplet with an offset amount of about 35 $\mu$m in the main scanning direction. An optimum printing position condition is established for the large droplet. In the meantime, the small droplet is ejected prior to the large droplet in the forward direction while the large droplet is ejected prior to the small droplet in the reverse direction, so that the total offset amount of the depositing positions between the small dots in both of the forward and reverse directions becomes 70 $\mu$m.

A pattern (f) illustrates the result of dot formation on the same conditions as those of the pattern (e) except that the small droplet is ejected prior to the large droplet in both of the forward and reverse directions. In this case, the total offset amount of the printing positions between the small droplets in both of the forward and reverse directions becomes about 35 $\mu$m. Moreover, misalignment between the printing positions occurs also between the large droplets in both of the forward and reverse directions, wherein the offset amount becomes about 35 $\mu$m.

A pattern (g) illustrates the result of dot formation in which the printing position in the reverse direction is corrected by 35 $\mu$m in a direction opposite to the reverse scanning direction in the pattern (f). In this case, each of the offset amounts of the printing positions between the large droplets and between the small droplets in both of the forward and reverse directions becomes substantially 0 $\mu$m.

If the offset amount of the ideal depositing positions between the large or small droplets in the bi-directional printing by the factors such as the ejection angle, a ratio in speed between the large and small droplets, a main scanning speed and the distance from the ejection opening to the surface to be printed is about 10 $\mu$m or less, "a granular impression" is hardly given to human eyes, thus obtaining a printout of good quality.

As a consequence, in the case where the offset amount of the depositing positions in the bi-directional printing is 10 $\mu$m or less, the small droplet is ejected prior to the large droplet in the forward direction while the large droplet is ejected prior to the small droplet in the reverse direction. At this time, as the printing position conditions can be used the optimum printing position conditions such established as described above for the bi-directional printing with either one of the large and small droplets (e.g., the large droplet).

The registration conditions may be established on the basis of a pattern approximate to an actual printing pattern formed with large and small dots in mixture.

FIGS. 53A to 53C and FIG. 54 illustrate one example in which the registration conditions are established on the basis of a printing pattern formed with large and small dots, and which includes coarse registration (FIGS. 53A to 53C) and fine registration (FIG. 54) in the same manner as described above.

Figure 53A:
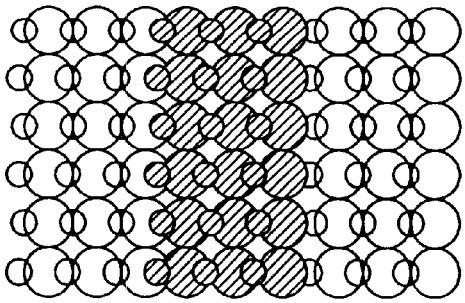
FIGS. 53A to 53C are schematic views illustrating one example of coarse registration in the bi-directional printing in the case where an offset between depositing positions of the large and small droplets is relatively small.
Figure 53B:
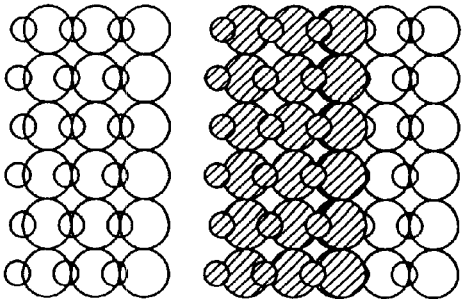
Figure 53C:
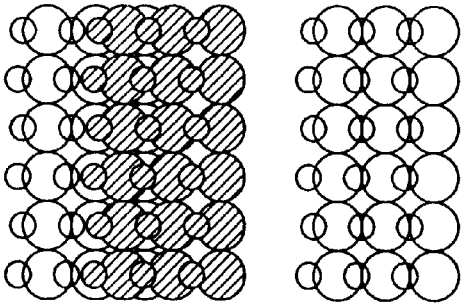

In order to obtain a registered pattern illustrated in FIG. 53A by the coarse registration, reference dots are formed with large and small droplets by forward scan printing in substantially the same procedures as those of FIGS. 37A to 37E, and then, shifted dots are formed by the reverse scanning printing on varied registration conditions. That is, assuming that an shifting amount in printing without any registration is set to 0 dot, the pattern is formed by shifting the dots within the range of the predetermined number of dots in the plus (+) and minus (−) reverse scanning directions (see FIGS. 53B and 53C).

In the same manner as the description in reference to FIG. 38, it is possible to obtain an adjustment value (a coarse adjustment value) in the case of the bi-directional printing.

Subsequently, although fine registration can be implemented with higher printing registration precision by the bi-directional printing in the same processes as those illustrated in FIGS. 39A to 39E, registration precision may be enhanced in the same processes as those illustrated in FIGS. 40 to 43.

Figure 54:
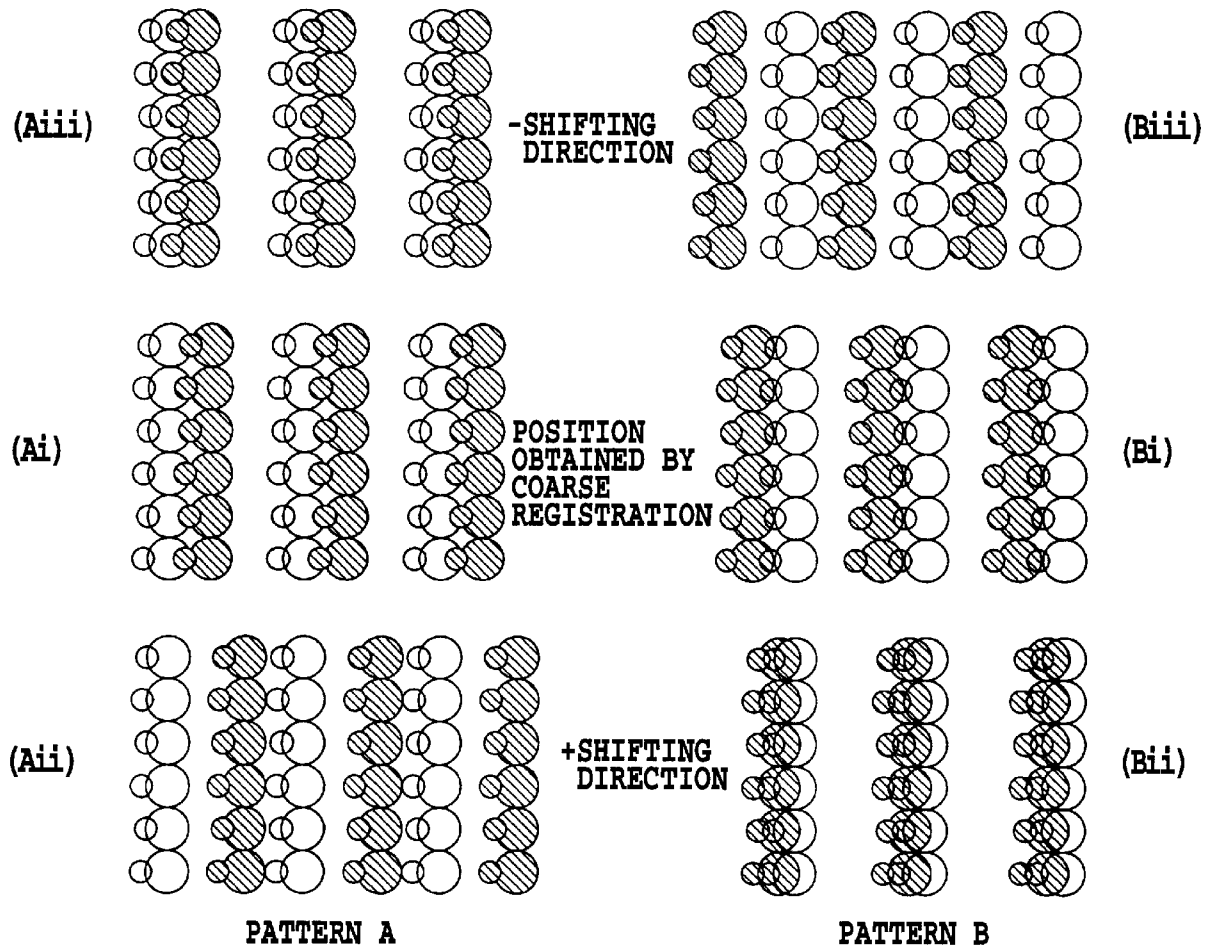
FIG. 54 is a schematic views illustrating one example of fine registration in the bi-directional printing in the case where the offset between the depositing positions of the large and small droplets is relatively small.
Figure 55A:
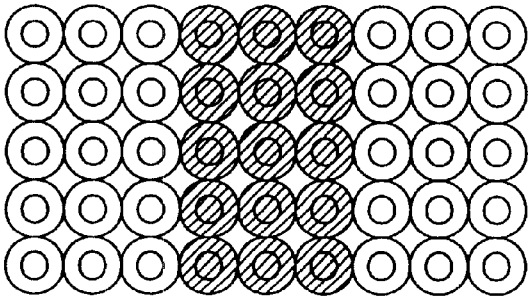
FIGS. 55A to 55C are schematic views illustrating one example of coarse registration in the bi-directional printing in the case where the offset between the depositing positions of the large and small droplets is relatively large.
Figure 55B:
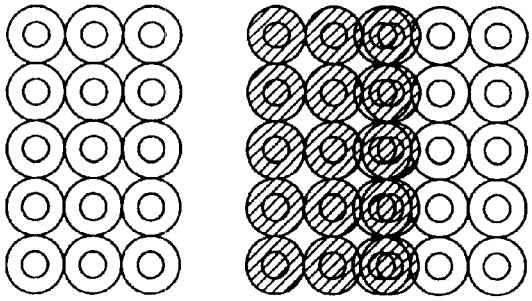
Figure 55C:
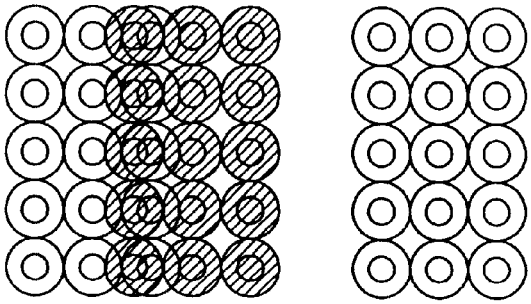
Figure 56:
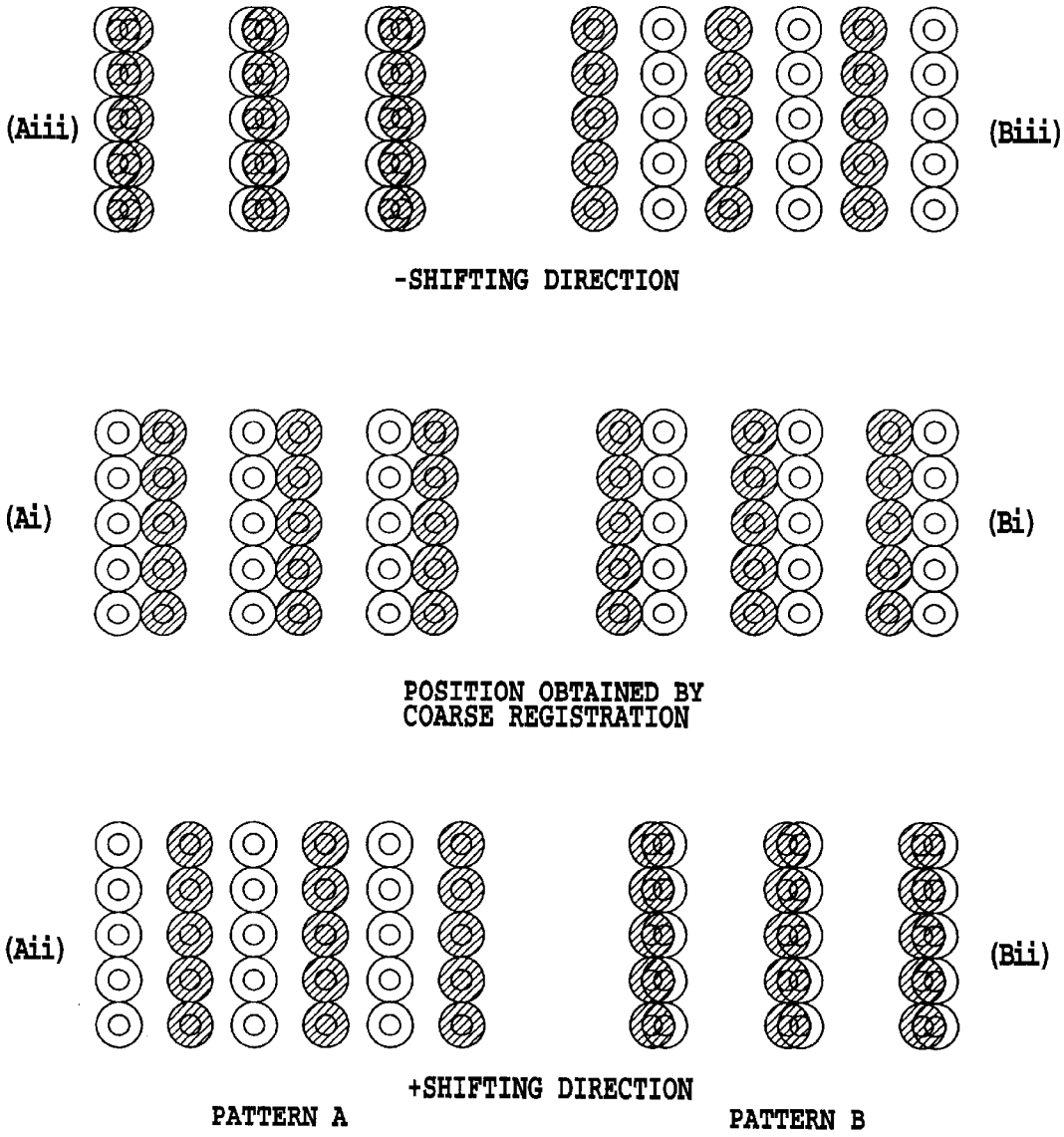
FIG. 56 is schematic view illustrating one example of fine registration in the bi-directional printing in the case where the offset between the depositing positions of the large and small droplets is relatively large.

As illustrated in FIG. 54, a registered position at which the dot depositing positions are registered with each other can be obtained at the intersection between the characteristics of density changes of a patch group (including patterns (Aii) and (Aiii)) formed by varying the registration condition (i.e., a dot shifting amount) of the depositing position of the dot in the reverse scanning direction and the characteristics of density changes of another patch group (including patterns (Bi) to (Biii)) obtained by forming the dot in the reverse scanning direction at a position linearly symmetric to a reference dot on each of the registration conditions in the plus (+) and minus (−) directions with respect to a pattern (Ai) obtained by the bi-directional printing on the positional conditions established by the coarse registration.

In this way, in the case where the offset amount of the depositing positions by the bi-directional printing is 10 μm or less, the small droplet is ejected prior to the large droplet in the forward direction while the large droplet is ejected prior to the small droplet in the reverse direction, and further, the registration conditions can be established on the basis of the pattern approximate to the actual printing pattern formed with the large and small dots.

To the contrary, in the case where the offset amount of the ideal depositing positions by the bi-directional printing is more than 10 μm, the large and small droplets are ejected in the same order in both of the forward and reverse directions (that is, the large droplet is ejected prior to the small droplet). Furthermore, the conditions of the printing positions are obtained in the similar processes illustrated in FIGS. 55A to 55C and FIG. 56 as those illustrated in FIGS. 53A to 53C and FIG. 54. With respect to the reverse direction, it is sufficient to correct the positions in the direction opposite to the reverse direction by an amount corresponding to an initial offset amount of the bi-directional depositing positions of the large and small droplets.

With respect to the offset amount of the bi-directional depositing position illustrated in FIG. 52E, the large and small droplets are deposited at the same position so that the small dot completely overlaps the large dot. Consequently, although the small droplet need not always be ejected in the case of no influence on the density change of the registering pattern, it is preferable that the pattern should be formed with both of the large and small droplets in the case where the overlap causes changes of the dot area or density.

The offset amount of the bi-directional depositing positions substantially depends upon the specifications of the head or the apparatus (for example, the ejection speed of at least two kinds of large and small droplets, or main scanning speed, or the distance from the ejection opening to the surface to be printed). Therefore, there are provided means indicating its own information electrically, electronically, mechanically, magnetically or optically on the side of the print head and corresponding means for receiving the indicated information at the head attaching portion of the apparatus, so that it is possible to acquire data relating to the offset amount of the bi-directional depositing positions by required calculation on the basis of the indicated information and its own specifications, so as to determine the necessity of or the correction value for the registration at the time of printing with the large and small dots. These processes can be performed during the above-described dot alignment sequence by the controller 100. The summation of speed vectors as described in reference to FIG. 47 may be considered at the time of the calculation required for determining the offset amount of the bi-directional depositing positions.

Moreover, although the registration is carried out at the plurality of stages (i.e., the coarse and fine registrations) in the present embodiment, the registration may be carried out at a single stage within a desired range. Additionally, although the registration conditions are automatically determined on the basis of the formed pattern in the present embodiment, they may be determined manually.

9. Others

In each of the above embodiments, an example of an ink jet printing apparatus in which the ink is ejected from its print head on a printing medium to form an image has been shown. However, the present invention is not limited to this configuration. The present invention is also applicable to a printing apparatus of any type which performs printing by moving its print head and a printing medium relatively and to form dots.

However, in the case that an ink jet printing method is applied, the present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

Additionally, in the above embodiments, the processing of printing registration is carried out in the side of the printing apparatus. The processing may be carried out in the side of a host computer or the like, appropriately. That is, though a printer driver installed in the host computer 110 shown in FIG. 9 is designed to supply image data made to the printing apparatus, in addition to this, the printer driver may be designed to make test patterns (printing patterns) for printing registration and to supply them to the printing apparatus, and further designed to receive values read from the test patterns by an optical sensor on the printing apparatus for calculating adjustment amount.

Further, a printing system, in which program codes of software or the printer driver for realizing the foregoing functions in the embodiments are supplied to a computer within the machine or the system connected to various devices including the printing apparatus in order to operate various devices for realizing the function of the foregoing embodiment, and the various devices are operated by the programs stored in the computer (CPU or MPU) in the system or machine, is encompassed within the scope of the present invention.

Also, in this case, the program codes of the software per se performs the functions of the foregoing embodiment. Therefore, the program codes per se, and means for supplying the program codes to the computer, such as a storage medium storing, are encompassed within the scope of the present invention.

As the storage medium storing the program codes. floppy disk, a hard disk, an optical disk, a CD-ROM, a magnetic tape, a non-volatile memory card, ROM and the like can be used, for example.

In addition, the function of the foregoing embodiments is realized not only by executing the program codes supplied to the computer but also by cooperatively executing the program codes together with an OS (operating system) active in the computer or other application software. Such system is also encompassed within the scope of the present invention.

Furthermore, a system, in which the supplied program codes are one stored in a function expanding board of the computer or a memory provided in a function expanding unit connected to the computer, and then a part of or all of processes are executed by the CPU or the like provided in the function expanding board or the function expanding unit on the basis of the command from the program code, is also encompassed within the scope of the present invention.

According to the present invention, it is possible to obtain the optimum adjustment values of the depositing positions of the printing dots in the first printing and the second printing in the forward and reverse directions in which the mutual dot formation registrations should be performed, or in the first printing and the second printing of each of the plurality of print heads. Thus, it is possible to provide the printing method and the printing apparatus in which the bi-directional printing without any depositing misalignment or the printing by the use of the plurality of print heads can be performed, inclusive of the case where at least the two kinds of large and small dots are deposited.

In addition, an apparatus or system which can printing a high-quality image at high speed can be achieved at low cost without problems about the formation of an image or operation.

The present invention has been described in detail with respect to preferred embodiments, and it will now be apparent from the foregoing to those skilled in the art that changes and modifications may be made without departing from the invention in its broader aspect, and it is the invention, therefore, in the apparent claims to cover all such changes to cover all such changes and modifications as fall within the true spirit of the invention.

What is claimed is:

1. A printing registration method for performing printing registration in a first printing and a second printing with respect to a printing apparatus for printing an image on a printing medium by the first printing and the second printing with predetermined conditions of dot forming positions by using a print head, in which a dot can be changed in at least two kinds of large and small sizes, said method comprising the steps of:

forming a plurality of patterns according to a plurality of shifting amounts of relative printing positions between the first printing and the second printing by controlling the print head, the pattern being formed with at least either one of the large and small dots by the first printing and the second printing;

acquiring an adjustment value of a dot forming position condition between the first printing and the second printing on the basis of the shifting amounts of the relative printing positions among the plurality of formed patterns; and correcting the adjustment value according to an offset amount of the forming position caused by printing operation by the first printing and the second printing with at least the other of the large and small dots.

2. A printing registration method as claimed in claim 1, wherein said adjustment value acquiring step has the steps of:

measuring optical characteristics of each of the plurality of patterns formed in said pattern forming step; and acquiring the adjustment value on the basis of the measured optical characteristics of each of the plurality of patterns.

3. A printing registration method as claimed in claim 2, wherein said pattern forming step has the step of forming a first pattern and a second pattern different in shifting direction of the printing position of the second printing relative to the first printing according to the plurality of shifting amounts, the pattern being formed by the first printing and the second printing; and said adjustment value acquiring step has the step of measuring optical characteristics of each of the plurality of the formed first patterns and optical characteristics of each of the formed plurality of the second patterns, so as to acquire the adjustment values of the conditions of the dot forming positions between the first printing and the second printing on the basis of intersections between a change characteristic of the measured optical characteristics of each of the plurality of the first patterns and a change characteristic of the measured optical characteristics of each of the plurality of the second patterns.

4. A printing registration method as claimed in claim 2, wherein said adjustment value acquiring step derives said adjustment value by calculation employing continuous values on the basis of optical characteristics data obtained from said measuring step by using a linear approximation or a polynominal approximation.

5. A printing registration method as claimed in claim 1, further comprising the step of allowing said pattern forming step and said adjustment value acquiring step to be performed a plurality of times with different dot registration precisions.

6. A printing registration method as claimed in claim 5, wherein said step of allowing said pattern forming step and said adjustment value acquiring step to be performed a plurality of times with different dot registration precisions includes the steps of:

coarsely performing the registration with precision per dot; and finely performing the registration with precision within one dot;

the fine registration being performed after the coarse registration, or the coarse registration being performed after the fine registration.

7. A printing registration method as claimed in claim 1, wherein, in said pattern forming step, the dots formed by said first printing and the dots formed by said second printing are arranged, and relative positional relationship of said dots is varied corresponding to said plurality of shifting amount, and a ratio of said dots covering said printing medium is varied, thereby to form said plurality of patterns having optical characteristics corresponding to said shifting amounts.

8. A printing registration method as claimed in claim 1, wherein the first printing and the second printing include printing in forward scanning and printing in reverse scanning, respectively, in performing printing with the large and small dots by scanning the print head forwardly and reversely with respect to the printing medium.

9. A printing registration method as claimed in claim 8, wherein the order of formation of the large and small dots is controlled in the forward scanning and the reverse scanning with the predetermined shifting amount as a threshold, and in said correcting step, an inverse of the shifting amount is used for the correction in forming the other of the large and small dots in the reverse scanning.

10. A printing registration method as claimed in claim 1, further comprising the step of calculating the offset amount.

11. A printing registration method as claimed in claim 10, wherein said print head is a head for performing printing by ejecting ink from ejection openings, said calculating step performs the calculation on the basis of respective speeds of the ink ejection for forming the large and small dots, a speed for relatively scanning the printing medium by the print head, and a distance from the ejection openings to the printing medium.

12. A printing registration method as claimed in claim 11, wherein said printing head has heating elements for generating thermal energy to make the ink to film-boil, as an energy used for ejecting the ink.

13. A printing apparatus for printing an image on a printing medium by a first printing and a second printing with predetermined conditions of dot forming positions by using a print head, in which a dot can be changed in at least two kinds of large and small sizes, comprising:

means for forming a plurality of patterns according to a plurality of shifting amounts of relative printing positions between the first printing and the second printing by controlling the print head, the pattern being formed with at least either one of the large and small dots by the first printing and the second printing;

means for acquiring an adjustment value of a dot forming position condition between the first printing and the second printing on the basis of the shifting amounts of the relative printing positions among the plurality of formed patterns; and means for correcting the adjustment value according to an offset amount of the forming position caused by printing operation by the first printing and the second printing with at least the other of the large and small dots.

14. A printing apparatus as claimed in claim 13, wherein said adjustment value acquiring means has:

means for measuring optical characteristics of each of the plurality of patterns formed by said pattern forming means; and means for acquiring the adjustment value on the basis of the measured optical characteristics of each of the plurality of patterns.

15. A printing apparatus as claimed in claim 14, wherein said pattern forming means has means for forming a first pattern and a second pattern different in shifting direction of the printing position of the second printing relative to the first printing according to the plurality of shifting amounts, the pattern being formed by the first printing and the second printing; and said adjustment value acquiring means has means for measuring optical characteristics of each of the plurality of the formed first patterns and optical characteristics of each of the formed plurality of the second patterns, so as to acquire the adjustment values of the conditions of the dot forming positions between the first printing and the second printing on the basis of intersections between a change characteristic of the measured optical characteristics of each of the plurality of the first patterns and a change characteristic of the measured optical characteristics of each of the plurality of the second patterns.

16. A printing apparatus as claimed in claim 14, wherein said adjustment value acquiring means derives said adjustment value by calculation employing continuous values on the basis of optical characteristics data obtained from said measuring means by using a linear approximation or a polynominal approximation.

17. A printing apparatus as claimed in claim 13, further comprising means for allowing the pattern formation and the adjustment value acquirement to be performed a plurality of times with different dot registration precisions.

18. A printing apparatus as claimed in claim 17, wherein said step for allowing the pattern formation and the adjustment value acquirement to be performed a plurality of times with different dot registration precisions includes:

means for coarsely performing the registration with precision per dot; and means for finely performing the registration with precision within one dot;

the fine registration being performed after the coarse registration, or the coarse registration being performed after the fine registration.

19. A printing apparatus as claimed in claim 13, wherein, in the pattern forming by said pattern forming means, the dots formed by said first printing and the dots formed by said second printing are arranged, and relative positional relationship of said dots is varied corresponding to said plurality of shifting amount, and a ratio of said dots covering said printing medium is varied, thereby to form said plurality of patterns having optical characteristics corresponding to said shifting amounts.

20. A printing apparatus as claimed in claim 13, wherein the first printing and the second printing include printing in forward scanning and printing in reverse scanning, respectively, in performing printing with the large and small dots by scanning the print head forwardly and reversely with respect to the printing medium.

21. A printing apparatus as claimed in claim 20, wherein the order of formation of the large and small dots is controlled in the forward scanning and the reverse scanning with the predetermined shifting amount as a threshold, and in the correcting by said correcting means, an inverse of the shifting amount is used for the correction in forming the other of the large and small dots in the reverse scanning.

22. A printing apparatus as claimed in claim 13, further comprising means for calculating the offset amount.

23. A printing apparatus as claimed in claim 22, wherein said print head is a head for performing printing by ejecting ink from ejection openings, said calculating means performs the calculation on the basis of respective speeds of the ink ejection for forming the large and small dots, a speed for relatively scanning the printing medium by the print head, and a distance from the ejection openings to the printing medium.

24. A printing apparatus as claimed in claim 23, wherein said printing head has heating elements for generating thermal energy to make the ink to film-boil, as an energy used for ejecting the ink.

25. A printing system provided with a printing apparatus for printing an image on a printing medium by a first printing and a second printing with predetermined conditions of dot forming positions by using a print head, in which a dot can be changed in at least two kinds of large and small sizes, and a host apparatus for supplying an image data to said printing apparatus, comprising:

means for forming a plurality of patterns according to a plurality of shifting amounts of relative printing positions between the first printing and the second printing by controlling the print head, the pattern being formed with at least either one of the large and small dots by the first printing and the second printing;

means for acquiring an adjustment value of a dot forming position condition between the first printing and the second printing on the basis of the shifting amounts of the relative printing positions among the plurality of formed patterns; and means for correcting the adjustment value according to an offset amount of the forming position caused by printing operation by the first printing and the second printing with at least the other of the large and small dots.

26. A storage medium which is connected to an information processing apparatus and a program stored in which is readable by the information processing apparatus, said program being for making a printing system to perform a method for processing for performing printing registration in a first printing and a second printing with respective to a printing apparatus for printing an image on a printing medium by the first printing and the second printing with predetermined conditions of dot forming positions by using a print head, in which a dot can be changed in at least two kinds of large and small sizes, said method comprising the steps of:

forming a plurality of patterns according to a plurality of shifting amounts of relative printing positions between the first printing and the second printing by controlling the print head, the pattern being formed with at least either one of the large and small dots by the first printing and the second printing;

acquiring an adjustment value of a dot forming position condition between the first printing and the second printing on the basis of the shifting amounts of the relative printing positions among the plurality of formed patterns; and correcting the adjustment value according to an offset amount of the forming position caused by printing operation by the first printing and the second printing with at least the other of the large and small dots.

* * * * *